US008678243B2

(12) United States Patent
Collins et al.

(10) Patent No.: US 8,678,243 B2
(45) Date of Patent: Mar. 25, 2014

(54) FLUID DISPENSER

(75) Inventors: James Terence Collins, Huntingdon (GB); Thomas Franz Paul Gratzfeld, Hemer (DE); Heiko Harms, Hemer (DE); Werner Hertrampf, Hemer (DE); Richard David Lintern, Huntingdon (GB); Gerdhard Niebecker, Hemer (DE); Allen John Pearson, Huntingdon (GB); Paul Kenneth Rand, Ware (GB); Karl Heinz Waitz, Hemer (DE); Karl Gisbert Welp, Hemer (DE)

(73) Assignees: Glaxo Group Limited, Brentford, Middlesex (GB); MeadWestVaco Calmar GmbH, Hemer (DE)

( * ) Notice: Subject to any disclaimer, the term of this patent is extended or adjusted under 35 U.S.C. 154(b) by 645 days.

(21) Appl. No.: 12/601,361

(22) PCT Filed: May 30, 2008

(86) PCT No.: PCT/EP2008/056655

§ 371 (c)(1),
(2), (4) Date: Mar. 10, 2010

(87) PCT Pub. No.: WO2008/145714

PCT Pub. Date: Dec. 4, 2008

(65) Prior Publication Data

US 2010/0163582 A1 Jul. 1, 2010

(30) Foreign Application Priority Data

May 30, 2007 (GB) ..... 0710315.3
Nov. 29, 2007 (GB) ..... 0723420.6

(51) Int. Cl.
*B65D 88/54* (2006.01)

(52) U.S. Cl.
USPC ..... 222/321.6; 222/385

(58) Field of Classification Search
USPC ..... 222/321.6, 321.1, 321.7, 321.9, 385
See application file for complete search history.

(56) References Cited

U.S. PATENT DOCUMENTS

| | | | | |
|---|---|---|---|---|
| 1,579,806 | A | | 4/1926 | Ball et al. |
| 3,786,963 | A | * | 1/1974 | Metzler, III ..... 222/136 |
| RE28,366 | E | * | 3/1975 | Pechstein ..... 239/333 |
| 3,877,616 | A | * | 4/1975 | Stevens ..... 222/321.9 |
| 3,921,861 | A | * | 11/1975 | Kondo ..... 222/257 |
| 4,105,146 | A | | 8/1978 | Broillard |
| 4,249,681 | A | | 2/1981 | French |
| 4,262,823 | A | * | 4/1981 | Monden ..... 222/321.9 |
| 4,726,747 | A | | 2/1988 | Skorka |
| 5,176,296 | A | * | 1/1993 | Lina et al. ..... 222/321.2 |
| 5,207,659 | A | | 5/1993 | Theot et al. |
| 5,624,055 | A | | 4/1997 | Clanet et al. |
| 5,657,930 | A | | 8/1997 | Battegazzore |
| 5,816,455 | A | | 10/1998 | Alpers et al. |

(Continued)

FOREIGN PATENT DOCUMENTS

| | | |
|---|---|---|
| DE | 10017438 A1 | 10/2001 |
| DE | 19610456 B4 | 10/2006 |

(Continued)

*Primary Examiner* — Lien Ngo
(74) *Attorney, Agent, or Firm* — Dwight S. Walker

(57) ABSTRACT

One aspect of the invention provides a component for a fluid dispenser which defines a dosing chamber for a piston member to stroke in and has an end adapted for engaging a fluid outlet of the fluid dispenser or a seal which overlies the fluid outlet to selectively close and open the fluid outlet or seal. Other aspects are disclosed herein.

27 Claims, 33 Drawing Sheets

(56) References Cited

U.S. PATENT DOCUMENTS

| | | | | |
|---|---|---|---|---|
| 5,850,948 | A * | 12/1998 | Garcia et al. | 222/321.9 |
| 6,050,457 | A * | 4/2000 | Arnold et al. | 222/321.9 |
| 6,234,363 | B1 | 5/2001 | Stradella | |
| 6,406,207 | B1 | 6/2002 | Wiegner et al. | |
| 6,505,622 | B2 | 1/2003 | Py | |
| 6,516,976 | B2 | 2/2003 | Lewis et al. | |
| 6,540,117 | B2 | 4/2003 | Powling | |
| 7,837,070 | B2 * | 11/2010 | Marelli | 222/321.7 |
| 2004/0035886 | A1 | 2/2004 | Cordomi | |
| 2005/0236434 | A1 | 10/2005 | Bonney | |
| 2009/0026224 | A1 | 1/2009 | Duquet et al. | |
| 2009/0236445 | A1 | 9/2009 | Lintern et al. | |

FOREIGN PATENT DOCUMENTS

| | | | |
|---|---|---|---|
| EP | 1202818 | | 5/2002 |
| EP | 1375011 | A1 | 6/2003 |
| FR | 2708314 | A1 | 2/1995 |
| GB | 2002847 | A | 2/1979 |
| JP | 57165264 | U | 10/1982 |
| NZ | 523949 | | 4/2003 |
| SU | 253691 | | 11/1970 |
| WO | 9220460 | A1 | 11/1992 |
| WO | 9525261 | A1 | 9/1995 |
| WO | 02/35121 | A1 | 5/2002 |
| WO | 02/100463 | A1 | 12/2002 |
| WO | 03/078075 | A1 | 9/2003 |
| WO | 2004/026489 | A1 | 4/2004 |
| WO | 200530401 | A1 | 4/2005 |
| WO | 200544449 | A2 | 5/2005 |
| WO | 200545292 | A1 | 5/2005 |
| WO | 200575103 | A1 | 8/2005 |
| WO | 2010004212 | A1 | 1/2010 |
| WO | 2010004224 | A2 | 1/2010 |

* cited by examiner 116
116a
112
118
116b
195
148
176m
128
114
176
170

116
116a
112
118
116b
195
148
128
114
176m
176
170

116
112
148
195
128
116a
116b
114
176m
176
170

FLUID DISPENSER

CROSS-REFERENCE TO RELATED APPLICATIONS

This application is filed pursuant to 35 U.S.C. §371 as a United States National Phase Application of International Application No. PCT/EP2008/056655 filed May 30, 2008, which claims priority from GB 0710315.3 filed May 30, 2007and GB 0723420.6 filed Nov. 29, 2007 in the United Kingdom.

CROSS-REFERENCE TO EARLIER APPLICATION

The present application claims priority from UK patent application Nos. 0710315.3 and 0723420.6 respectively filed on 30 May 2007 and 29 Nov. 2007.

FIELD OF THE INVENTION

The present invention relates to a fluid dispenser, for example for a nasal spray, and is particularly, but not exclusively, concerned with a fluid dispenser for drug administration.

BACKGROUND OF THE INVENTION

Prior art fluid dispensers, e.g. for dispensing fluids into a nasal cavity, are known from US-A-2005/0236434 and WO-A-2005/075103, the entire original disclosures of which (as well as their patent family members) are incorporated herein by way of reference. These dispensers comprise a fluid reservoir, an outlet and a pump for pumping fluid from the reservoir through the outlet. The outlet is provided in a nozzle, which nozzle may be shaped and sized for positioning in a nostril. As the dispensers are for dispensing a metered volume of the fluid, they further comprise a metering chamber which is selectively placed in fluid communication with the reservoir, through at least one metering chamber inlet, and the outlet. The pump reciprocates to move the metering chamber between an expanded state, in which the metering chamber has a first volume greater than the metered volume, and a contracted state. The dispensers further comprise a one-way valve between the metering chamber and the outlet which is biased to a 'valve-closed' position. When the metering chamber moves from its contracted state to its expanded state, the metering chamber and reservoir are placed in fluid communication through the at least one inlet and fluid is drawn from the reservoir into the metering chamber to fill the metering chamber with an excess volume of fluid. When the metering chamber moves from the expanded state towards the contracted state, there is an initial bleed phase in which the surplus volume of fluid in the metering chamber is pumped back into the reservoir through the at least one inlet to leave a metered volume of fluid in the metering chamber. In a final dispensing phase of movement of the metering chamber back to its contracted state, the metered volume of fluid in the metering chamber is pumped towards the one-way valve whereby the increasing pressure produced in the fluid causes the one-way valve to temporarily open to enable the metered volume to be pumped from the outlet.

Other fluid dispenser arrangements are disclosed in FIGS. 1 to 21 of WO-A-2007/138084.

An aim of the present invention is to provide a novel fluid dispenser and novel components for a fluid dispenser, which fluid dispenser optionally incorporates the pumping principle disclosed in US-A-2005/0236434 and WO-A-2005/075103.

SUMMARY OF THE INVENTION

A first aspect of the present invention provides a component for a fluid dispenser which defines a dosing chamber for a piston member to stroke in and an end adapted for engaging a fluid outlet of the fluid dispenser or a seal which overlies the fluid outlet to selectively close and open the fluid outlet or seal The end may be in the form of a tip. The component may be an assembly of parts. A first such part may form the end. The first part may be a cap part The component may be provided with a seal on its outer surface for forming a sliding sealing fit in the fluid dispenser. The seal may be of the lip-seal type. The seal may be presented by the first part of the component.

The dosing chamber may be a first chamber with the component defining a second chamber, a fluid pathway between the dosing and second chambers and having a valve to selectively open and close the fluid pathway.

A second aspect of the present invention provides a fluid dispenser for use with a fluid supply, the dispenser having a dosing chamber, a fluid outlet, and a piston member which is arranged to sealingly stroke in the dosing chamber (i) in a first direction for filling the dosing chamber with fluid from the supply, and (ii) in a second direction to dispense fluid from the chamber towards the fluid outlet, wherein the dosing chamber has first and second sections of different widths, the first section is narrower than the second section and located in the second direction relative to the second section, and the piston member is in constant sealingly contact with the second section as it strokes in the first and second directions, but only in sealing contact with the first section in a portion of the strokes in the first and second directions.

The piston member may be provided with a seal to sealingly contact with the first section. The seal may have an outer dimension which is no less than the width of the first section and less than the width of the second section.

The seal may form a one-way valve with the piston member. The seal may be of the lip-seal type. The seal may be located on an end of the piston member.

The piston member may be provided with a seal to sealingly contact the second section of the dosing chamber. The seal may be of the lip-seal type.

The piston member may be provided with a fluid conduit for communicating with the fluid supply and through which, in use, fluid is conveyed from the fluid supply into the dosing chamber when the piston member strokes in the first direction. The fluid supply may have an outlet positioned on the piston member to register with the second section of the dosing chamber.

The fluid dispenser may be adapted such that, in use, as the piston member strokes in the second direction fluid in the dosing chamber is bled from the dosing chamber (e.g. back to the fluid supply) until the piston member sealingly contacts the first section of the dosing chamber. The fluid may be bled back to the fluid supply via the fluid conduit in the piston member.

The fluid dispenser may comprise a valve between the dosing chamber and the fluid outlet which remains closed as the piston member strokes in the second direction before it comes into sealing contact with the first section. The valve may be formed in an opening in the first section.

The fluid dispenser may be adapted such that the fluid is bled in the first direction around the piston member or the seal which selectively contacts the first section.

The one-way valve may be adapted to open to enable fluid to pass into the first section of the dosing chamber as the piston member strokes in the first direction with the seal in sealing contact with the first section.

The one-way valve may be adapted to close when the piston member strokes in the second direction.

According to a third aspect of the invention there is provided a piston member for stroking in a dosing chamber of a fluid dispenser, the piston member having a seal mounted thereon to form a one-way valve, wherein the seal is not an O-ring.

According to a fourth aspect of the invention there is provided a fluid dispenser comprising a container for a fluid, a dosing chamber, a fluid outlet and a piston member arranged to stroke in the dosing chamber (i) in a first direction for filling the dosing chamber with fluid from the container, and (ii) in a second direction to dispense fluid from the chamber towards the fluid outlet, wherein the piston member is mounted to move in unison with the container.

The piston may be comprised in a cap structure mounted on the container. The cap structure may be a stopper inserted into an opening of the container.

The dosing chamber may be provided in a nozzle of the fluid dispenser in which the fluid outlet is formed.

The nozzle may be mounted on the container for relative movement therebetween, for instance to cause the piston member to stroke in the dosing chamber.

The nozzle may be mounted on the cap structure.

The nozzle may be shaped and sized for insertion into a nostril of a human being. Of course, it could be shaped for different applications, for instance insertion into different body cavities or topical application to other body areas.

The fluid dispenser may have a biasing mechanism to bias the piston member to a rest position in the dosing chamber. The rest position may be a retracted position of the piston member in the dosing chamber.

In another aspect of the invention there is provided a fluid dispenser having a container for a fluid, a nozzle mounted on the container for movement towards and away from the container, a piston member and dosing chamber, the piston member being comprised in the container or the nozzle and the dosing chamber being comprised in the other whereby relative movement of the nozzle and the container causes the piston member to stroke in the dosing chamber for filling and emptying of the dosing chamber, and wherein the fluid dispenser is adapted so that at rest the nozzle and container are separated at a first spacing, wherein for actuation of the fluid dispenser the nozzle and container are moved towards one another and then returned to the first spacing, and wherein the nozzle and container are separable to a second spacing, greater than the first spacing to improve protection of the fluid dispenser in the event of an impact event, e.g. dropping of the fluid dispenser.

A yet further aspect of the invention provides a fluid dispenser for use with a fluid supply, the dispenser having a fluid outlet, dosing chamber, a piston member arranged to reciprocate in the dosing chamber to selectively fill the dosing chamber with fluid from the fluid supply and pump fluid from the dosing chamber towards the fluid outlet, optionally a seal for sealing the fluid outlet which is movable from a normal closed state, in which the seal prevents fluid being dispensed through the fluid outlet, to an open state, in which the seal opens the fluid outlet for enabling dispensing therefrom, and a component movable between a normal first position, in which the member seals the fluid outlet or acts on the seal to locate the seal in the closed state, and a second position, which opens the fluid outlet or enables the seal to move to the open state, wherein the component comprises the dosing chamber.

In another aspect of the invention, there is provided a sealing arrangement for sealing a fluid outlet of a fluid dispenser comprising a seal member having a first face for sealing the fluid outlet, a second face in which is provided a recess, and a component which is sealingly slidably mountable in the recess for sliding movement relative to the seal member between an inward position and an outward position, wherein in the inward position the component causes the first face to be deflected outwardly and in the outward position the first face is able to return towards its original state.

The seal member may be made from a resilient material or other type of material which has shape memory; i.e. having the ability to return to an original shape.

Each aspect of the invention may also comprise any of the additional features of (i) the other aspects of the invention, or (ii) the exemplary embodiments described with reference to the accompanying Figures.

These and other aspects and features of the present invention will be understood from the exemplary embodiments which will now be described with reference to the accompanying Figures of drawings.

BRIEF DESCRIPTION OF THE FIGURES OF DRAWINGS

FIG. 1A shows the fluid dispenser in a fully extended (open) position and FIGS. 1B and 1C respectively show the fluid dispenser in its rest and fired positions;

Figures 2A, 2B, 2C:
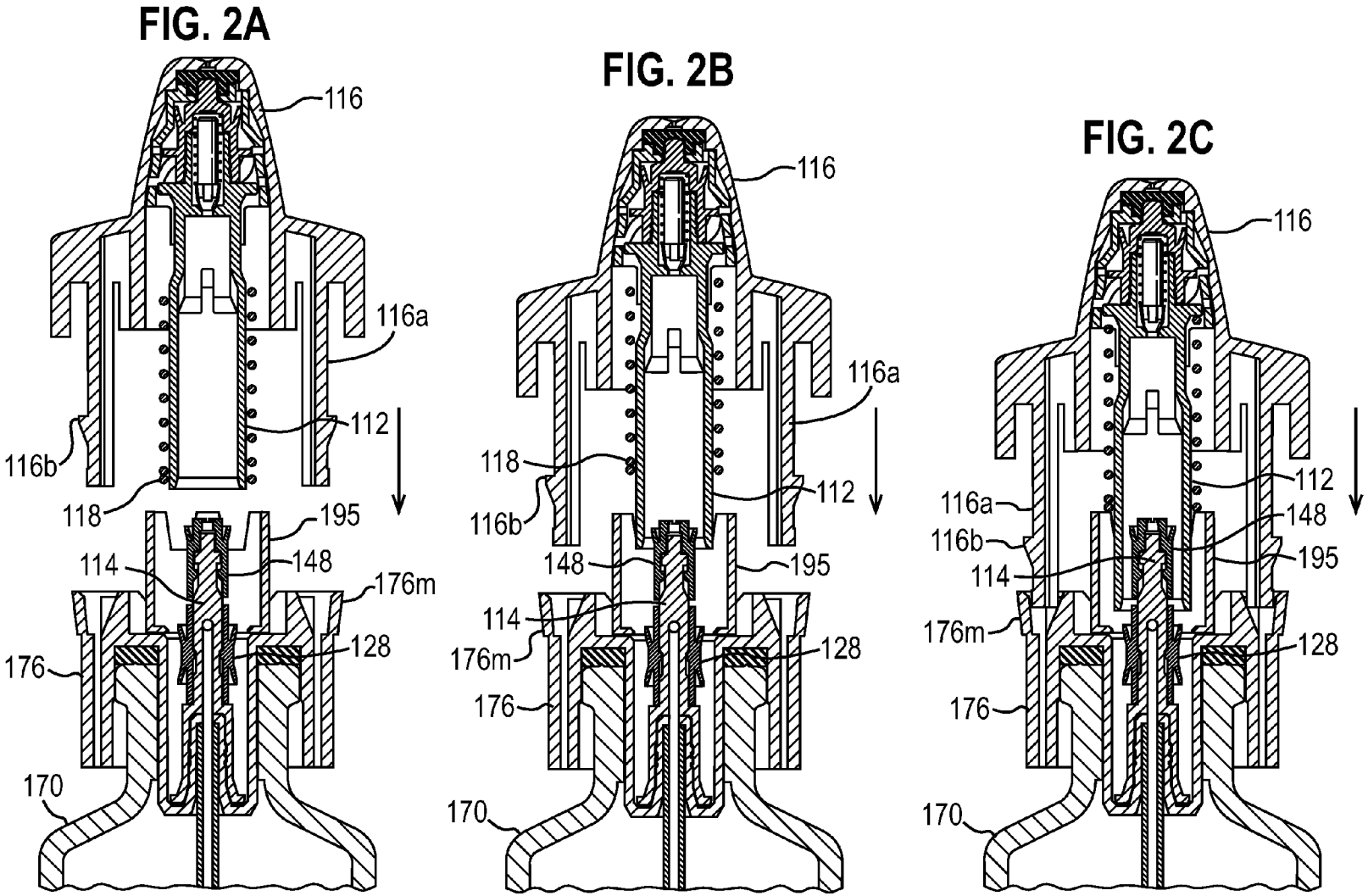
FIGS. 2A to 2C illustrate the assembly of the fluid dispenser of FIGS. 1A-C.
Figure 3A:
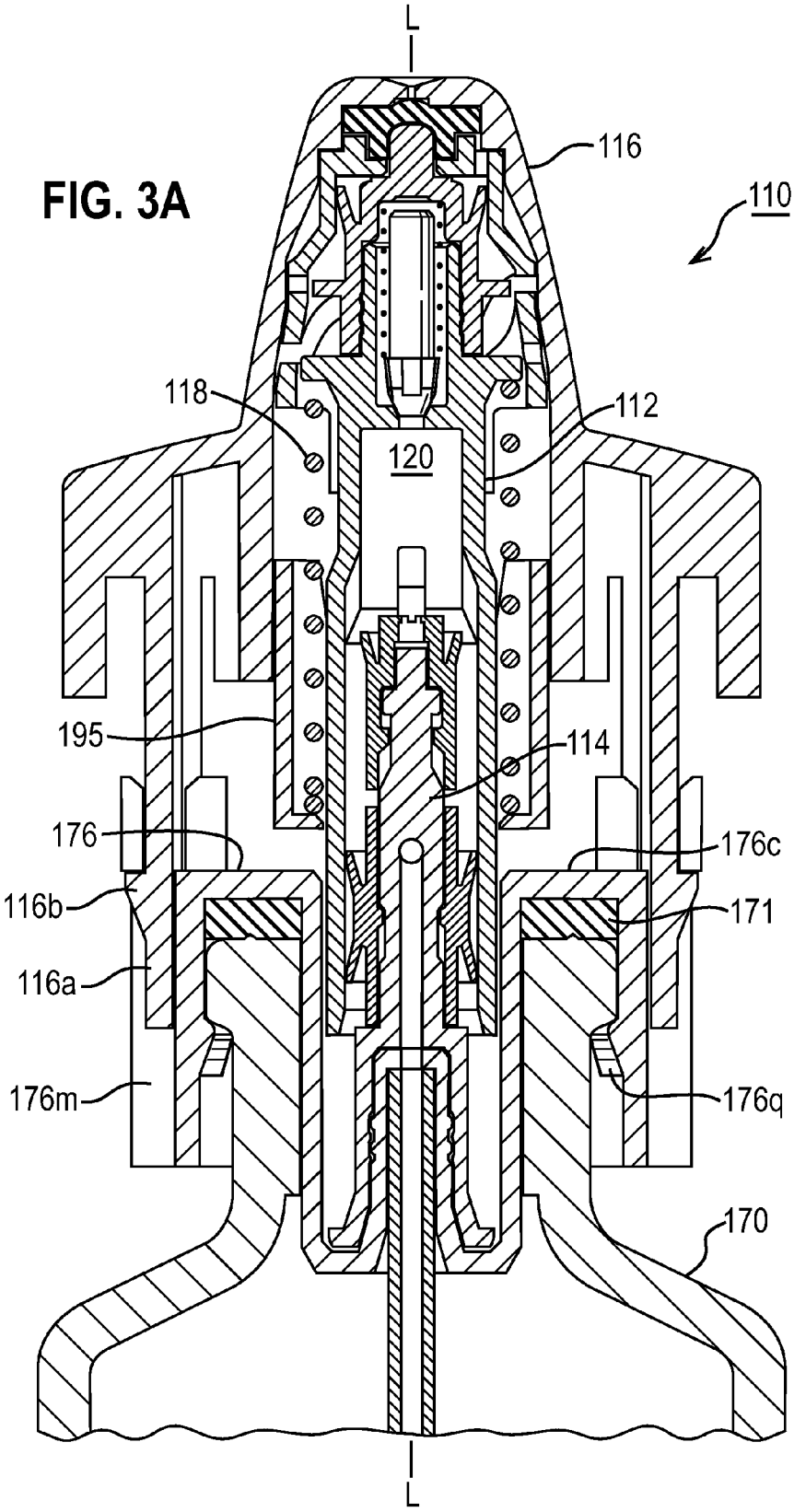
FIGS. 3A to 3C are cross-sectional side views of the fluid dispenser of FIGS. 1A-C respectively in its fully extended, rest and fired positions.
Figure 3B:
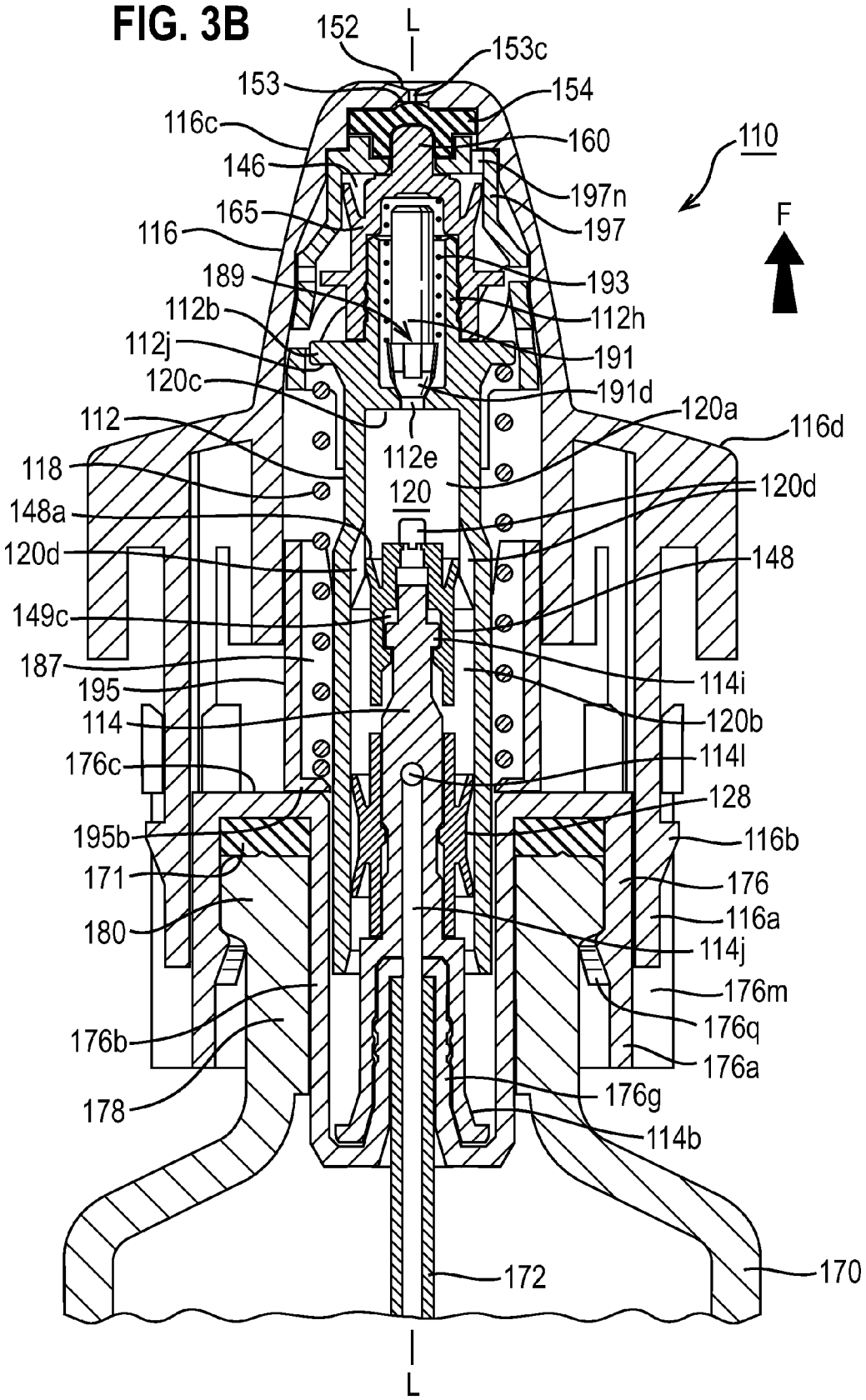
Figure 3C:
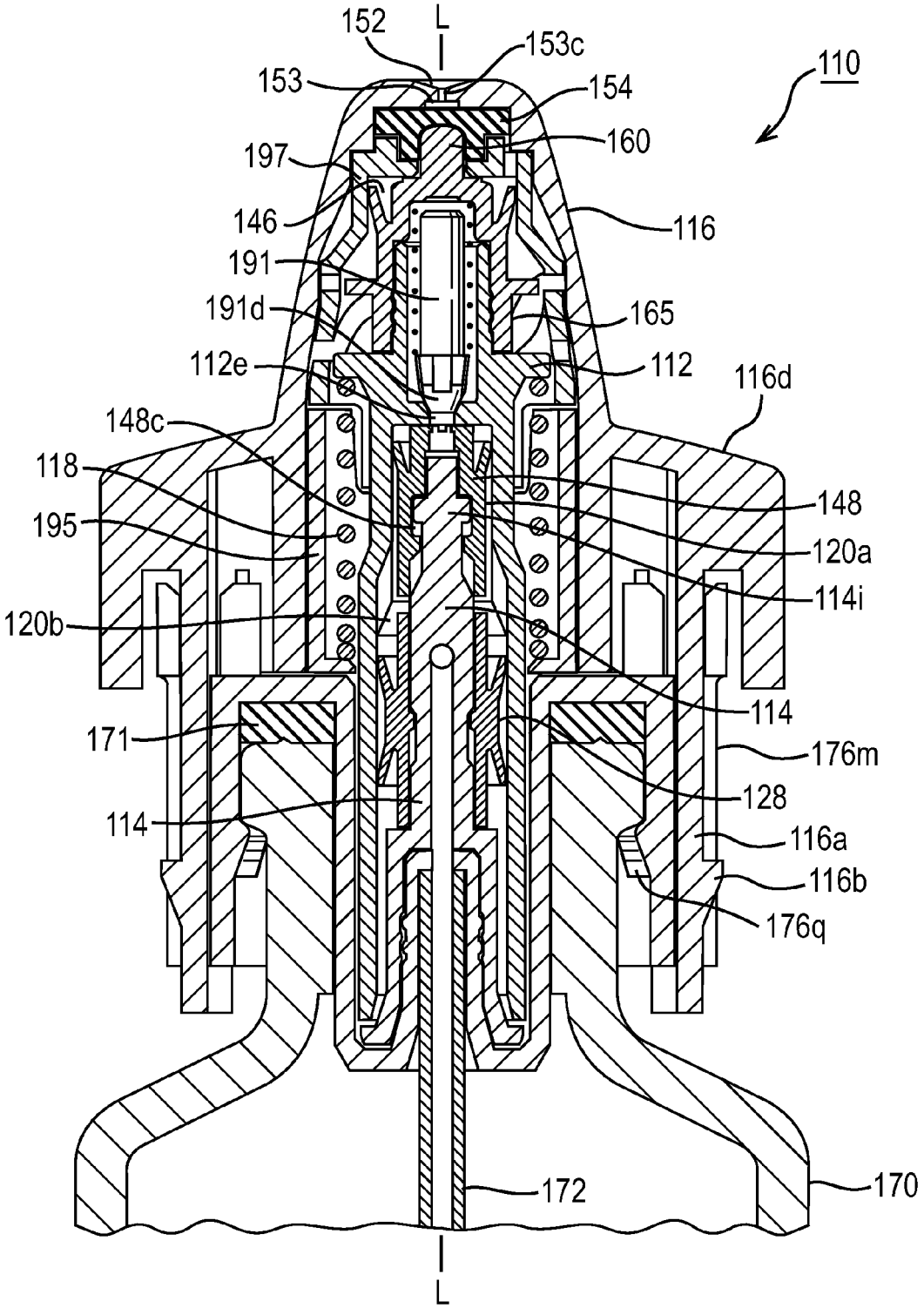
Figure 4:
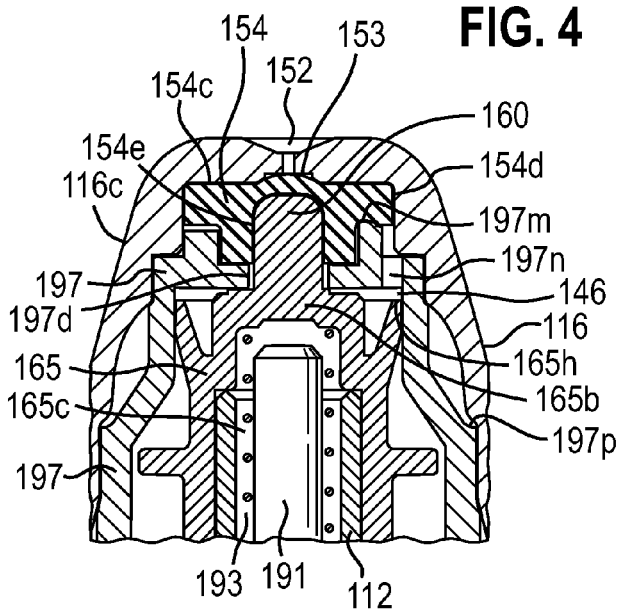
FIG. 4 is an enlarged cross-sectional view of the nozzle area of the fluid dispenser of FIGS. 1 to 3 showing a tip seal arrangement.
Figure 11:
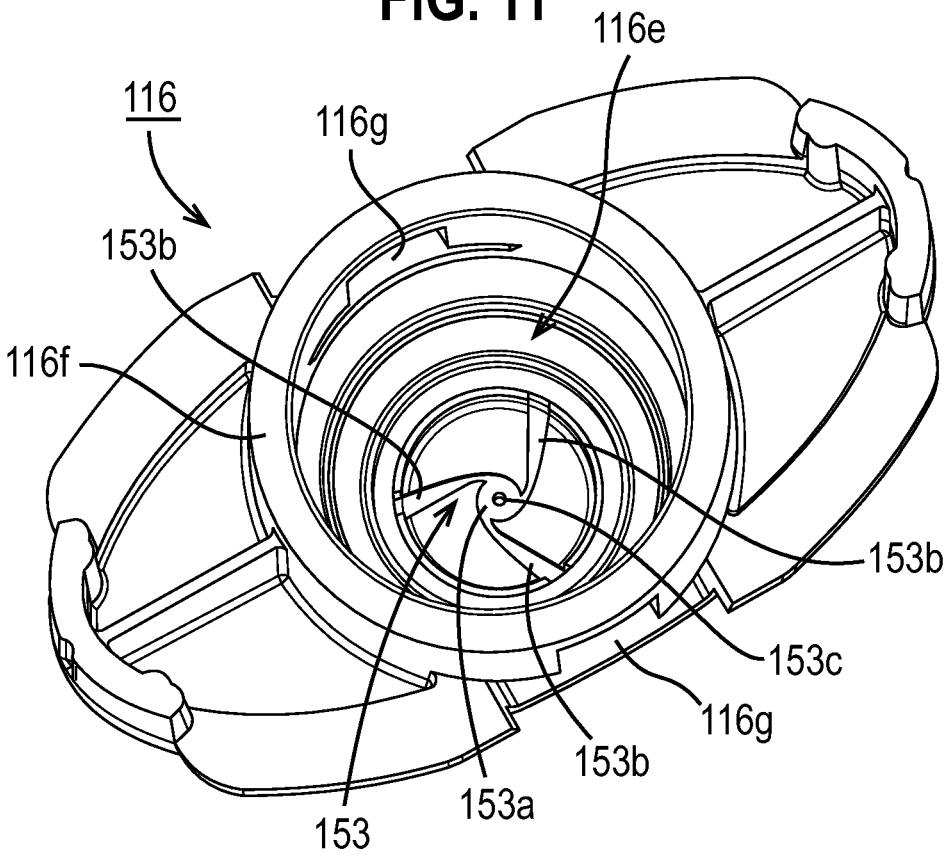
FIG. 11 is a perspective rear view of the nozzle of FIGS. 10A and 10B showing a swirl chamber formed in the end face thereof.
Figure 17:
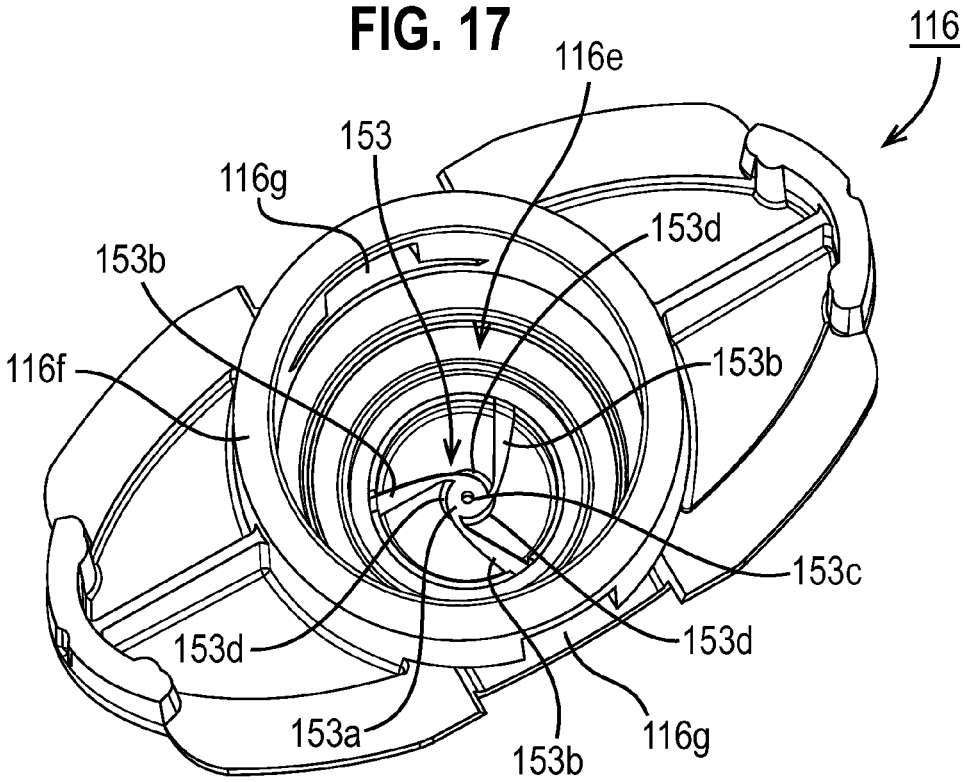
Figure 18:
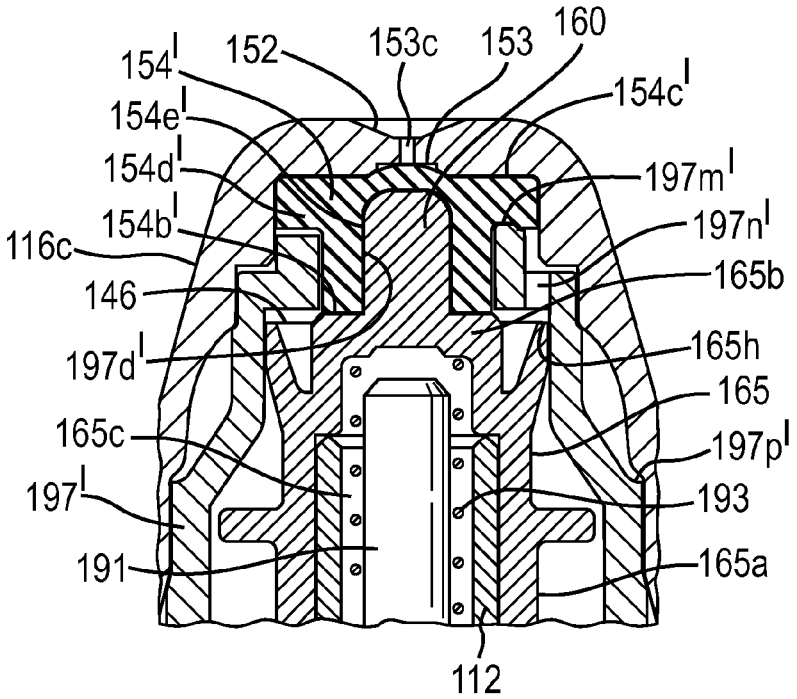
Figure 19A:
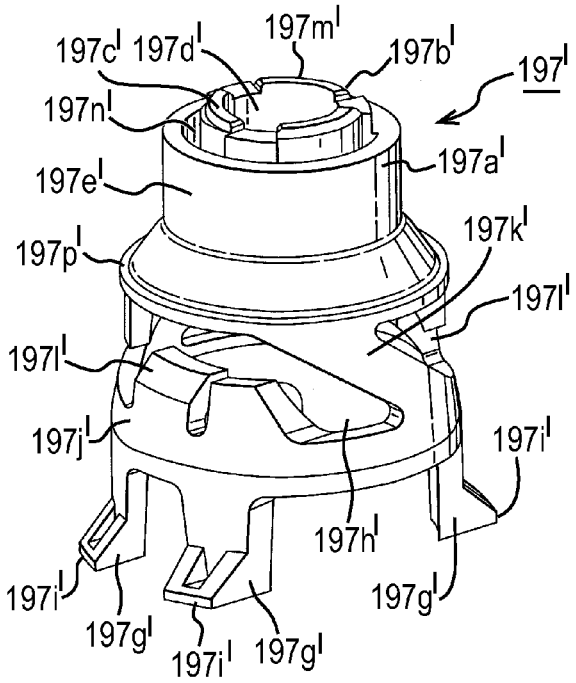
Figure 19B:
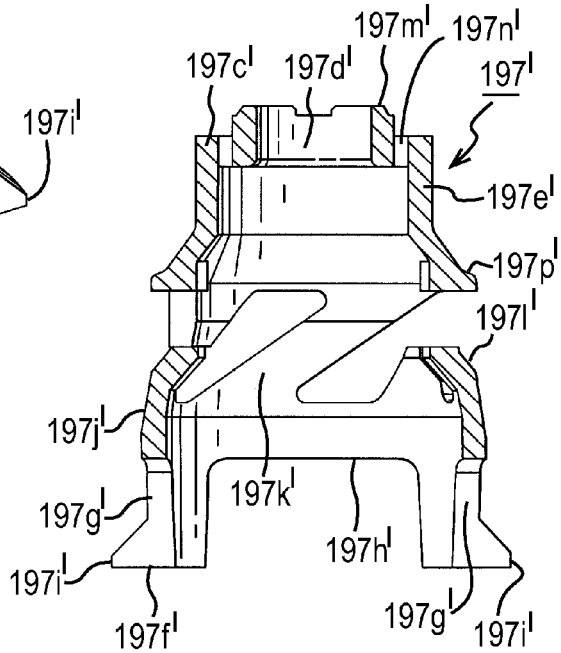
Figure 20:
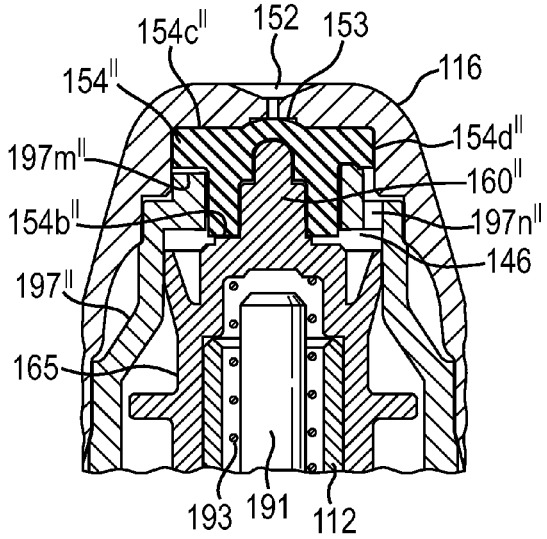
Figure 21:
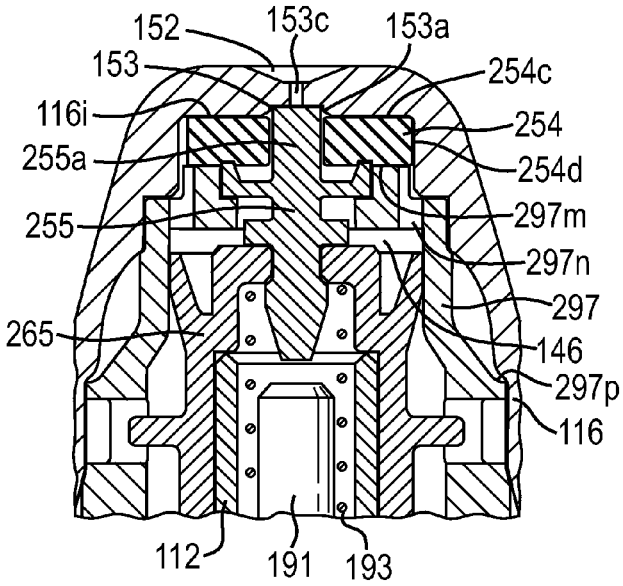
Figure 22A:
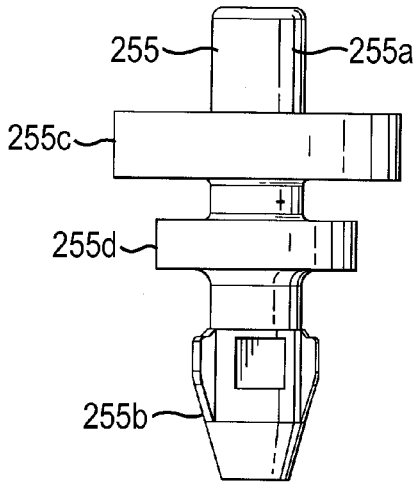
Figure 22B:
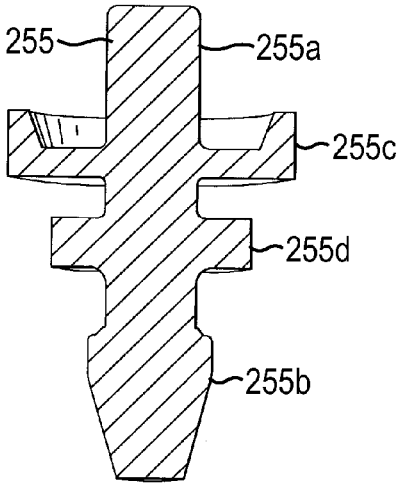
Figure 23A:
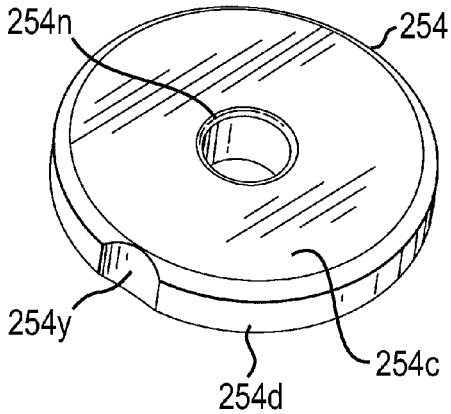
Figure 23B:
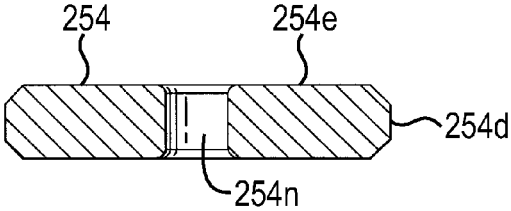
Figure 24A:
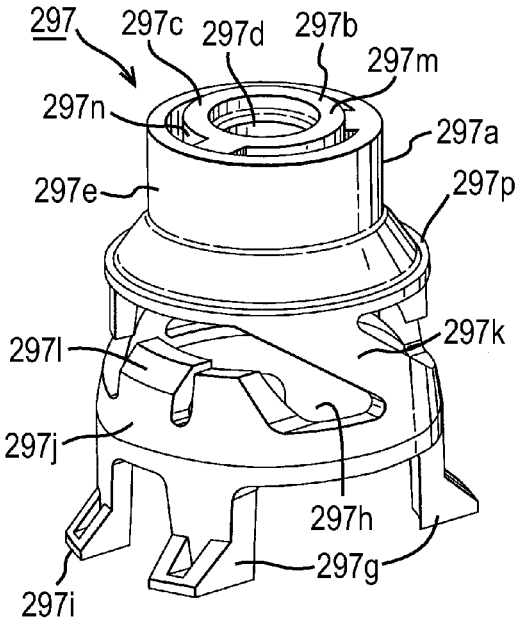
Figure 24B:
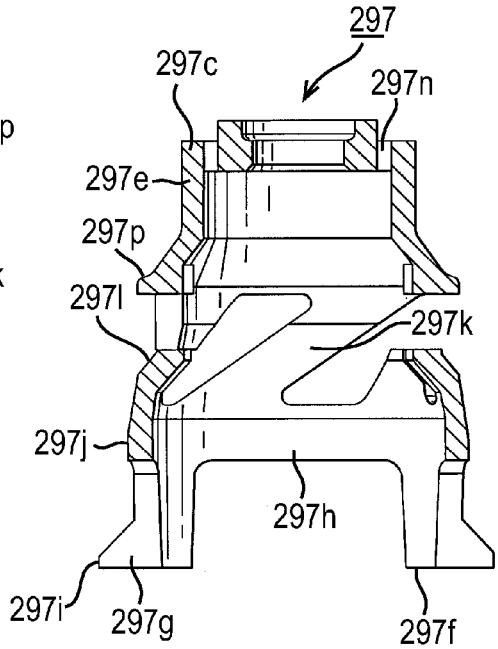
Figure 25A:
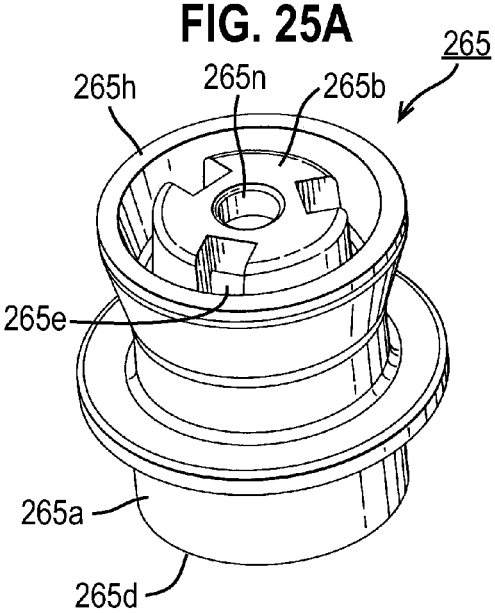
Figure 25B:
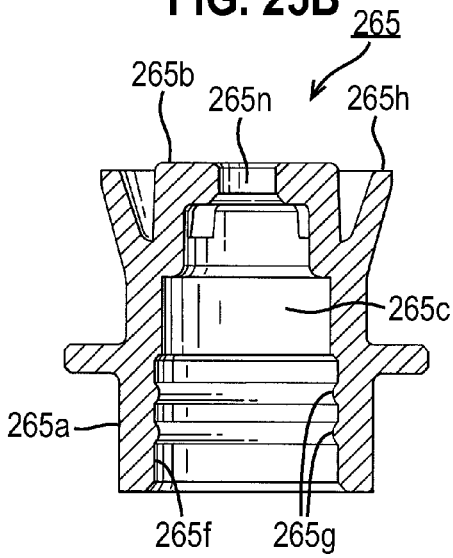
Figure 26:
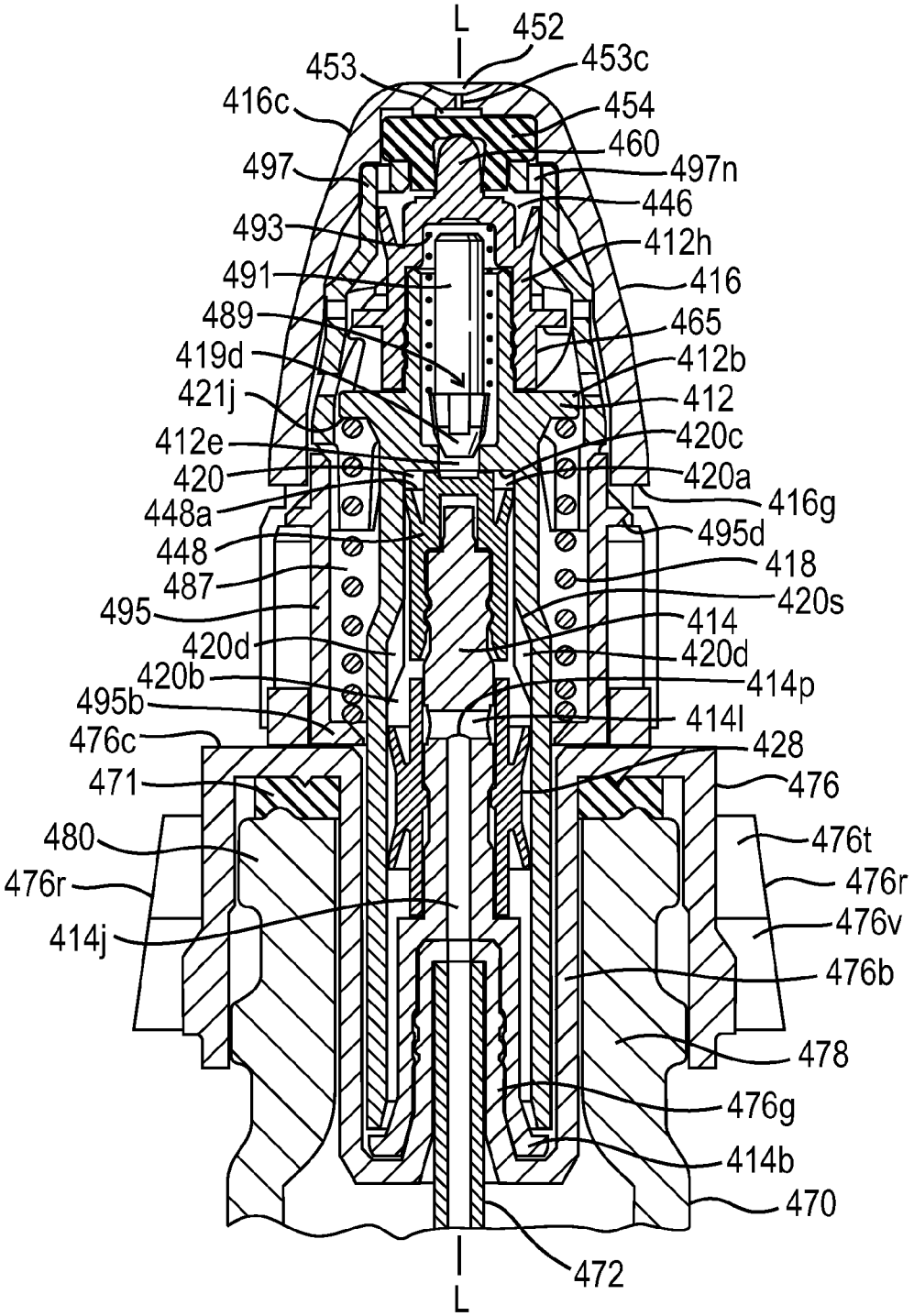
Figure 27:
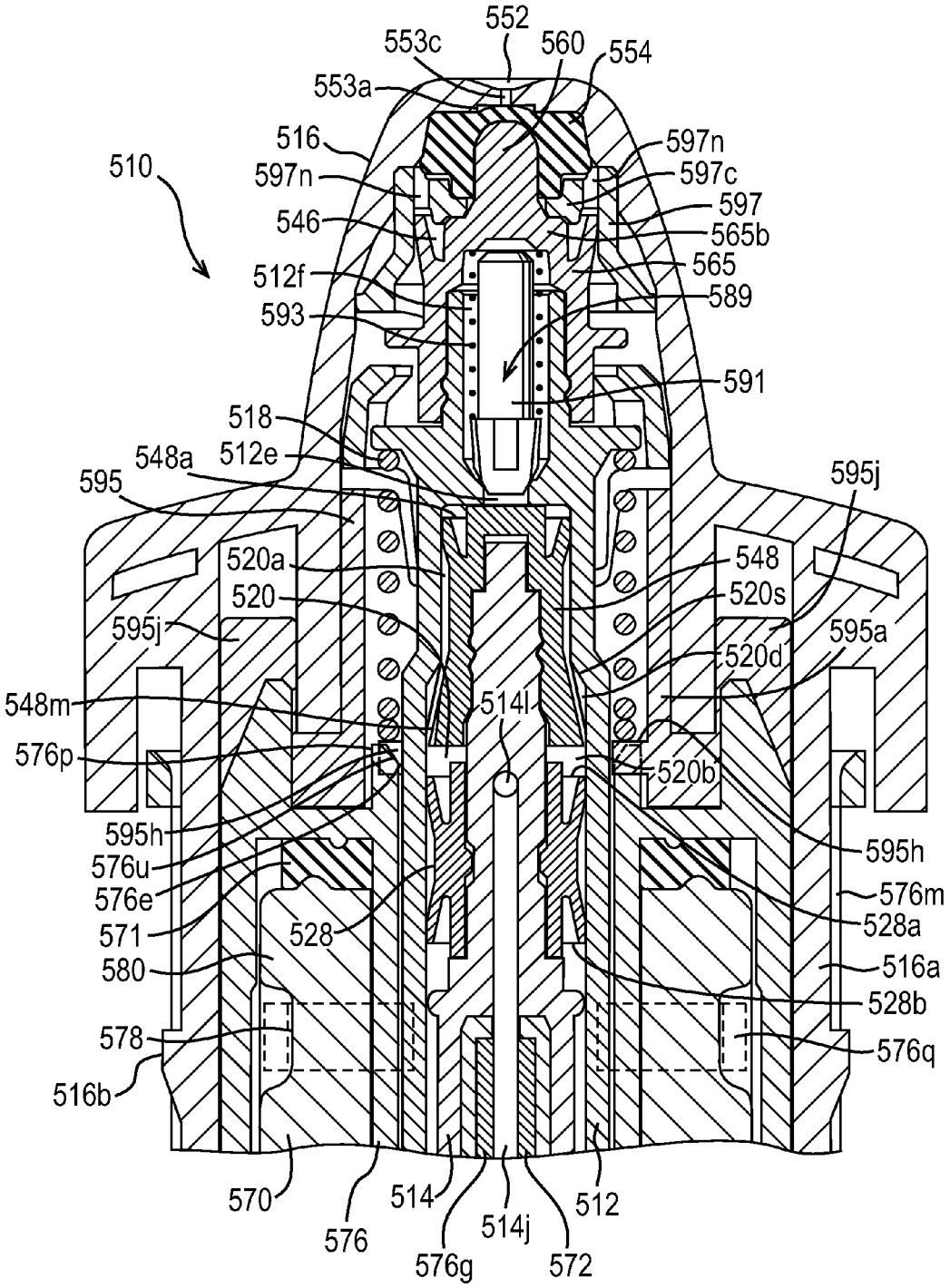
Figure 29:
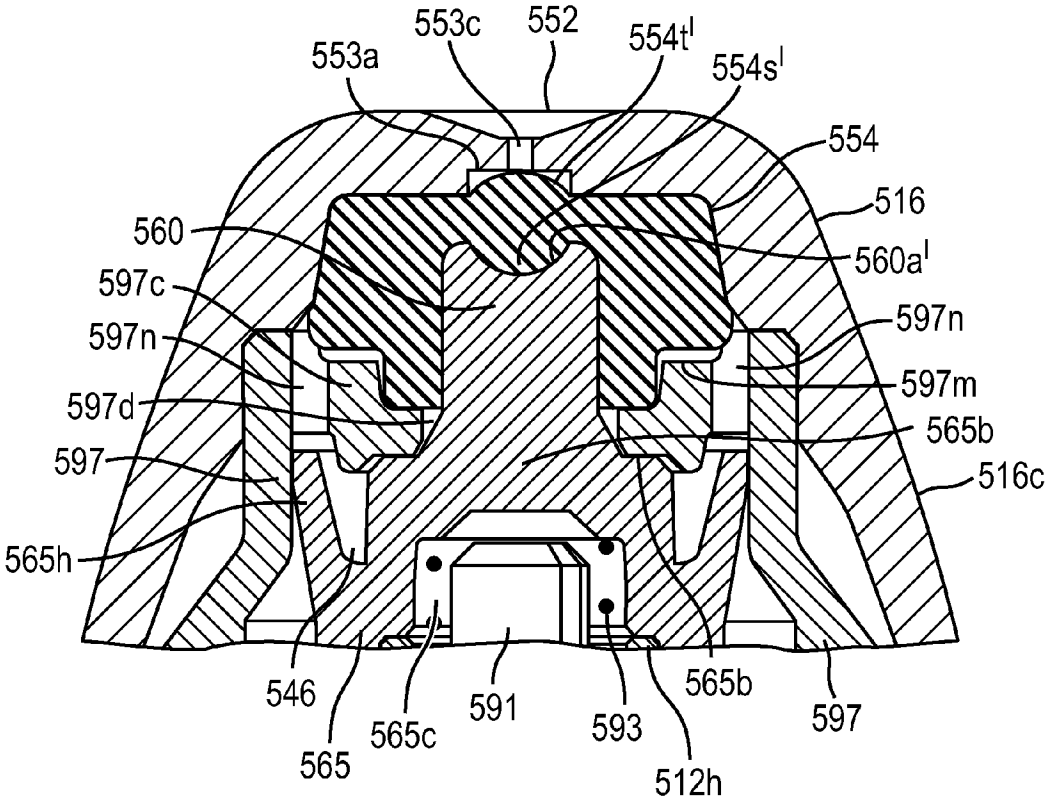
Figure 28:
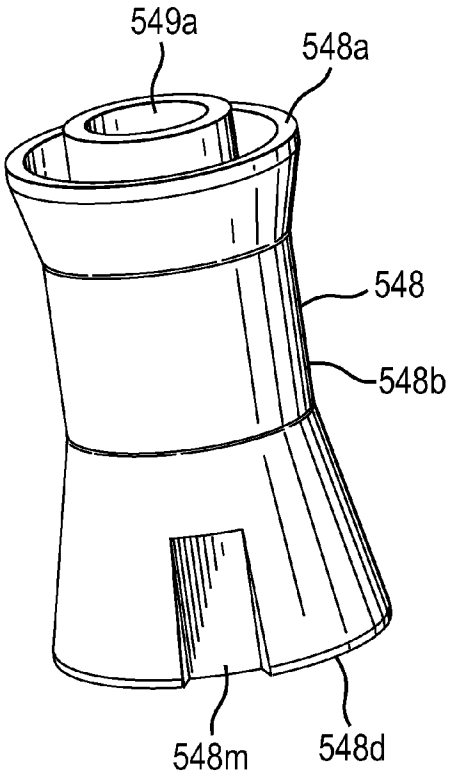
Figure 30A:
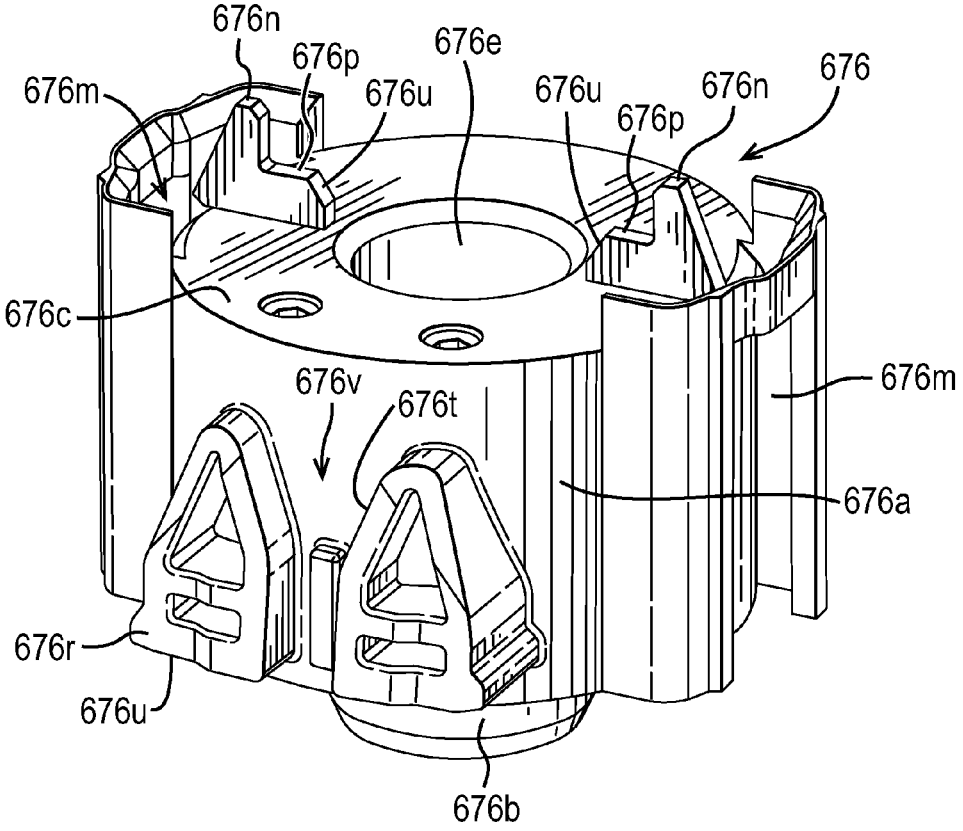
Figure 30B:
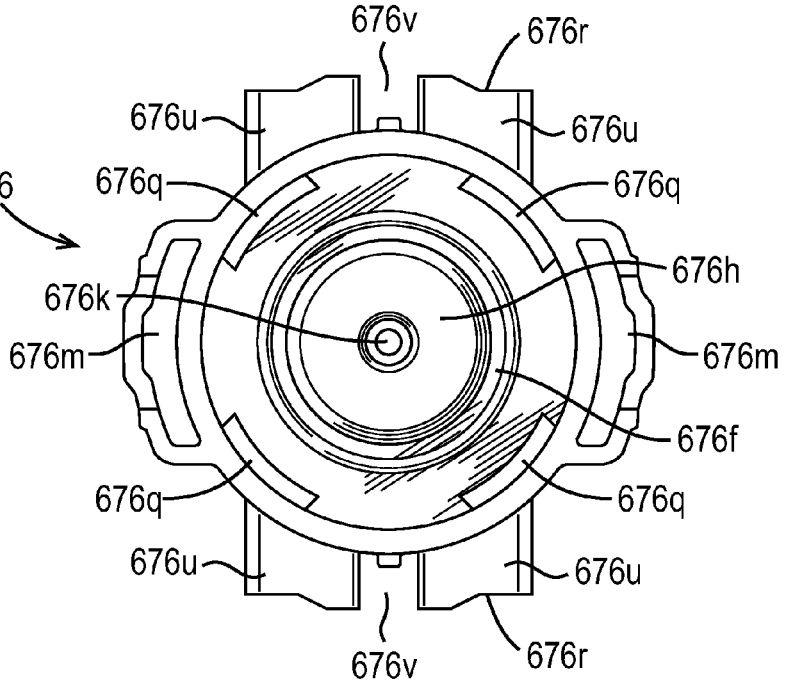
Figure 31:
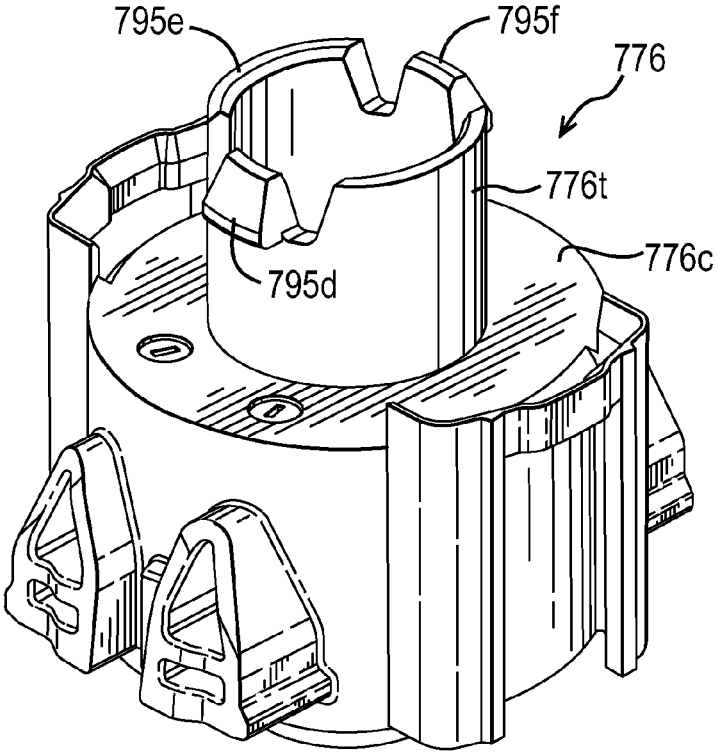
Figure 33:
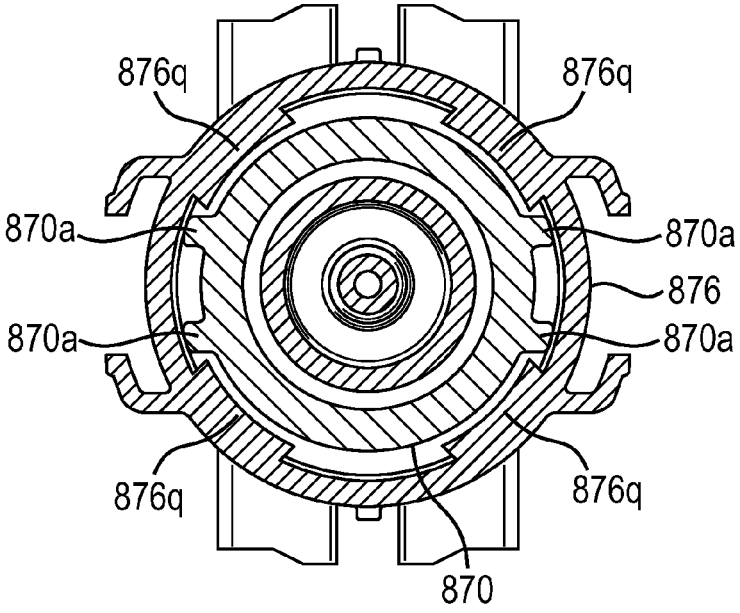
Figure 32:
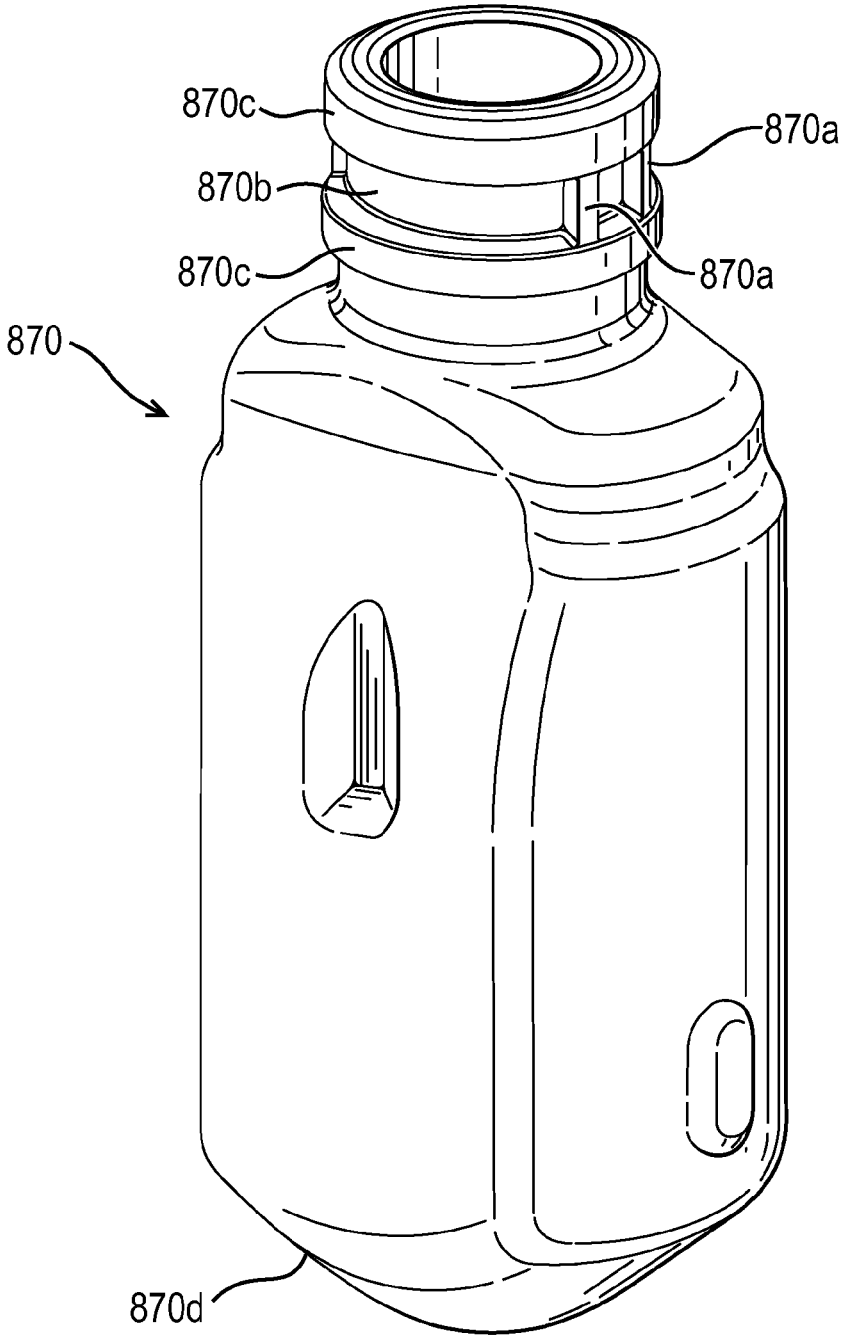
Figure 34:
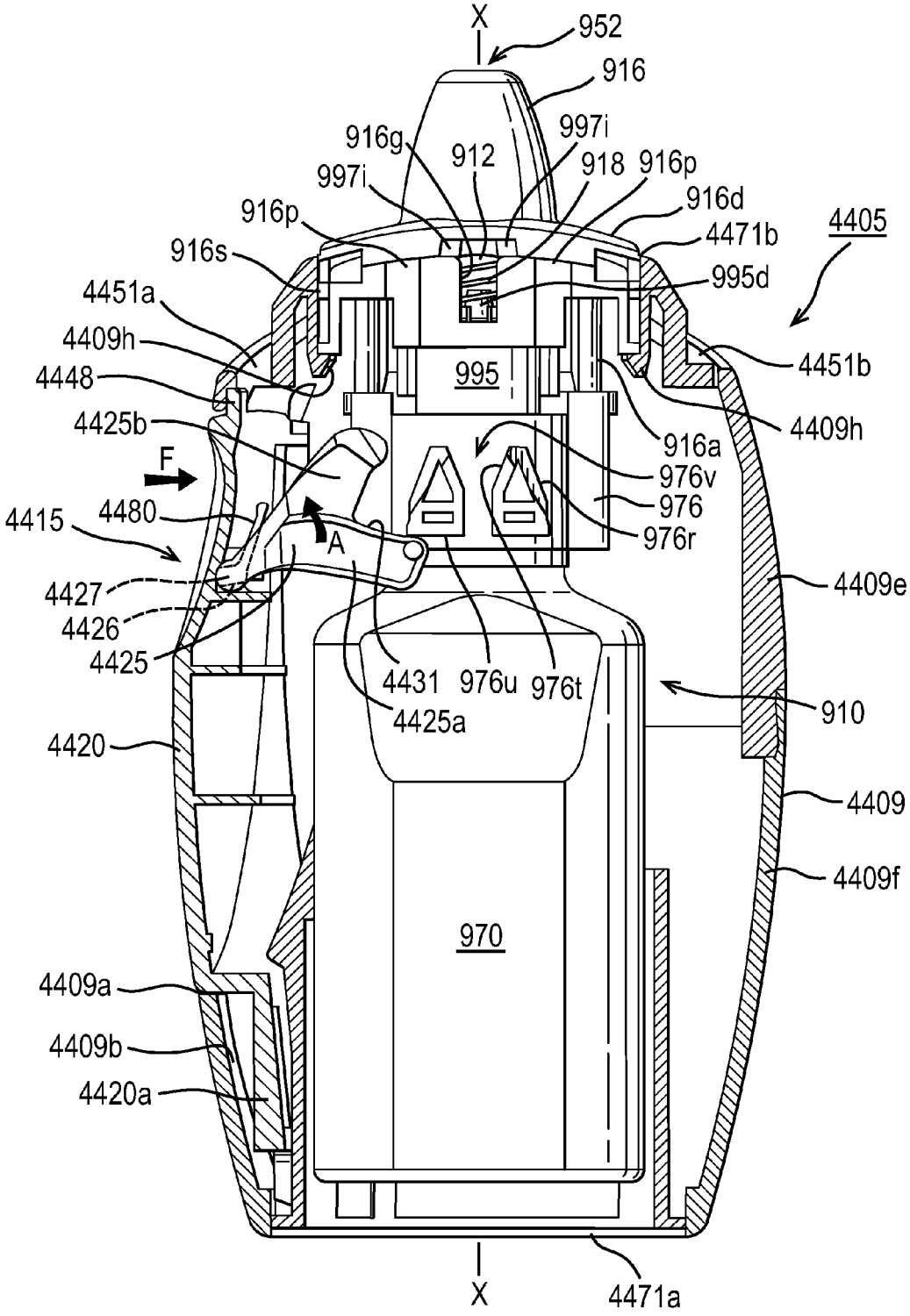
Figure 35A:
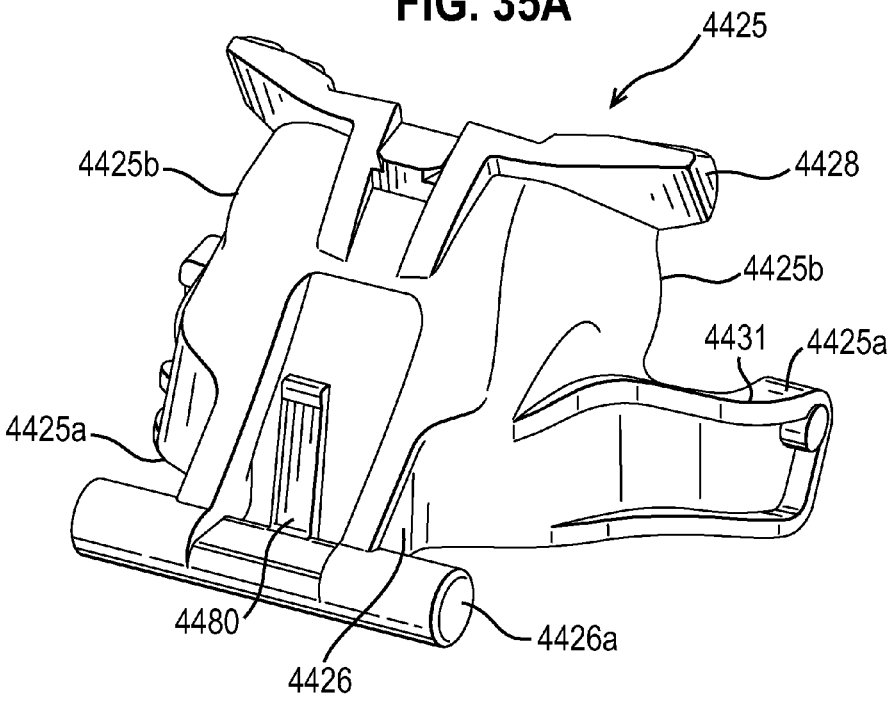
Figure 35B:
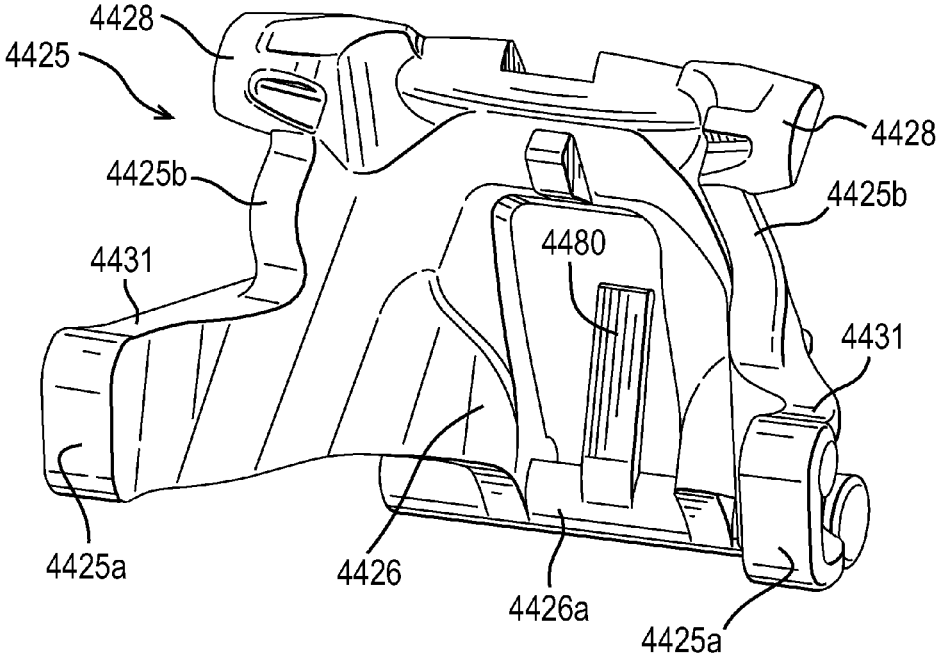
Figure 35C:
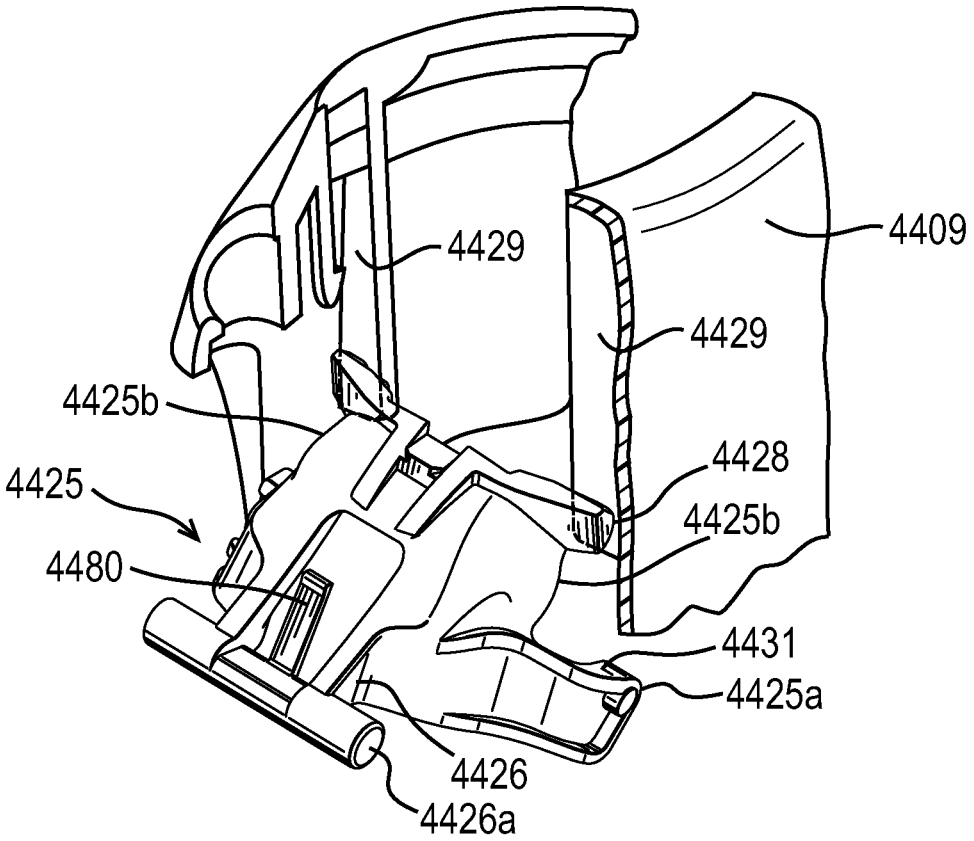
Figure 36A:
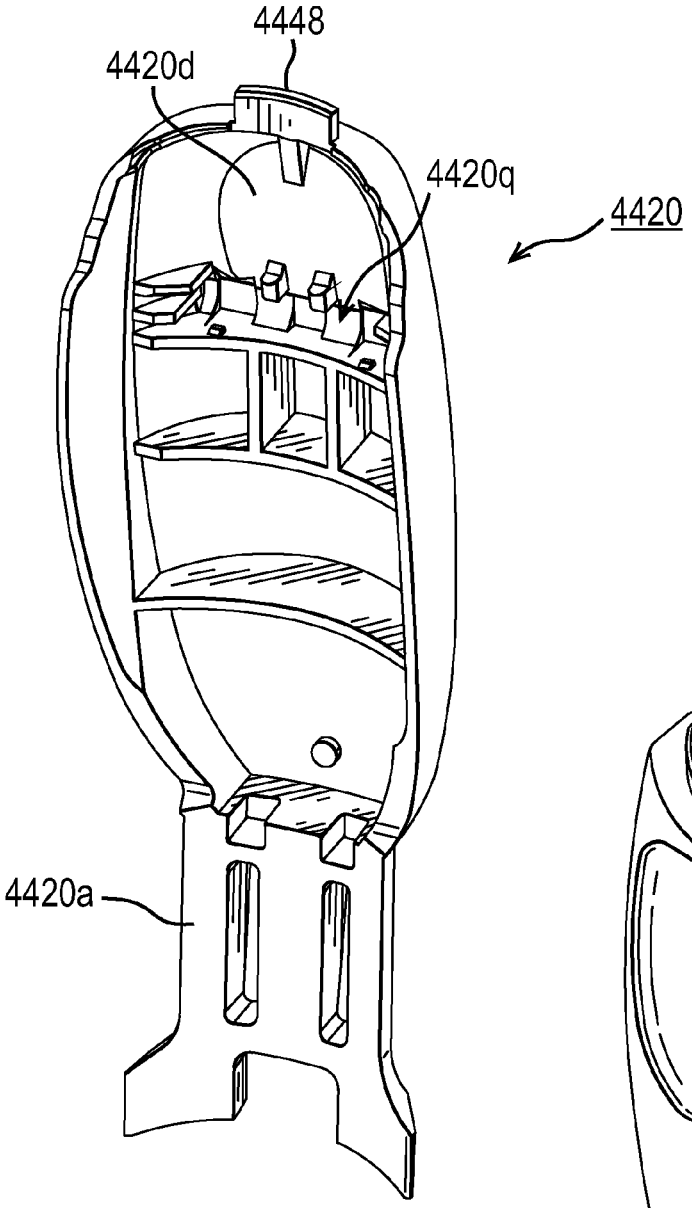
Figure 36B:
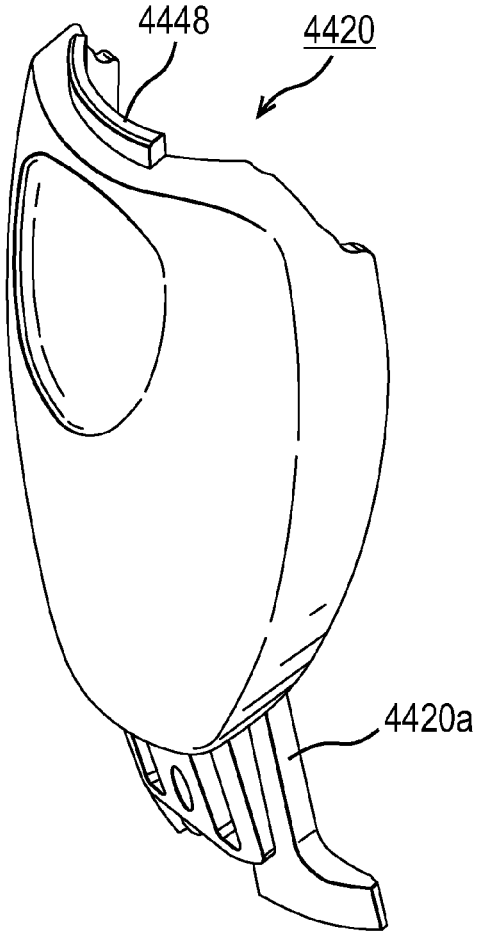
Figure 37:
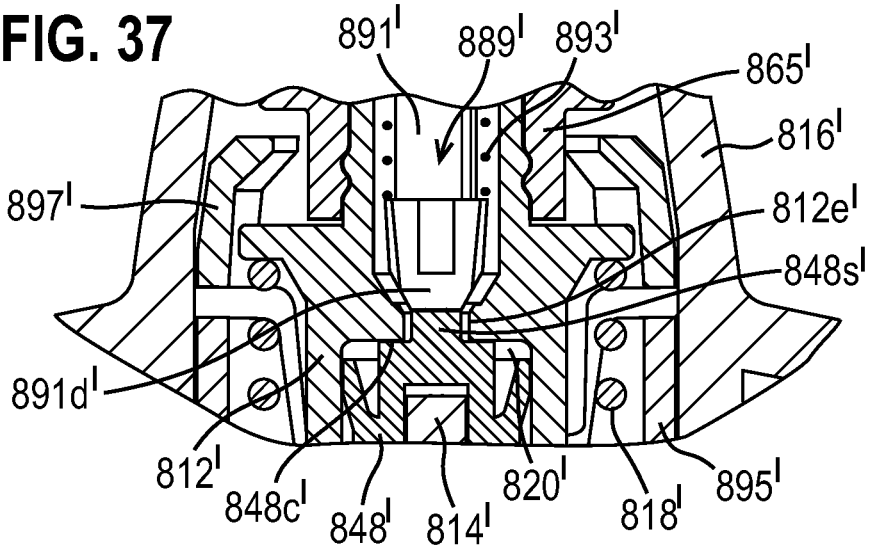
Figure 38:
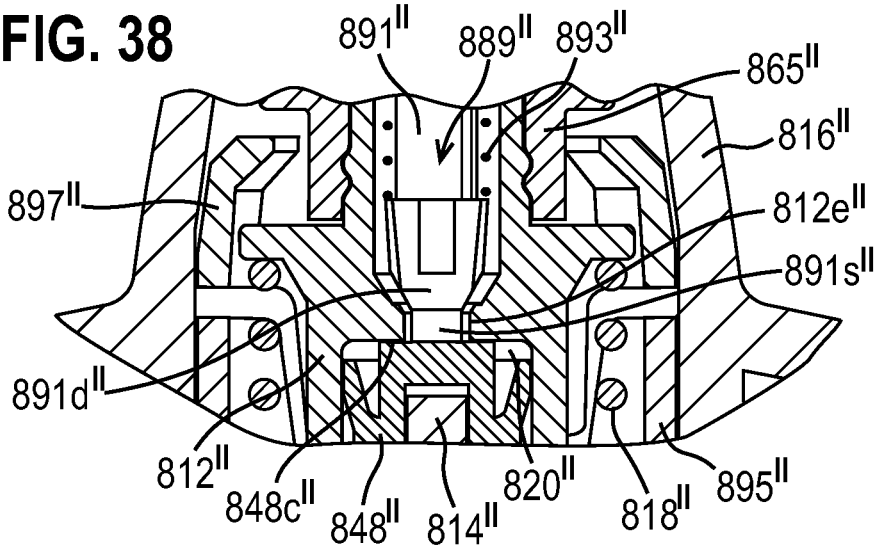

FIG. 17 corresponds to FIG. 11 showing a modification to the swirl chamber;

FIG. 18 corresponds to FIG. 4, but shows an alternative tip seal arrangement for the fluid dispenser of FIGS. 1 to 15;

FIGS. 19A and 19B are respectively perspective and cross-sectional side views of the nozzle insert in FIG. 18;

FIG. 20 corresponds to FIG. 4, but shows a further alternative tip seal arrangement;

FIG. 21 corresponds to FIG. 4, but shows an alternative sealing arrangement for the fluid dispenser of FIGS. 1 to 15;

FIGS. 22A and 22B are respectively a side view and a cross-sectional side view of the sealing pin in FIG. 21;

FIGS. 23A and 23B are respectively perspective and cross-sectional side views of the backing plate in FIG. 21;

FIGS. 24A and 24B are respectively perspective and cross-sectional side views of the nozzle insert in FIG. 21;

FIGS. 25A and 25B are respectively perspective and cross-sectional side views of the cap in FIG. 21;

FIG. 26 is a cross-sectional side view of another modified version of the fluid dispenser of FIGS. 1 to 15, being shown in its fired position, but as viewed in a section taken perpendicular to that in FIGS. 3A to 3C;

FIG. 27 is a cross-sectional side view of yet another modified version of the fluid dispenser of FIGS. 1 to 15, shown in its fired position, but with the tip seal arrangement having reclosed at the end of dispensing;

FIG. 28 is a perspective view of the forward sealing element of the fluid dispenser of FIG. 27;

FIG. 29 is an enlarged fragmentary view of an alternative tip seal arrangement for the fluid dispenser of FIG. 27;

FIGS. 30A and 30B are respectively perspective and underneath plan views of a first alternative stopper portion;

FIG. 31 is a perspective view of a second alternative stopper portion;

FIG. 32 is a perspective view of a bottle for use in the fluid dispenser of the invention;

FIG. 33 is a sectional plan view of the bottle of FIG. 32 in a stopper portion;

FIG. 34 is a side sectional view of the fluid dispenser of FIG. 27 mounted in an actuator in the formation of a hand-held, hand-operable fluid dispensing system;

FIGS. 35A and 35B are perspective views of a bell crank of the actuator of FIG. 34;

FIG. 35C corresponds to FIG. 35A, but shows the bell crank in relation to pusher surfaces provided by the actuator;

FIGS. 36A and 36B are perspective views of a lever of the actuator of FIG. 34 on which the bell crank of FIGS. 35A and 35B mounts;

FIG. 37 is a fragmentary view showing an alternative configuration for the piston member and valve element of the fluid dispenser of FIG. 1 to 15, 16, 26 or 27; and FIG. 38 is a fragmentary view showing an another alternative configuration for the piston member and valve element of the fluid dispenser of FIG. 1 to 15, 16, 26 or 27.

DETAILED DESCRIPTION OF THE FIGURES OF DRAWINGS

In the following description of non-limiting specific embodiments according to the present invention, any terms concerning the relative position, orientation, configuration, direction or movement of a given feature (e.g. "forward", "anti-clockwise" etc.) relate only to the arrangement of that feature from the view point shown in the specific Figure or Figures to which the description refers. Moreover, these terms are not meant to be limiting on the arrangement for the invention, unless stated otherwise.

Furthermore, in the following description of exemplary fluid dispensers in accordance with the present invention, the fluid dispensers are for dispensing a liquid, and all references to "fluid" in relation to the description of these exemplary fluid dispensers should be read as meaning liquid. The liquid may contain a medicament, for example suspended or dissolved in the liquid.

The underlying principle of operation of the exemplary fluid dispensers is as described in US-A-2005/0236434 and WO-A-2005/075103 supra.

Like reference numerals are used to identify like features as between the various exemplary fluid dispensers for ease of reference.

FIGS. 1 to 15 show a fluid dispenser 110 in accordance with a first embodiment of the present invention.

Figure 5A:
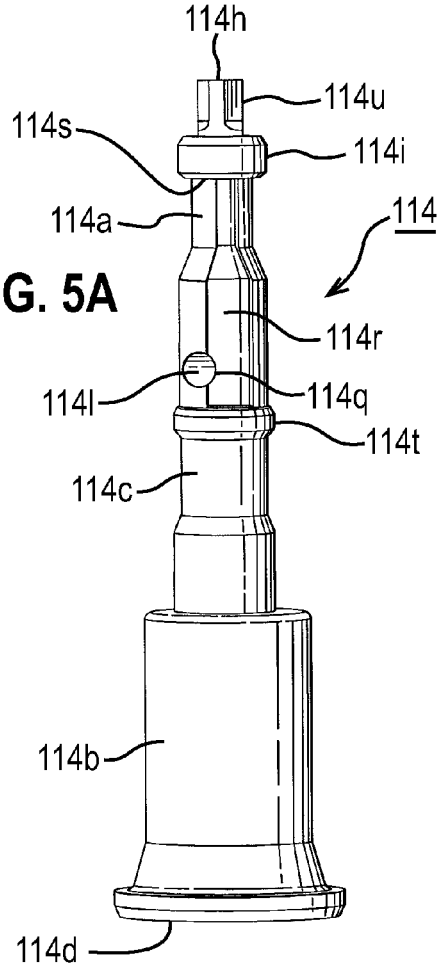
FIGS. 5A and 5B are respectively a side view and a cross-sectional side view of a piston member of the fluid dispenser of FIGS. 1 to 4.
Figure 5B:
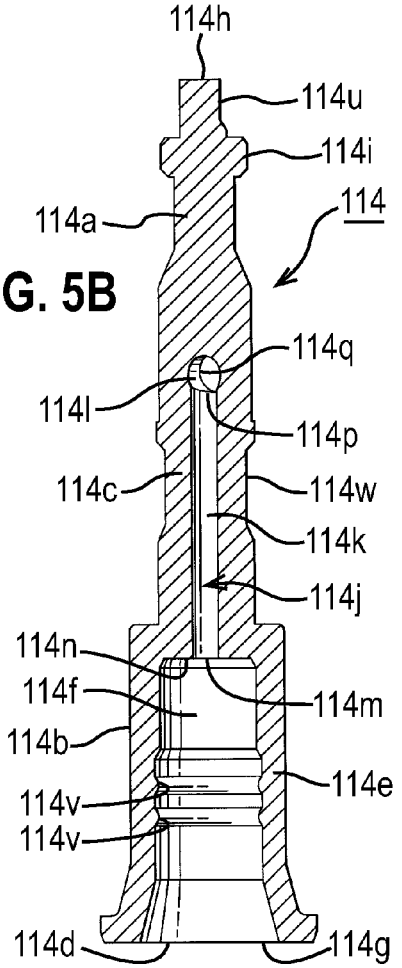
Figure 6A:
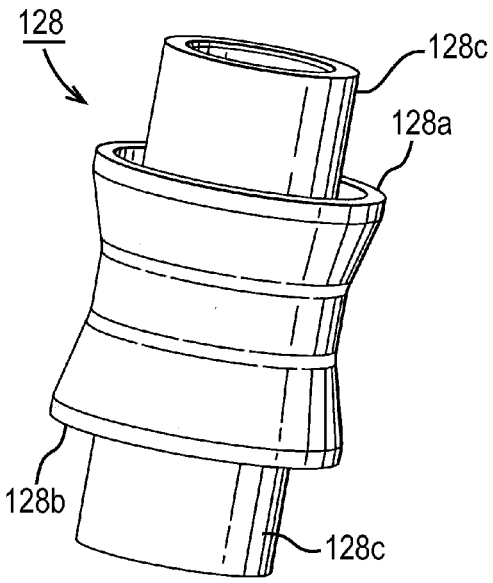
FIGS. 6A and 6B are respectively perspective and cross-sectional side views of a rear sealing element of the fluid dispenser of FIGS. 1 to 4 which mounts on the piston member of FIGS. 5A-B.
Figure 6B:
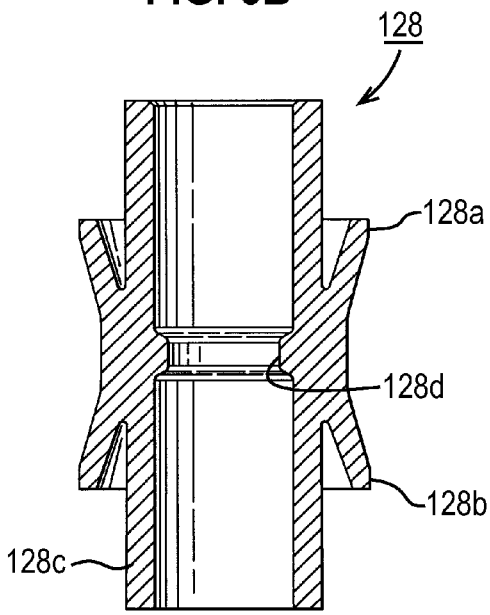

Referring to FIGS. 3B, 5A and 5B, the fluid dispenser has a piston member 114 of generally cylindrical form which is mounted to stroke in reciprocal fashion along a longitudinal axis L-L of the fluid dispenser 110 inside a dosing chamber 120 defined by a main housing 112. The piston member 114 is mounted to stroke between forward and rear positions relative to the dosing chamber 120. As a piston, it will impose a pumping force onto fluid within the dosing chamber 120 as the piston member 114 moves within the dosing chamber 120.

Figure 8A:
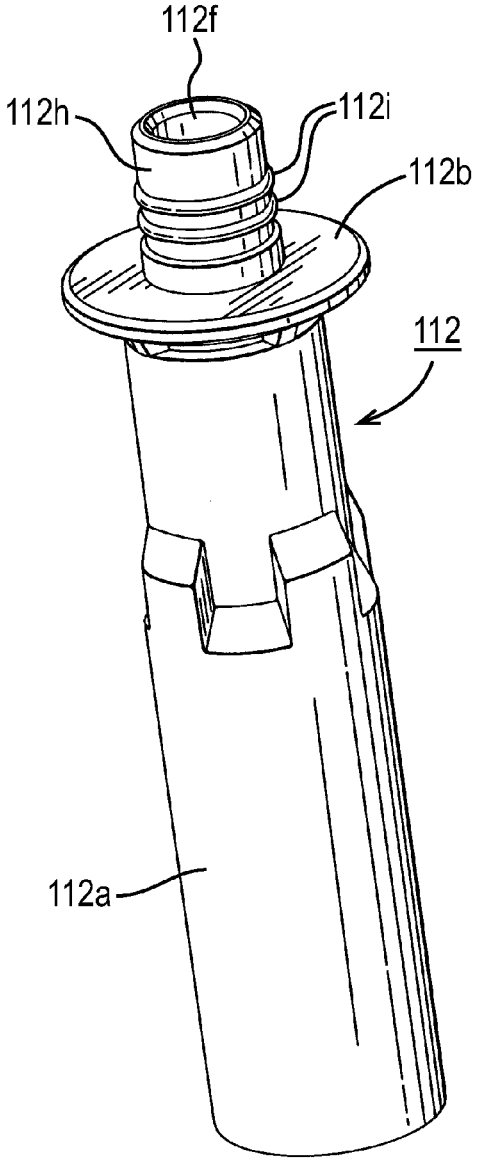
FIGS. 8A and 8B are respectively perspective and cross-sectional side views of a main housing of the fluid dispenser of FIGS. 1 to 4 which slidingly receives the piston member of FIGS. 5A-B.
Figure 8B:
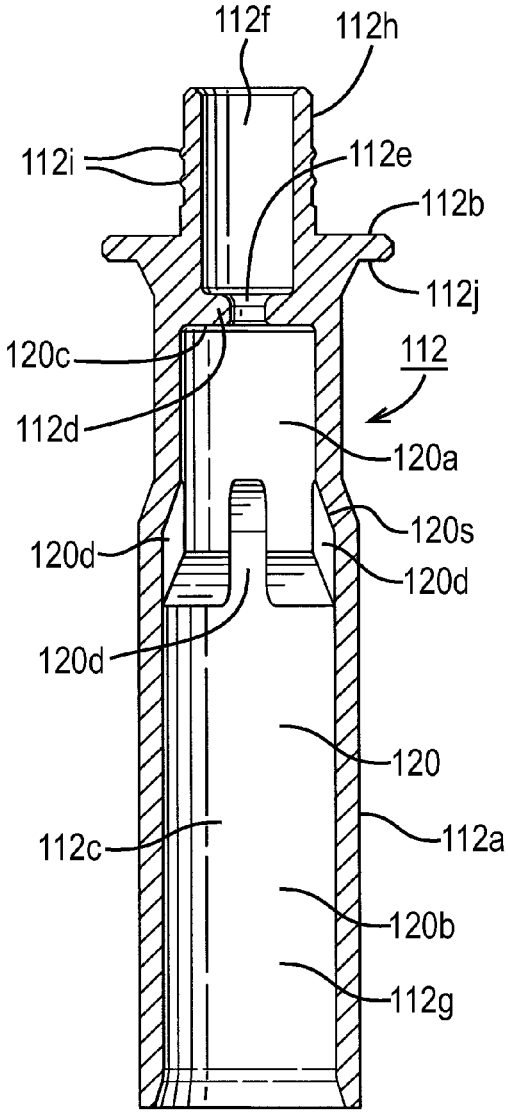

As shown in FIGS. 8A and 8B, the main housing 112 is formed by a tubular body 112*a* from which an annular flange 112*b* projects. The tubular body 112*a* has an open-ended axial bore 112*c* into which an annular shoulder 112*d* projects to create a restricted bore section 112*e* relative to forward and rear bore sections 112*f*, 112*g* disposed on either side of the annular shoulder 112*d*. The rear bore section 112*g* defines the dosing chamber 120. The forward section 112*h* of the tubular body 112*a* is provided with a pair of outer circumferential beads 112*i*, the purpose of which will be explained shortly hereinafter.

The main housing 112 in this embodiment is injection moulded from polypropylene (PP), but other plastics materials could be used.

Referring to FIGS. 3B, 3C, 8A and 8B, the dosing chamber 120 is cylindrical and co-axially arranged with the longitudinal axis L-L. The dosing chamber 120 has forward and rear sections 120*a*, 120*b*. As can be seen, the forward section 120*a* is narrower than the rear section 120*b*. A step 120*s* tapers inwardly in the forward direction F (see FIG. 3B) to connect the rear section 120*b* to the forward section 120*a*. As shown in FIGS. 3B and 8B, at least one axial groove or flute 120*d* is formed in the step 120*s*. In this particular embodiment, four such flutes 120*d* are provided, although another number may be selected. Where plural flutes 120*d* are provided, they are ideally equi-angularly spaced apart, as in this particular embodiment.

The forward section 120*a* forms a metering chamber which meters a volume of the fluid for dispensement from the dispenser 110. The metered volume may be 50 microliters, but this is only illustrative as the fluid dispenser 110 can be arranged to dispense the desired metered volume.

Turning back to FIGS. 5A and 5B, the piston member 114 has a forward section 114*a*, a rear section 114*b* and a central section 114*c*. These are arranged co-axially.

The rear section 114*b* presents an open rear end 114*d* of the piston member 114. The rear section 114*b* is cup-shaped having an annular outer peripheral wall 114*e* which defines an internal cavity 114*f* having a mouth 114*g* which opens in the rear end 114*d*.

The forward section 114*a* is solid and presents the forward end 114*h* of the piston member 114. The forward section 114*a* comprises an annular flange 114*i* rearwardly of the forward end 114*h*.

Figure 1C:
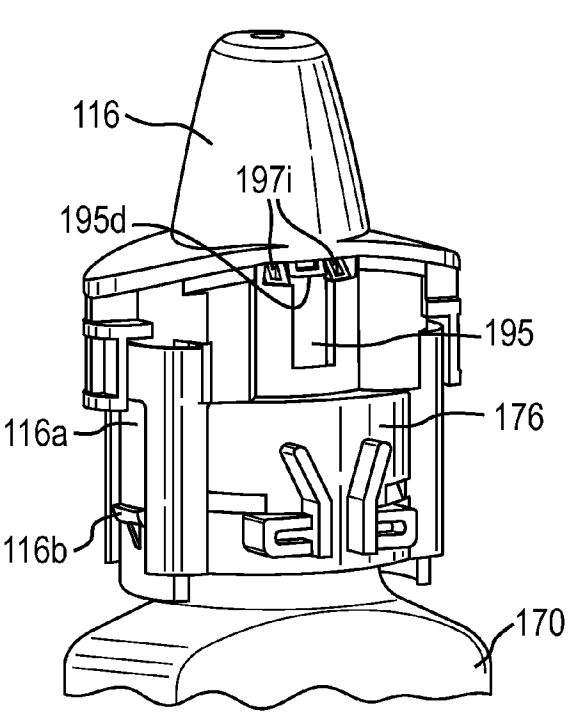
FIGS. 1A to 1C are perspective side views of a fluid dispenser in accordance with the present invention, where

The central section 114*c* connects to the forward and rear ends 114*a*, 114*b* and comprises an internal bore network 114*j* to place the rear section 120*b* of the dosing chamber 120 in fluid communication with a fluid supply 170 (in this particular embodiment a bottle, e.g. of glass or a plastics material—see FIGS. 1A to 1C), as will be described in more detail hereinafter. The bore network 114*j* consists of an axial section 114*k* and plural transverse sections 114*l*. The axial bore section 114*k* extends forwardly from a rear opening 114*m* in a forward face 114*n* of the internal cavity 114*f* to a junction 114*p*. The transverse bore sections 114*l* extend transversely, inwardly from respective forward openings 114*q* in the outer circumferential surface of the central section 114*c* to the junction 114*p* to connect with the axial bore section 114*k*. The forward openings 114*q* are arranged equi-angularly about the central section 114*c*. In this particular embodiment, there are two transverse bore sections 114*l*, but one or greater than two transverse bore sections could be used. The forward openings 114*q* are also recessed in the central section 114*c*.

The piston member 114 is provided with a plurality of axially-oriented grooves 114*r* about the outer periphery. The grooves 114*r* extend rearwardly from a rear surface 114*s* of the annular flange 114*i* in the forward section 114*a* to an annular rib 114*t* on the central section 114*c* rearward of the forward openings 114*q* of the internal bore network 114*j*. The grooves 114*r* are arranged so that at least a portion of the forward openings 114*q* are within the grooves 114*r*.

A tip part 114*u* of the forward section 114*a* of the piston member 114, which extends forwardly from the flange 114*i* to the forward end 114*h*, has a triangular cross-sectional shape, with the apexes being rounded.

The piston member 114 in this embodiment is injection moulded from polypropylene (PP), but other functionally equivalent plastics materials could be used.

Referring to FIGS. 3B, 3C, 6A and 6B, the piston member 114 carries on its central section 114*c* a tubular rear sealing element 128 which provides a permanent dynamic (sliding) seal between the piston member 114 and the rear section 120*b* of the dosing chamber 120. The rear sealing element 128 is fixed to the piston member 114 to move in unison therewith so that there is no, or substantially no, relative axial movement therebetween as the piston member 114 strokes in the dosing chamber 120.

The rear sealing element 128 is of the lip-seal type, being provided with resilient, annular sealing lips 128*a*, 128*b* at its forward and rear ends, respectively. The material of the rear sealing element 128 provides the sealing lips 128*a*, 128*b* with an inherent outwardly-directed bias. The sealing lips 128*a*, 128*b* have an outer diameter which is greater than the inner diameter of the rear dosing chamber section 120*b*, whereby the sealing lips 128*a*, 128*b* are compressed inwardly by the inner surface of the rear dosing chamber section 120*b*. As a result, the bias in the sealing lips 128*a*, 128*b* means they sealingly engage the inner surface of the rear dosing chamber section 120*b*.

The rear sealing element 128 further comprises a tubular body 128*c* from which the sealing lips 128*a*, 128*b* depend and which fits on the outer surface of the piston member central section 114*c* by engagement of an inner circumferential bead 128*d* of the rear sealing element 128 in a recessed portion 114*w* of the central section 114*c* of the piston member 114. The tubular body 128*c* has a length such that, when fitted on the piston member 114, it covers substantially the entire axial extent of the central section 114*c* of the piston member 114. It will further be seen from FIG. 3B that the rear end of the rear sealing element 128 bears against the forward end of the rear section 114*b* of the piston member 114, as a result of which the circumferential bead 128 is disposed at the forward end of the recessed portion 114*w*. This arrangement prevents, or substantially prevents, relative axial movement of the rear sealing element 128 on the piston member 114.

Figure 7A:
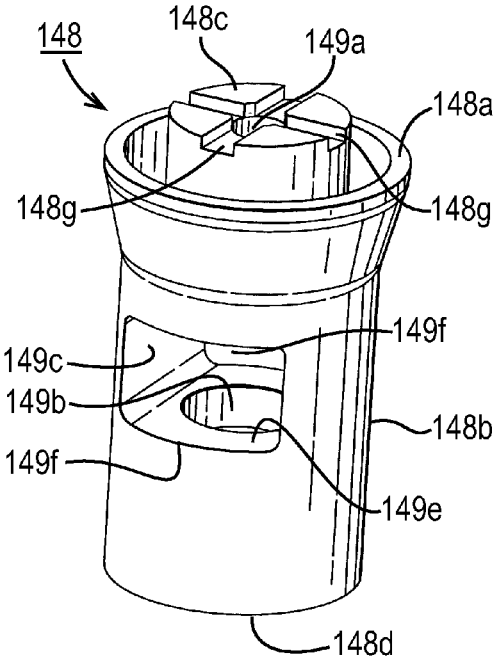
FIGS. 7A and 7B are respectively perspective and cross-sectional side views of a forward sealing element of the fluid dispenser of FIGS. 1 to 4 which slidably mounts on the piston member of FIGS. 5A-B to form a one-way valve.
Figure 7B:
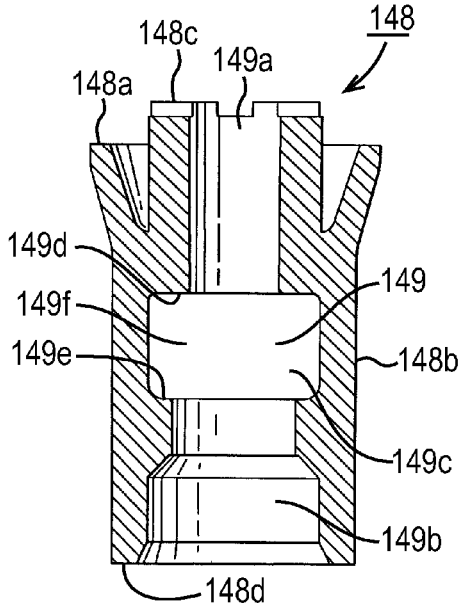

Now referring additionally to FIGS. 7A and 7B, the piston member 114 further carries on its forward section 114*a* a tubular forward sealing element 148 to form a dynamic (sliding) seal between the piston member 114 and the forward section 120*a* of the dosing chamber 120, but only during a particular phase of the piston member stroke, as will be described in more detail hereinafter.

The forward sealing element 148 is also of the lip-seal type, but this time only being provided with a resilient, annular sealing lip 148*a* at its forward end. The outer diameter of the sealing lip 148*a* is less than the inner diameter of the rear dosing chamber section 120*b*, but greater than the inner diameter of the forward dosing chamber section 120*a*. Consequently, the forward sealing lip 148*a* is able to be biased into sealing engagement with the inner surface of the forward dosing chamber section 120*a*.

As will be observed, the forward sealing element 148 is slidably mounted on the forward section 114*a* of the piston member 114. In more detail, the forward sealing element 148 comprises a tubular body 148*b*, from which the sealing lip 148*a* depends, and provides an axial, open-ended bore 149 through the forward sealing element 148 in which the forward section 114*a* of the piston member 114 is slidably mounted. The bore 149 comprises forward and rear bore sections 149*a*, 149*b* and an enlarged, central chamber 149*c*. The forward and rear bore sections 149*a*, 149*b* respectively extend from the central chamber 149*c* to openings in the forward and rear ends 148*c*, 148*d* of the forward sealing element 148. The forward end 148*c* is provided with grooves 148*g* which intersect the forward bore opening therein. The central bore chamber 149*c* is provided with a pair of diametrically opposed windows 149*f* through the tubular body 148*b*.

The annular flange 114*i* of the piston member 114 is located inside of the central bore chamber 149*c*. The central bore chamber 149*c* has transversely-oriented forward and rear end walls 149*d*, 149*e* which selectively engage the annular flange 114*i* of the piston member 114 to delimit the sliding movement of the forward sealing element 148 on the piston member 114. Specifically, the forwardmost position of the forward sealing element 148 relative to the piston member 114 is delimited by the rear end wall 149*e* abutting the annular flange 114*i* (see e.g. FIG. 3B), and conversely the rearmost position of the forward sealing element 148 relative to the piston member 114 is delimited by abutment of the forward end wall 149*d* with the annular flange 114*i* (see e.g. FIG. 3*c*).

The sliding movement of the forward piston member section 114*a* in the forward sealing element bore 149 forms a one-way valve. The one-way valve is closed when the forward sealing element 148 is in its rearmost position relative to the piston member 114 and open as the forward sealing element 149 moves towards its forwardmost position relative to the piston member 114, as will be discussed in more detail hereinafter.

To this end, it will be understood that the annular flange 114*i* forms a fluid-tight seal against the forward end 149*d* of the central bore chamber 149*c* when the forward sealing element 148 is in its rearmost position.

In operation, as the piston member 114 strokes forwardly relative to the dosing chamber 120 (see e.g. FIG. 3*c*), the forward sealing element 148 moves forwardly with the piston member 114 through engagement of the annular flange 114*i* with the forward end wall 149*d* of the central bore chamber 149*c*. Thus, the one-way valve is closed in the forward stroke of the piston member 114. The forward stroke also brings the forward sealing element 148 into sliding sealing engagement with the forward section 120*a* of the dosing chamber 120.

Once the piston member 114 reaches its forward position at the end of its forward stroke, as delimited by abutment of the forward end 148*c* of the forward sealing element 148 with a forward end wall 120*c* of the dosing chamber 120 (see FIG. 3C), the piston member 114 starts its return, rearward stroke towards its rearward position. In an initial phase of the rearward stroke, the piston member 114 moves rearwardly relative to the forward sealing element 148 so that the one-way valve is moved to its open position for the rearward stroke. The rearward stroke of the piston member 114 ends with the piston member 114 being disposed in its rearward position, where the forward sealing element 148 is disposed rearwardly of the forward dosing chamber section 120*a*, i.e. in the rear dosing chamber section 120*b* or, as shown in FIG. 3B, in the step 120*s* so that the forward and rear dosing chamber sections 120*a*, 120*b* are in flow communication about the forward sealing element 148 (e.g. via the flutes 120*d* where the rest position is in the step 120*s*).

It will thus be appreciated that in an initial phase of the forward stroke of the piston member 114 in the dosing chamber 120, from its rest position towards its forward position, the piston member 114 moves forwardly relative to the forward sealing element 148 to (re)close the one-way valve.

The rear and forward sealing elements 128, 148 in this embodiment are injection moulded from low density polyethylene (LDPE), but other functionally equivalent plastics materials could be used.

Figure 1B:
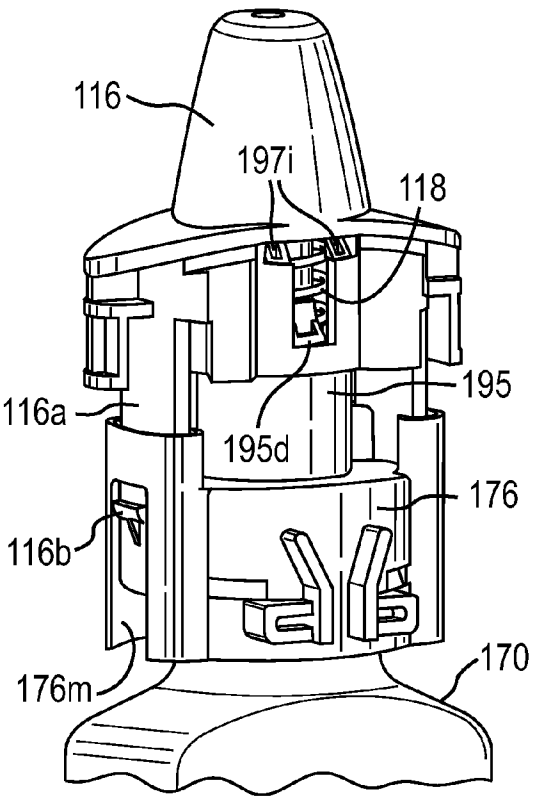

A return, compression spring 118 is provided in the fluid dispenser 110 to bias the piston member 114 to its rearward (resting) position relative to the dosing chamber 120, which is shown in FIGS. 1B and 3B. The spring 118 may be made from a metal (e.g. stainless steel, for instance 316 or 304 grade) or a plastics material. The return or biasing force of the return spring 118 may be 5N at rest, increasing to 8.5N as it is compressed. The biasing force of the return spring 118 acts to reset the piston member 114 in its rear position relative to the dosing chamber 120 defined in the main housing 112 by acting on the main housing annular flange 112*b* to bias the main housing 112 forwardly to its relative position shown in FIGS. 1B and 3B.

Figure 15A:
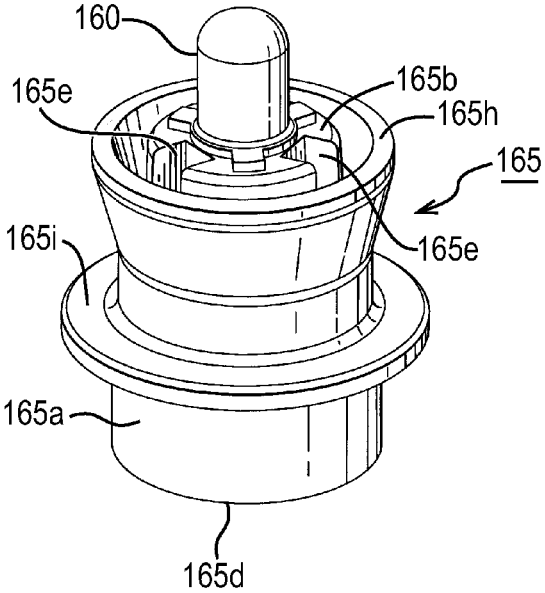
FIGS. 15A and 15B are respectively perspective and cross-sectional side views of a cap of the fluid dispenser of FIGS. 1 to 4 which mounts on the main housing of FIGS. 8A-B.
Figure 15B:
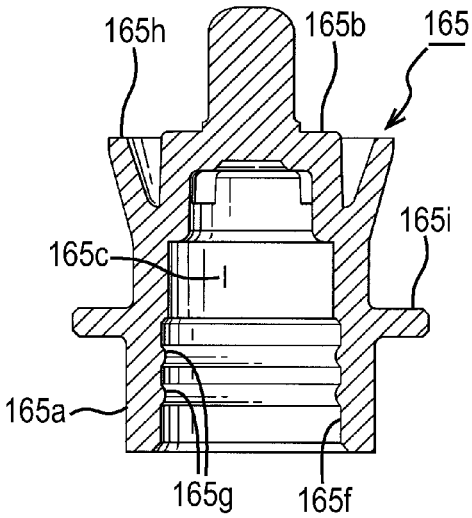

Referring to FIGS. 15A and 15B, the fluid dispenser 110 includes a separate cylindrical cap 165. The cap 165 is of cup-form, having an annular side skirt 165*a* and a forward end wall 165*b* which form the boundary walls of an internal cylindrical chamber 165*c* which is open at the rear end 165*d* of the cap 165. Moreover, a nipple 160 in the form of a central sealing tip projects forwardly from the forward end wall 165*b*.

A plurality of apertures 165*e* are also formed in the forward end wall 165*b*, about the base of the sealing tip 160, to communicate with the internal chamber 165*c*. In this embodiment, there are three equi-angularly spaced apart apertures 165*e*, but alternatively there may be less or more in number than three apertures.

The inner circumferential side surface 165*f* of the internal chamber 165 is provided with a pair of circumferential beads 165*g*. The outer circumferential edge of the forward end wall 165*b* presents a resilient, annular sealing lip 165*h*.

In this embodiment, the cap 165 is formed from LDPE, but again other plastics materials could be used.

As shown in FIGS. 3B and 3C, for instance, the cap 165 is mounted over the forward section 112*h* of the main housing 112 to enclose the forward bore section 112*f* of the main housing 112. The cap 165 is secured to the main housing 112 by the respective internal and external beads 165*g*, 112*i* clipping or interlocking together such that the main housing 112 and the cap 165 move in unison.

As further shown in FIGS. 3B and 3C, a valve mechanism 189 is located in the forward bore section 112*f* of the main housing 112. The valve mechanism 189 comprises a cylindrical, elongate valve element 191 mounted for axial movement in the forward bore section 112*f*.

Figure 13A:
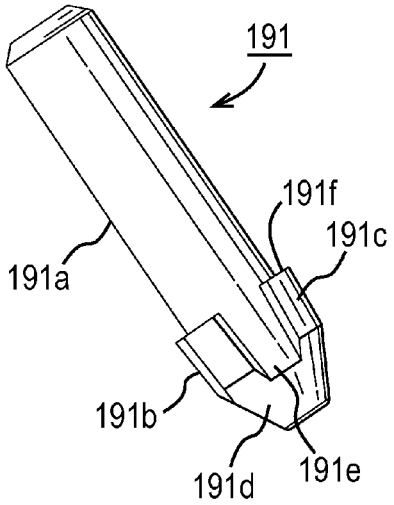
FIGS. 13A and 13B are perspective views of a valve element of a valve mechanism of the fluid dispenser of FIGS. 1 to 4 which mounts in the main housing of FIGS. 8A-B.
Figure 13B:
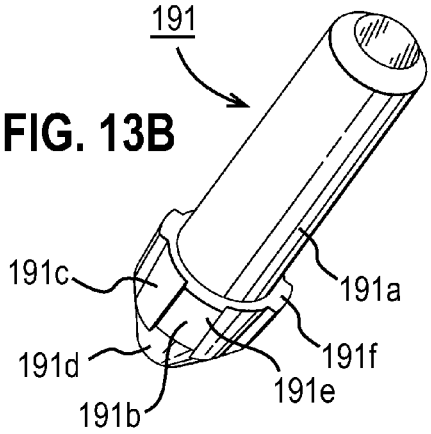

As shown in FIGS. 13A and 13B, the valve element 191 has a cylindrical forward section 191*a* and a coaxial, enlarged rear section 191*b*. The rear section 191*b* has a forward portion 191*c* and a frusto-conical rear portion 191*d* sized to sealingly fit in the restricted bore section 112*e* of the main housing 112 for closure thereof. A plurality of axial grooves 191*e* are formed in the outer peripheral surface of the rear section 191*b* to extend through the forward portion 191*c* and partially into the rear portion 191*d*.

Turning back to FIGS. 3B and 3C, the valve mechanism 189 further comprises a return, compression spring 193 which extends rearwardly from the inner surface of the forward end wall 165*b* of the cap 165 onto an annular flange 191*f* at the forward end of the rear section 191*b* of the valve element 191. The return spring 193 acts to bias the valve element 191 rearwardly to dispose the frusto-conical rear portion 191*d* in the restricted bore section 112*e* for sealing closure thereof.

The valve element 191 in this embodiment is injection moulded from low density polyethylene (LDPE) or polypropylene (PP), but other functionally equivalent plastics materials could be used. The return spring 193 may be of metal (e.g. of stainless steel, such as of 304 or 316 grade) or a plastics material. The return spring 193 may have a return force of approximately 0.4N.

Figure 1A:
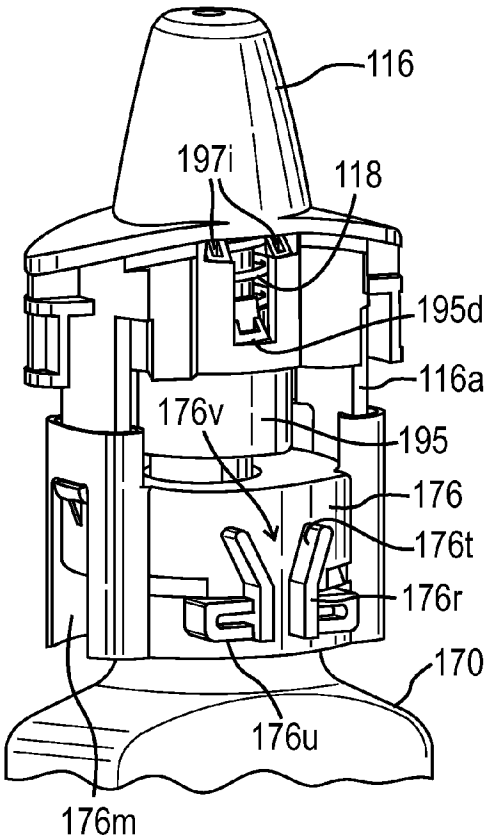

From FIGS. 1 to 3 it will be seen that the fluid dispenser 110 has a fluid supply 170, here in the form of a bottle (e.g. of glass or of a plastics material).

FIGS. 3B and 3C also show that the fluid dispenser 110 includes a cylindrical stopper portion 176 of cap form for fitting on a neck 178 of the bottle 170. In this embodiment, the stopper portion 176 is injection moulded from polypropylene (PP). However, other plastics materials could be used.

Figure 9A:
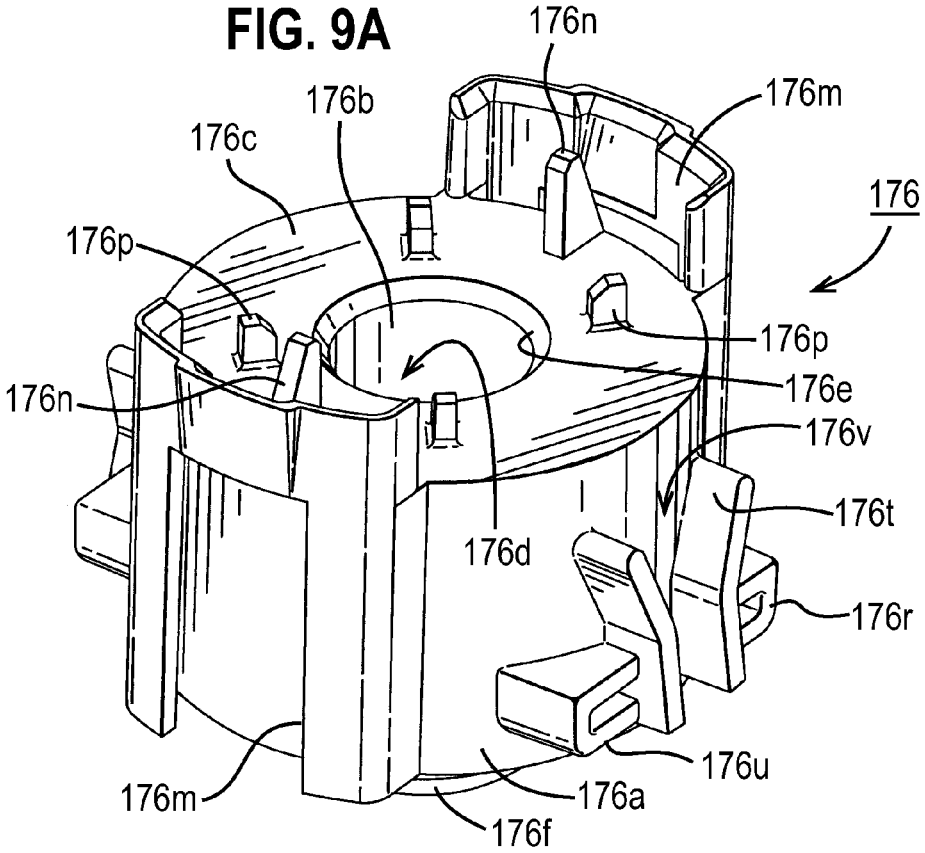
FIGS. 9A and 9B are respectively perspective and cross-sectional side views of a stopper portion of the fluid dispenser of FIGS. 1 to 4 which mounts on a fluid supply and to which mounts the piston member of FIGS. 5A-B.
Figure 9B:
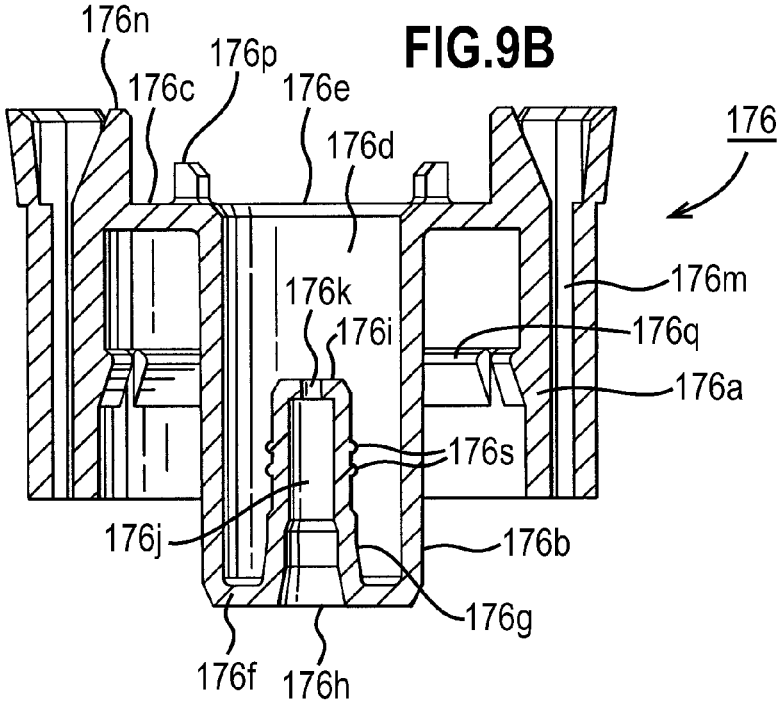

Referring also to FIGS. 9A and 9B, the stopper portion 176 has an outer annular skirt 176*a*, which surrounds the outer peripheral surface of a flange 180 of the bottle neck 178, and a concentrically arranged inner annular skirt 176*b*, which plugs the bottle neck 178. The inner peripheral surface of the outer annular skirt 176*a* is provided with circumferentially-oriented bead 176*q* to engage underneath the flange 180 of the bottle neck 178 to give a snap-fit connection of the stopper portion 176 to the bottle 170. The bead 176*q* may be continuous, or segmented (as here) to simplify the moulding of the stopper portion 176.

The stopper portion 176 has a roof 176*c* at its forward end extending radially inwardly from the outer skirt 176*a* to the inner skirt 176*b*. The inner skirt 176*b* encloses an internal cavity 176*d* which extends rearwardly from a opening 176*e* in the roof 176*c*. The cavity 176*d* has a floor 176*f* at its rear end from which upstands an elongate tubular projection 176*g*.

The tubular projection 176*g* has an open rear end 176*h*, a forward end wall 176*i*, an internal cavity 176*j* which extends forwardly from the open rear end 176*h* to the forward end wall 176*i*, and a forward opening 176*k* in the forward end wall 176*i* to place the internal cavities 176*d*, 176*j* in flow communication.

As shown in FIG. 3B, for example, a supply (dip) tube 172 (e.g. of polypropylene (PP)) inserts into the internal cavity 176*j* of the tubular projection 176*g* as an interference fit, with the supply tube 176 abutting the forward end wall 176*i* of the tubular projection 176*g*. Likewise, the tubular projection 176*g* inserts into the internal cavity 114*f* of the rear section 114*b* of the piston member 114 so that the forward end wall 176*i* of the tubular projection 176*g* abuts the forward face 114*n* of the internal cavity 114*f*. In this way, the bore network 114*j* in the piston member 114 is placed in flow communication with the fluid supply 170 through the supply tube 172. The supply tube 172 extends to adjacent the bottom of the fluid supply 170 so fluid can still be delivered from the fluid supply 170 in normal use (i.e. upright or substantially upright) when nearly empty.

The tubular projection 176*g* is secured against relative movement in the internal cavity 114*f* of the piston member 114 by the internal cavity 114*f* of the piston member 114 presenting a plurality of circumferential beads 114*v* on its inner circumferential surface to which clip or interlock circumferential beads 176*s* provided on the outer circumferential surface of the tubular projection 176*g*.

As further shown in FIG. 3B, for example, the tubular body 112*a* of the main housing 112 is also mounted in the internal cavity 176*d* of the stopper portion 176 for relative sliding motion therebetween. The relative sliding motion between the stopper portion 176 and the main housing 112 effects the relative sliding motion between the piston member 114 and the dosing chamber 120 because the piston member 114 is carried on the tubular projection 176*g* of the stopper portion 176. The relative sliding motion is achievable by having the main housing 112 move and maintaining the fluid supply 170 stationary, or vice-versa, or by having the main housing 112 and fluid supply 170 move at the same time.

It will be seen from FIG. 3B, for example, that a sealing ring 171 is interposed between the stopper portion 176 and the fluid supply 170 to prevent leaks therebetween. The sealing ring 171 may be made from a thermoplastic elastomer (e.g. SANTOPRENE®), an ethylene-vinyl acetate rubber (EVA), a polythene or from a low density polyethylene (LDPE) laminate comprising a LDPE foam core sandwiched between LDPE outer layers (sold under the brand name "TriSeal").

Figure 12A:
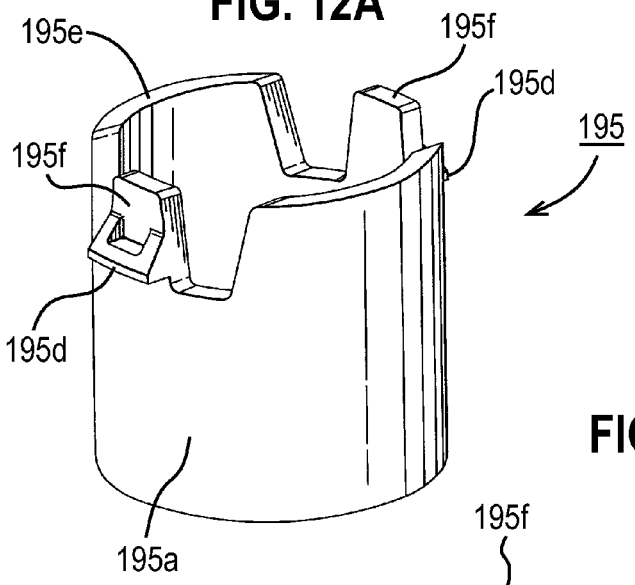
FIGS. 12A and 12B are respectively perspective and cross-sectional side views of a carrier member of the fluid dispenser of FIGS. 1 to 4 which slidingly mounts on the nozzle of FIGS. 10A-B and 11.
Figure 12B:
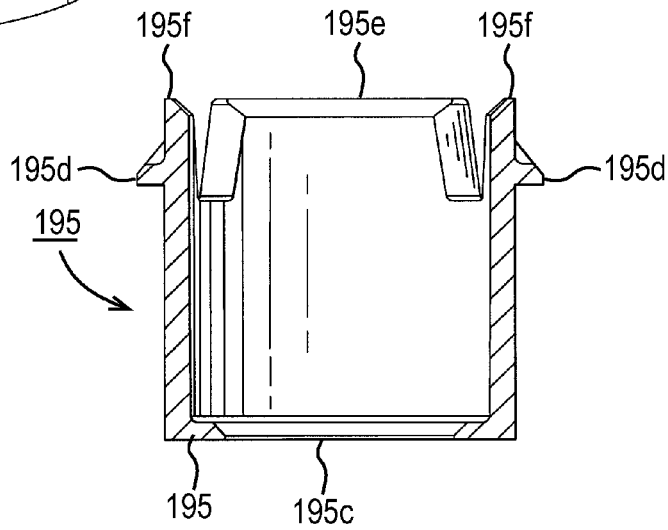

The fluid dispenser 110 further comprises a cylindrical carrier member 195 which surrounds the tubular body 112*a* of the main housing 112. As shown in FIGS. 12A and 12B, the carrier member 195 has an annular body 195*a* which is spaced radially outwardly of the tubular body 112*a* of the main housing 112 to define an annular space 187 therebetween. The annular body 195*a* has an inwardly projecting, annular flange 195*b* at its rear end 195*c*, and a plurality of outwardly projecting clips 195*d* disposed on tongues 195*f* defined by the castellated profile at its forward end 195*e*.

As shown in FIG. 3B, the return spring 118 extends rearwardly from the rear face 112*j* of the main housing annular flange 112*b* into the annular space 187 between the carrier member 195 and the main housing 112 and onto the carrier member annular flange 195*b* for carriage thereon.

In normal use of the fluid dispenser 110, the carrier member 195 seats on the roof 176*c* of the stopper portion 176, both in the rest and fired positions of the fluid dispenser 110 to be discussed hereinafter. This normal position for the carrier member 195 is shown in FIGS. 3B (rest) and 3C (fired).

The carrier member 195 in this embodiment is also injection moulded from polypropylene (PP), but other plastics materials may be used.

Referring back to FIGS. 9A and 9B which show the stopper portion 176, it will be seen that the roof 176*c* carries a pair of diametrically opposed main protrusions 176*n* and a series of minor protrusions 176*p* arranged equi-angularly about the roof opening 176*e*. The main protrusions 176*n* are adapted in use to act on the outer circumference of the carrier member 195 to centralise it with respect to the stopper portion 176 as the carrier member 195 is seated on the roof 176*c*. The minor protrusions 176*p* fit into complementary grooves (not shown) in the annular flange 195*b* of the carrier member 195 to correctly orient the carrier member 195 on the roof 176*c* so that the clips 195*d* will clip into T-shaped tracks 116*g* in a nozzle 116 to be described hereinafter. In a modification, such as shown in FIG. 31, there may be provided just two minor protrusions, each forming a radial extension from one of the main protrusions.

Figure 14A:
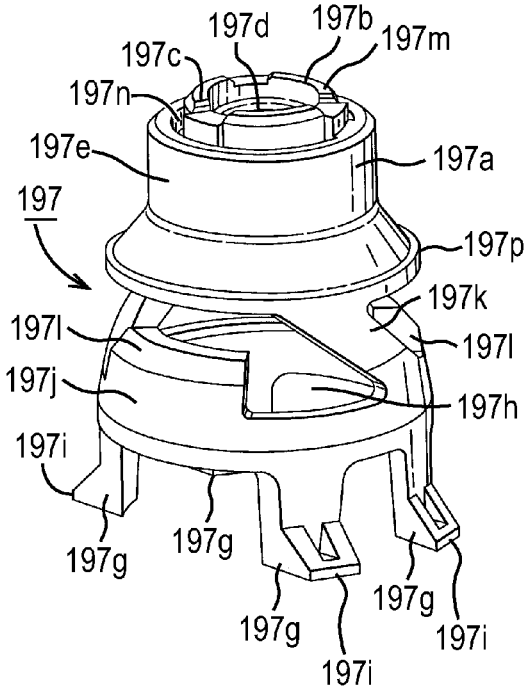
FIGS. 14A and 14B are respectively perspective and cross-sectional side views of a nozzle insert of the fluid dispenser of FIGS. 1 to 4 which inserts in the nozzle of FIGS. 10A-B and 11.
Figure 14B:
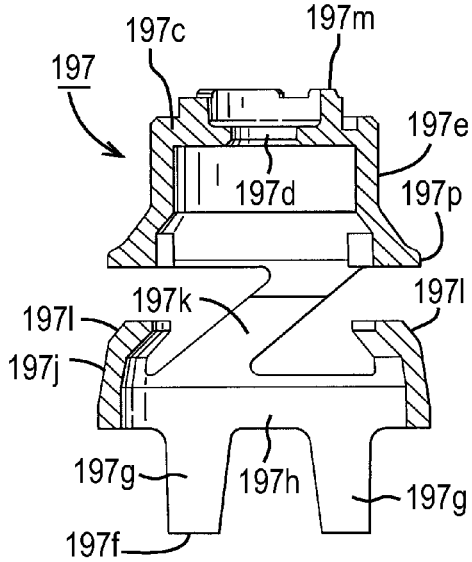

The fluid dispenser 110 also comprises a tubular nozzle insert 197 surrounding the cap 165 mounted on the forward section 112*h* of the main housing 112. FIGS. 14A and 14B show the nozzle insert 197 has a hollow body 197*a* which at its forward end 197*b* has an end wall 197*c* through which is provided a central aperture 197*d*. The body 197*a* comprises a first annular section 197*e* which extends rearwardly from the forward end wall 197*c* and has, about it rear end, an outer circumferential bead 197*p* for forming a seal with the inner surface of the nozzle 116. The rear end 197*f* of the nozzle insert body 197*a* is presented by a plurality of spaced-apart, rearwardly extending legs 197*g*. There are four legs 197*g* in this embodiment. The legs 197*g* are arranged circumferentially on the body 197*a* about a rear opening 197*h* to the body 197*a*. Each leg 197*g* comprises an outwardly extending foot 197*i*.

The nozzle insert body 197*a* further comprises a second annular section 197*j* spaced rearwardly of the first annular section 197*e* and from which the legs 197*g* depend. The first and second annular sections 197*e*, 197*j* are joined together by a plurality of spaced-apart, resilient ribs 197*k* which are disposed on the outer circumference of the body 197*a* and extend on a diagonal path between the first and second annular sections 197*e*, 197*j*.

The second annular section 197*j* presents a pair of diametrically opposed, forwardly oriented, resilient tongues 197*l*. The tongues 197*l* are disposed between the ribs 197*k*.

On the forward face of the forward end wall 197*c* there is provided an annular lip 197*m* about the central aperture 197*d*. The forward end wall 197*c* is further provided with apertures 197*n* therethrough.

The nozzle insert 197 in this embodiment is injection moulded from polypropylene (PP), but could be made from other plastics materials, as will be appreciated by those skilled in the art.

FIGS. 3B and 3C show the nozzle insert 197 is arranged in the fluid dispenser 110 about the cap 165 so that the sealing tip 160 of the cap 165 projects through the central aperture 197*d* in the forward end wall 197*c* of the nozzle insert 197. Moreover, the sealing lip 165*h* of the cap 165 is slidingly sealingly engaged with the inner circumferential surface of the first annular section 197*e* of the nozzle insert 197.

An annular space formed between the nozzle insert 197 and the cap 165 defines a fluid dispensement chamber 146.

It will be seen from FIGS. 15A-B that the cap 165 is provided with an outwardly projecting, annular flange 165*i*. As will be appreciated by additional reference to FIGS. 14A-B and FIG. 3B, as the cap 165 is inserted into the nozzle insert 197 during assembly, the flange 165*i* pushes past the resilient tongues 197*l* of the nozzle insert 197 to be retained in the space between the first and second annular sections 197*e*, 197*j* of the nozzle insert 197.

FIG. 3B shows that mounted on the sealing tip 160 of the cap 165 is a sealing member 154. The sealing member 154 is, sealingly mounted on the sealing tip 160 and seated on the forward end wall 197*c* of the nozzle insert 197. The seal formed between the opposing longitudinal surfaces of the sealing member 154 and the sealing tip 160 is such that fluid cannot pass therebetween.

The sealing member 154 is made from natural rubber or a thermoplastic elastomer (TPE), but other elastic materials may be used which have a 'memory' to return the sealing member 154 to its original state. The sealing member 154 may be made from ethylene propylene diene monomer (EPDM), for instance as an injection moulded EPDM component.

As shown in FIGS. 3A and 4, in this tip seal arrangement of the fluid dispenser 110 the return spring 118 biases the cap 165 into abutment with the nozzle insert 197 to control the position of the sealing tip 160 relative to the sealing member 154. More particularly, the forward end wall 165*b* of the cap 165 is biased into direct engagement with the rear side of the forward end wall 197*c* of the nozzle insert 197. This has the advantage of protecting the sealing member 154 from excessive force being applied to it by the sealing tip 160 in the rest state of the fluid dispenser 110, which of course is the predominant state of the fluid dispenser 110.

As illustrated by FIGS. 1 and 2, the nozzle 116 is slidably connected to the stopper portion 176 through engagement of a pair of rearwardly directed runners 116*a* of the nozzle 116 in complementary tracks 176*m* on the outer circumference of the stopper portion 176. The runners 116*a* are provided with outwardly extending clips 116*b* to secure the runners 116*a* in the tracks 176*m* and to delimit the maximum sliding separation between the nozzle 116 and the stopper portion 176.

Figure 10A:
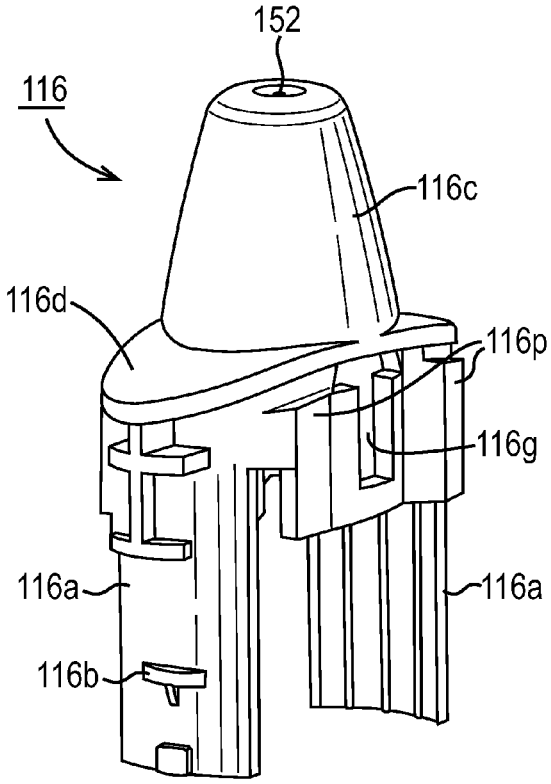
FIGS. 10A and 10B are respectively perspective and cross-sectional side views of a nozzle of the fluid dispenser of FIGS. 1 to 4 which slidingly mounts on the stopper portion of FIGS. 9A-B.
Figure 10B:
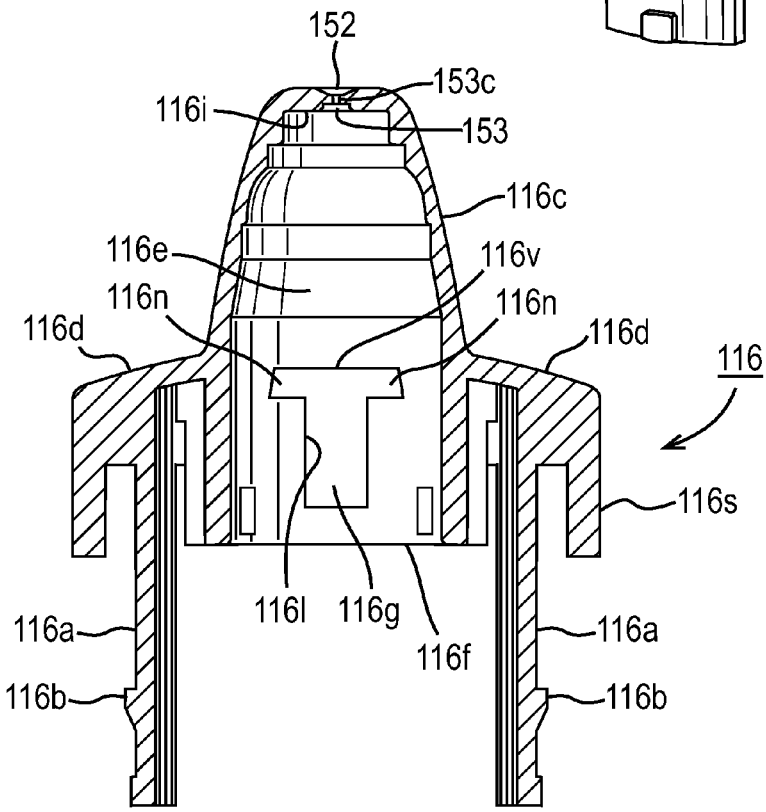

As further illustrated in FIGS. 10A and 10B, the nozzle 116 has a nozzle section 116*c*, sized and shaped for insertion into a nostril of a human being, in which is formed a fluid outlet 152, and shoulders 116*d* at the rear end of the nozzle section 116*c* from which depend the runners 116*a*.

The nozzle section 116*c* encloses an internal cavity 116*e* having a rear open end 116*f*. A pair of T-shaped cut-outs 116*g* are provided on opposite sides of the internal cavity 116*e*. The longitudinal section 1161 defines a track in which the clips 195*d* of the carrier member 195 are clipped to secure the carrier member 195 to the nozzle 116 and to provide for sliding movement therebetween.

Moreover, in each corner 116*n* of the crossbar section 116*v* of the T-shaped cut-outs 116*g* is clipped one of the feet 197*i* of the nozzle insert 197 to fix the nozzle insert 197 in the internal cavity of the nozzle 116. These connections are best seen in FIGS. 1A-C. The resilient ribs 197*k* of the nozzle insert 197 act as springs to enable the nozzle insert 197 to be inserted into the nozzle 116 and then the second annular section 197*j* to be compressed so that the feet 197*i* fix in the T-shaped cut-outs 116*g*. The nozzle insert 197 is then held captive in the nozzle 116. Moreover, the first annular section 197*a* forms a fluid-tight seal against the adjacent inner surface of the nozzle internal cavity 116*e* to prevent liquid leaking therebetween.

As shown in FIG. 11, a swirl chamber 153 is formed in the forward end wall 116*i* of the nozzle internal cavity 116*e*. The swirl chamber 153 comprises a central cylindrical chamber 153*a* and a plurality of feed channels 153*b* which are equispaced about the central chamber 153*a* in tangential relationship thereto. At the centre of the central chamber 153*a* is a passageway 153*c* (exit) connecting the swirl chamber 153 to the fluid outlet 152. The feed channels 153*b* may be square cut and may have a depth in the range of 100 to 500 microns (inclusive), such as 100 to 250 microns (inclusive), for instance in the range of 150 to 225 microns (inclusive). The width may be the same as the depth, for instance 400 microns.

To accelerate the fluid as it flows towards the central chamber 153*a*, the feed channels 153*b* are provided with a decreasing cross-sectional area in the fluid flow direction.

As shown in FIG. 11, in this instance the feed channels 153*b* decrease in width as they approach the central chamber 153*a*. The decreasing cross-sectional area may then be provided by maintaining a constant channel depth along the length of the feed channels 153*b*.

In an alternative case, the width of the channels 153*b* may remain uniform throughout, and the channel depth decrease as the feed channels 153*b* approach the central chamber 153*a*. In this regard, the depth of the feed channels 153*b* may vary uniformly from 400 microns to 225 microns, for example.

The width and depth of the feed channels 153*b* may also both vary along their length whilst providing the decreasing cross-sectional area in the fluid flow direction. In this regard, the aspect (width:depth) ratio along the length of the feed channels 153*b* may be maintained constant.

Preferably, the feed channels 153*b* are of narrow width to inhibit their obstruction by the sealing member 154, e.g. as from creep of the sealing member material. Preferably, the feed channels 153*b* have a low aspect (width:depth) ratio; i.e. are narrow and deep, preferably with the width being less than the depth (e.g. of rectangular cross-section).

As will be understood from FIG. 4, a gap exists between the side face 154*d* of the sealing member 154 and the adjacent inner side faces of the internal cavity 116*e* of the nozzle 116 to enable fluid to flow towards the swirl chamber 153. This fluid flow path could instead be formed by forming longitudinal grooves in the outer side face of the sealing member 154 and/or the inner side faces of the nozzle 116. More particularly, the gap/fluid flow path between the sealing member 154 and the nozzle 116 places the feed channels 153*b* of the swirl chamber 153 in flow communication with the fluid dispensement chamber 146, via the apertures 197*n* and, optionally, gaps between the sealing member 154 and the forward opening 197*d* of the nozzle insert 197.

However, as shown most clearly in FIG. 4, the forward face 154*c* of the flexible sealing member 154 is held by the nozzle insert 197 in sealing engagement with the forward end wall 116*i* of the nozzle 116. This means that the sealing member 154 seals over the swirl chamber feed channels 153*b* and that any liquid travelling up the gap between the side face 154*d* of the sealing member 154 and the adjacent surfaces of the internal cavity 116*e* of the nozzle 116 has to pass into the swirl chamber feed channels 153*b* and thence into the central chamber 153*a* of the swirl chamber 153.

Moreover, the return spring 118 acts to bias the main housing 112 forwardly in the nozzle 116 whereby the sealing tip 160, on the cap 165 fixed on the forward section 112*h* of the main housing 112, pushes a central part of the forward face 154*c* of the sealing member 154 into the central chamber 153*a* of the swirl chamber 153 to sealingly close the passageway 153*c* to the fluid outlet 152. In this way, no fluid can enter or exit the fluid outlet 152, or more particularly the swirl chamber 153, until the sealing tip 160 releases the central part of the elastic sealing member 154, to be described in more detail hereinafter.

In a modification, the straight walls of the central chamber 153*a* of the swirl chamber 153 may be chamfered to facilitate pushing the central part of the sealing member 154 thereinto. This is shown in FIG. 17, with the chamfered surface denoted by reference number 153*d*.

The nozzle 116 in this embodiment is injection moulded from polypropylene (PP), but other plastics materials could be used.

To operate the fluid dispenser 110, it is first necessary to prime the fluid dispenser 110 to fill all the fluid pathways between the fluid outlet 152 and the fluid supply 170. To prime, the fluid dispenser 110 is operated in exactly the same manner as for later dispensing operations. As shown in FIGS. 1B-C and 3B-C, this is done by (i) sliding the nozzle 116 relatively towards the fluid supply 170, by acting on the nozzle 116, or the fluid supply 170, while keeping the other stationary, or acting on both, to move the fluid dispenser from its rest position (FIGS. 1B and 3B) to its fired position (FIGS. 1C and 3C); and (ii) allowing the return spring 118 to return the nozzle 116 to its separated position relative to the fluid supply 170 to return the fluid dispenser 110 to its rest position. The relative sliding movement of the nozzle 116 and the fluid supply 170 is effected by the runners 116*a* of the nozzle 116 sliding in the tracks 176*m* of the stopper portion 176 fixed in the neck 178 of the fluid supply 170.

It will be appreciated that the relative movement of the nozzle 116 and the fluid supply 170 to effect priming and then dispensing from the dispenser 110 is actually relative movement between the nozzle 116 and the components assembled thereto (the "nozzle assembly", including the nozzle insert 197, the cap 165 and the main housing 112) and the fluid supply 170 and the components assembled thereto (the "bottle assembly", including the stopper portion 176 and piston member 114). The return spring 118 biases the nozzle assembly away from the bottle assembly and thus the piston member 114 to its rearward, rest position in the dosing chamber 120 in the main housing 112.

FIGS. 16A to 16J show the priming process, and the liquid flow during priming, albeit for a fluid dispenser 310 which is a subtle modification (but functional equivalent) of the fluid dispenser 110 of FIGS. 1 to 15, with like features being assigned like reference numbers. While the fluid dispenser 310 of FIGS. 16A to 16J will be discussed in more detail after the description of the fluid dispenser 110, FIGS. 16A to 16J are a useful reference to the detailed description of priming of the fluid dispenser 110 which now follows.

Each complete (reciprocal) cycle of the afore-mentioned sliding movement (a "pumping cycle") between the nozzle 116 and the fluid supply 170 includes a phase which creates a negative pressure in the dosing chamber 120 which draws liquid from the fluid supply 170 up the supply tube 172 and this cycling continues until liquid fills up all the fluid pathways from the fluid supply 170 to the fluid outlet 152, as will be now described in more detail.

Figure 16B:
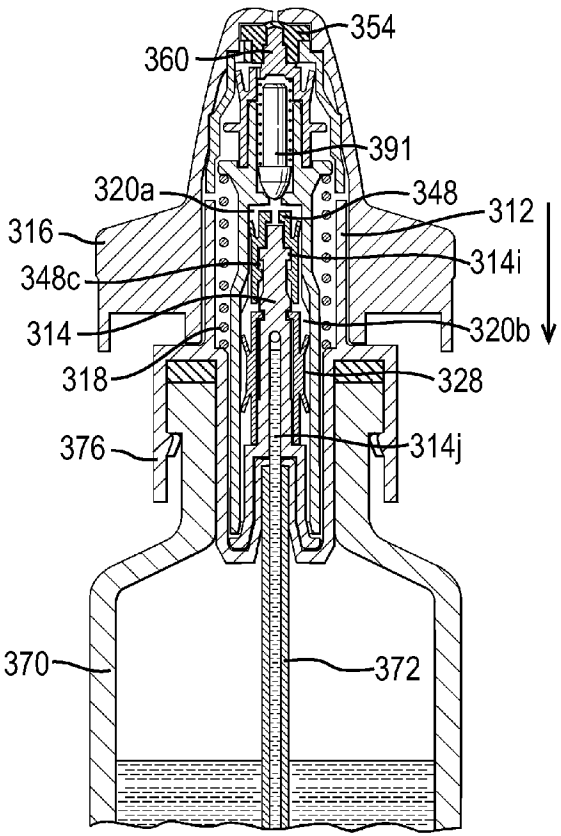
FIGS. 16A to 16J are cross-sectional side views of a modified version of the fluid dispenser of FIGS. 1 to 15 in accordance with the present invention showing the sequential advancement of liquid therewithin during priming of the dispenser.
Figure 16A:
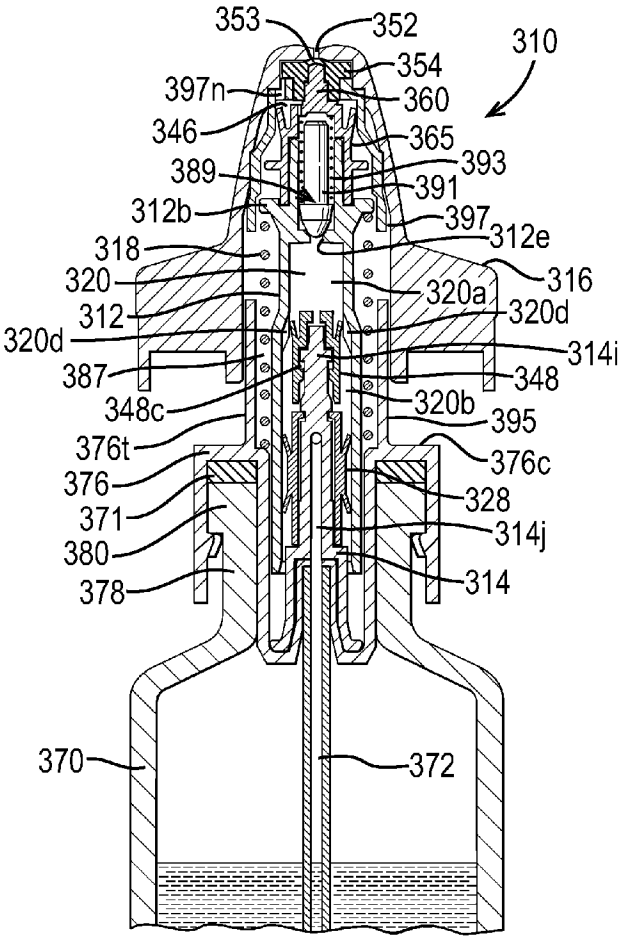
Figure 16D:
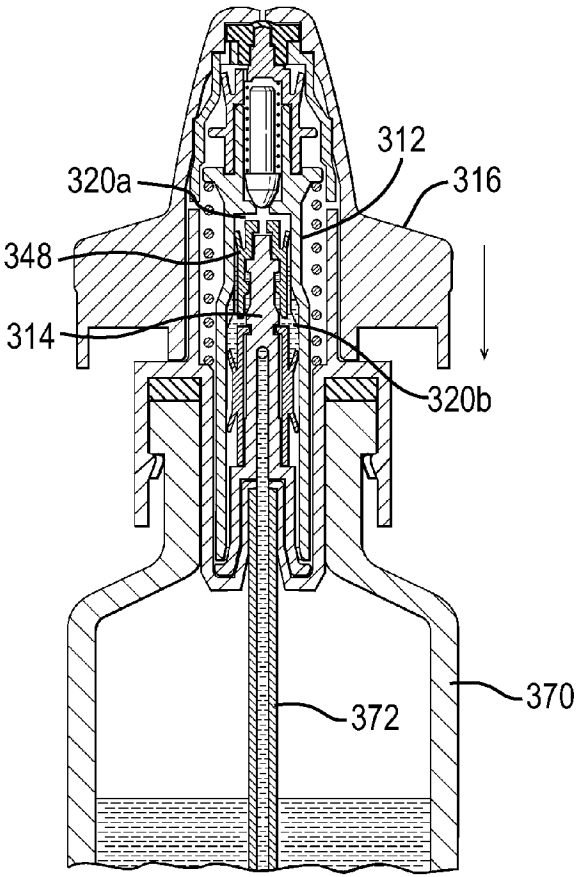
Figure 16C:
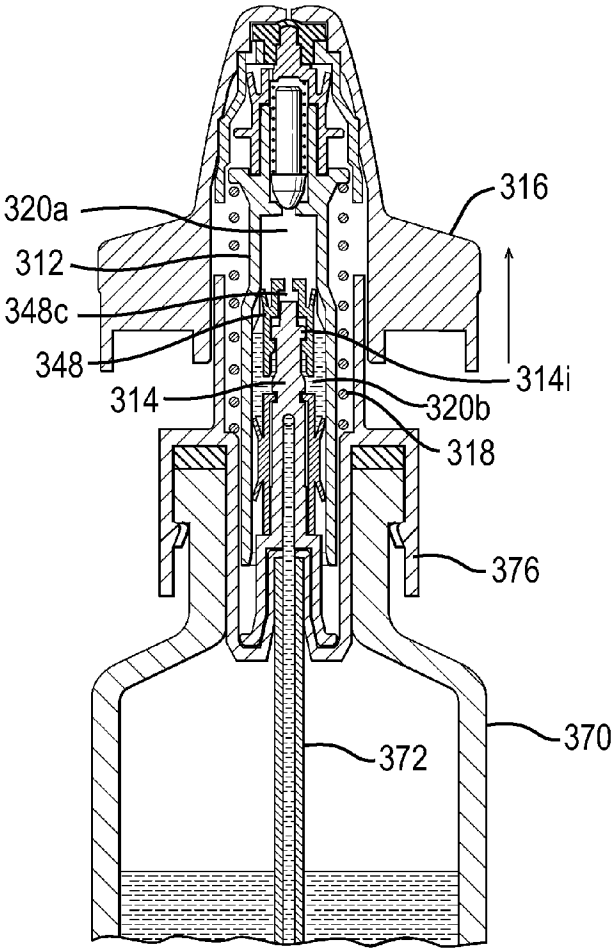
Figure 16F:
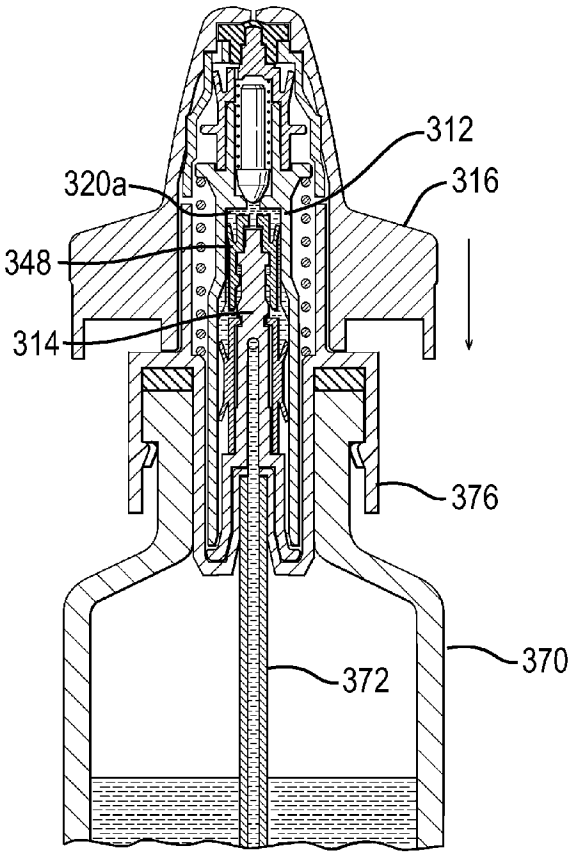
Figure 16E:
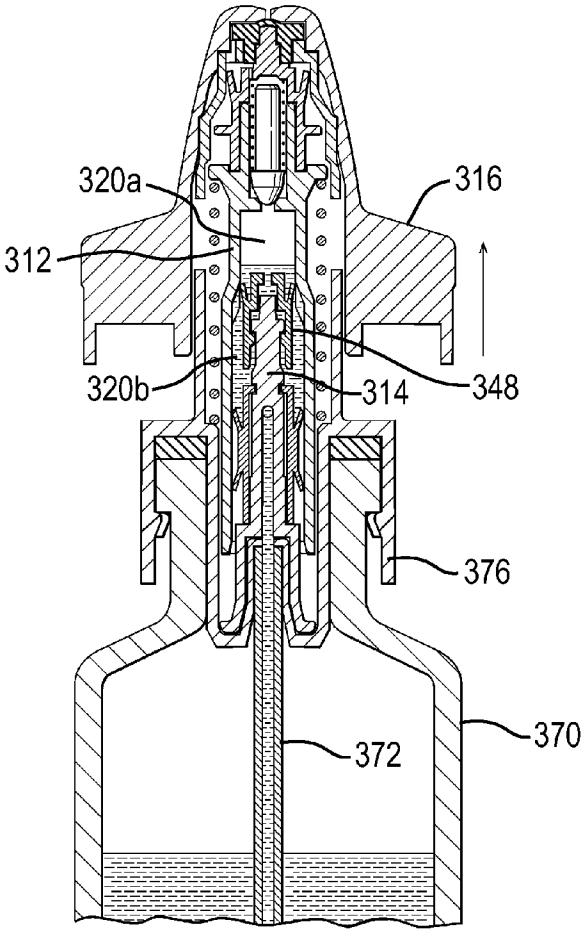

In more detail, the liquid flows forwardly through the supply tube 172, into the bore network 114*j* of the piston member 114 via the rear opening 114*m* thereof, and out of the forward openings 114*q* of the bore network 114*j* into the rear section 120*b* of the dosing chamber 120 via the axial grooves 114*r* in the outer periphery of the piston member 114 (see FIGS. 16A to 16C).

As a result of the nozzle 116 and the fluid supply 170 respectively carrying the main housing 112 and the piston member 114, as described above, each reciprocal cycle of relative movement of the nozzle 116 and the fluid supply 170 causes the piston member 114 to stroke in corresponding reciprocating fashion inside the dosing chamber 120 defined by the main housing 112 from the rear (rest) position.

As the piston member 114 returns from its forward position to its resting, rear position, in the second half of each cycle, a negative pressure is created in the dosing chamber 120 to draw the liquid further forwardly. Moreover, the piston member 114 moves rearwardly relative to the forward sealing element 148 to open the one-way valve, as described hereinabove, and therefore allows the liquid to flow forwardly into the forward dosing chamber section 120*a* through the one-way valve (see FIGS. 16D to 16G). Friction forces between the lip seal 148*a* and the dosing chamber wall assist in the telescoping of the forward sealing element 148 on the piston member 114.

Specifically, as the annular flange 114*i* of the piston member 114 disengages from the forward end wall 149*d* of the central bore section 149*c* of the bore 149 in the forward sealing element 148, the liquid to the rear of the one-way valve is able to flow around the flange 114*i* of the piston member 114 via the windows 149*f* in the forward sealing element 148, over the tip part 114*u* of the piston member 114 and through the forward bore section 149*a* of the forward sealing element 148 into the forward section 120*a* of the dosing chamber 120.

Figure 16H:
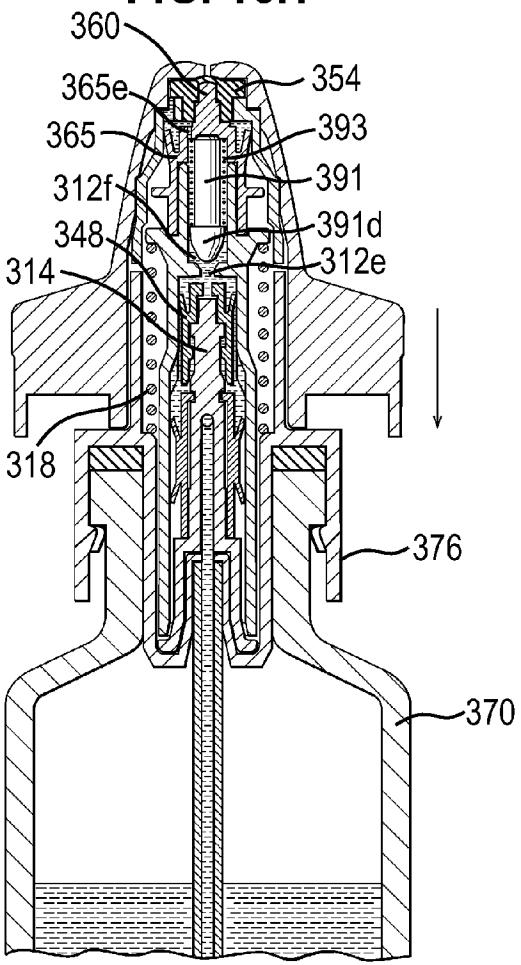
Figure 16G:
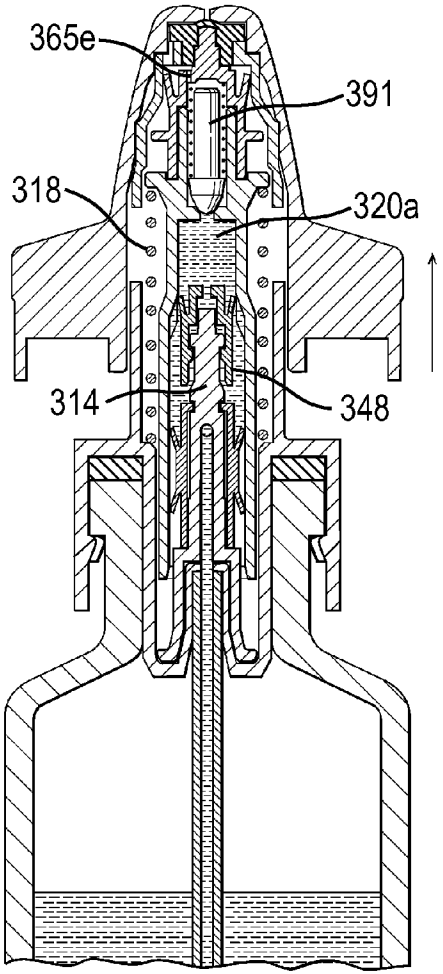
Figure 16J:
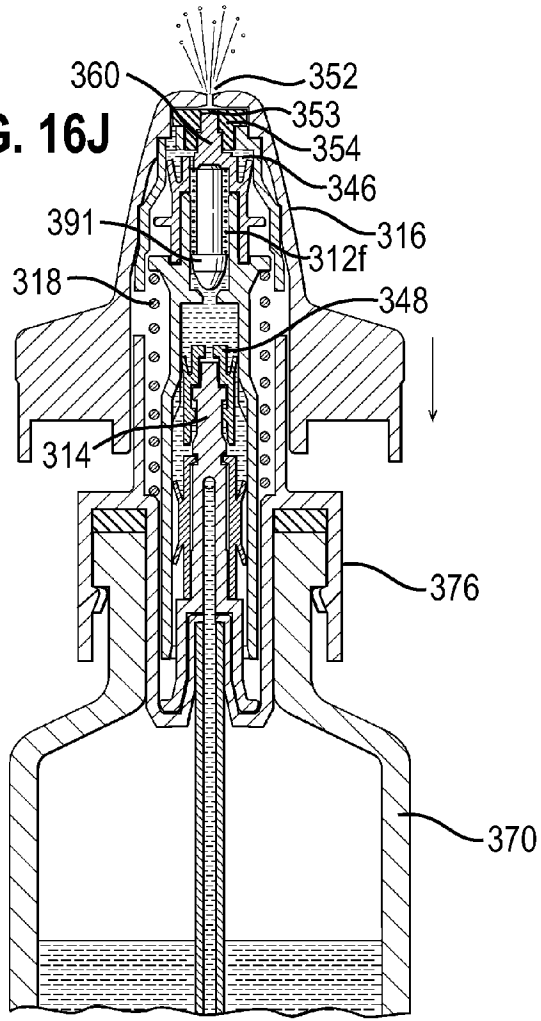

After the dosing chamber 120 (including the forward section 120*a*) is filled with liquid by priming the fluid dispenser with enough pumping cycles (see FIG. 16G), each cycle thereafter results in the same amount (a metered volume) of the liquid being pumped forward from the dosing chamber 120 through the restricted bore section 112*e* in the main housing 112 (compare FIGS. 16G and 16H).

In more detail, in the forward stroke of the piston member 114 to its forward position in the dosing chamber 120, the valve mechanism 189 in the forward bore section 112*f* keeps the restricted bore section 112*e* shut until after the forward sealing element 148 comes into sealing engagement with the inner surface of the forward dosing chamber section 120*a*. This is because the biasing force of the valve return spring 193 is not overcome by the hydraulic pressure of the liquid produced on the initial (first) phase of the forward stroke of the piston member 114 prior to the forward sealing element 148 sliding into sealing engagement in the forward dosing chamber section 120*a* to sealingly separate the forward and rear dosing chamber sections 120*a*, 120*b*.

This first phase may be referred to as the "bleed phase" because it results in liquid being pumped rearwardly from the dosing chamber 120 back into the fluid supply 170 (i.e. bled) until the piston member 114 locates the forward sealing element 148 in the forward dosing chamber 120*a* (i.e. so there is no longer any flow therebetween, recalling that the one-way valve defined by the forward sealing element 148 on the piston member 114 is reclosed in the forward stroke of the piston 114). The bleed flow is aided by the provision of the at least one axial flute 120*d* in the step 120*s* of the dosing chamber 120.

Once the forward sealing element 148 is located in the forward dosing chamber 120*a*, the forward dosing chamber

120*a*, and the metered volume of liquid which fills it, is sealed. The flutes 120*d* no longer provide a fluid flow path into the forward dosing chamber section 120*a*, since the forward sealing element 148 is at, or forward of, the forward end of the flutes 120*d* and in sealing engagement with the inner wall of that chamber section 120*a*.

In the next (second) phase of the continuous forward stroke of the piston member 114, the piston member 114 increases the hydraulic pressure of the liquid in the forward dosing chamber section 120*a* as it moves relatively towards the forward end wall 120*c* of the forward dosing chamber section 120*a* presented by the annular shoulder 112*d* of the main housing 112. At a certain point in the second phase of the forward stoke of the piston member 114, which may be nearly instantaneous, the hydraulic pressure of the liquid in the forward dosing chamber section 120*a* is at a level which is greater than the biasing force in the return spring 193 of the valve mechanism 189, whereby the valve element 191 is forced out of sealing engagement with the restricted bore section 112*e* (which functions as a "valve seat"), as shown in FIG. 16H. This is the start of the final (third) phase of the continuous forward stroke of the piston member 114 which ends when the piston member 114 reaches its forward position, as delimited by abutment of the forward end 148*c* of the forward sealing element 148 with the forward end wall 120*c* of the dosing chamber 120. In this final phase, the metered volume of the liquid in the forward dosing chamber section 120*a* is dispensed through the restricted bore section 112*e*, being conveyed along the grooves 191*e* in the valve member 191 into the forward bore section 112*f* of the main housing 112, before the valve mechanism 189 is re-closed by the return spring 193 returning the valve member 191 into sealing engagement in the restricted bore section 112*e*.

The valve mechanism 189 only opens in this final (third) phase, remaining closed at all other times.

The second and third phases can collectively be considered as a "dispensing phase".

In an initial (first) phase of the return, rearward stroke of the piston member 114 in the dosing chamber 120, driven by the return spring 118, the piston member 114 not only moves rearwardly with respect to the dosing chamber 120, but also to the forward sealing element 148 so as to open the one-way valve, as discussed hereinabove. Moreover, a negative pressure (or vacuum) is generated in the headspace being formed in the forward dosing chamber section 120*a* in front of the rearwardly moving piston member 114.

Figure 16I:
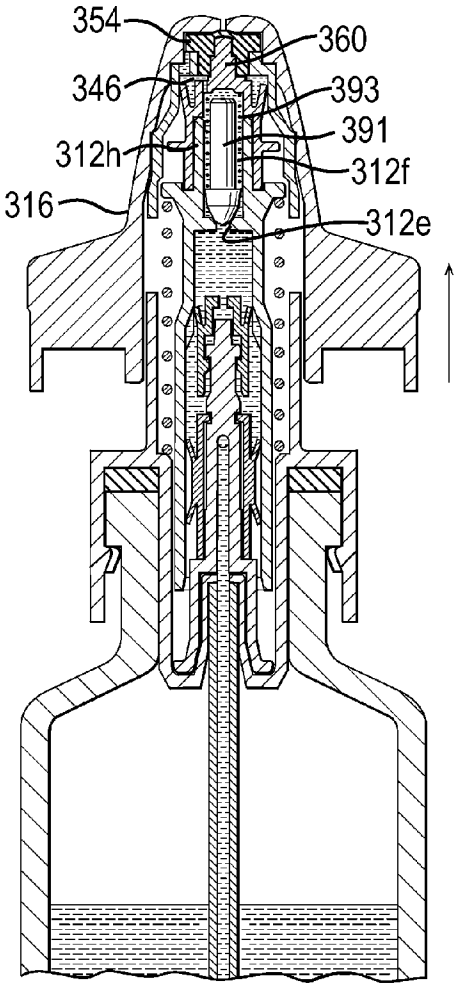

This negative pressure draws more liquid out of the fluid supply 170 and through the open one-way valve into the forward dosing chamber section 120*a* until the forward sealing element 148 disengages from the forward dosing chamber 120*a* to enter the step 120*s* (see FIG. 16I). The provision of the one-way valve on the piston 114 which opens in the initial phase of the return stroke avoids the creation of any hydraulic lock in front of the piston member 114 which could otherwise prevent or inhibit the return stroke.

In a final (second) phase of the rearward stroke of the piston member 114, the piston member 114 moves from an intermediate position, at which the forward sealing element 148 has just been disposed in the step 120*s* to its rearward position. In this final phase, the liquid is able to be drawn from the rear dosing chamber section 120*b* directly into the forward dosing chamber section 120*a* around the outside of the forward sealing element 148, in addition to via the open one-way valve. When the forward sealing element 148 is moving rearwardly in the step 120*s*, the liquid flows around it via the flutes 120*d*. Concomitantly, bleeding of the liquid from the forward dosing chamber section 120*a* to the rear dosing chamber section 120*b* is via the flutes 120*d* when the forward sealing element 148 is moving forwardly in the step 120*s* towards the forward section 120*a*.

At the end of the return, rearward stroke, the dosing chamber 120 is refilled with liquid. In other words, the volume between the forward lip seal 128*a* of the rear sealing element 128 and the forward end wall 120*c* of the dosing chamber 120 is filled. The return stroke may thus be referred to as the "filling phase".

Thus, each cycle of movement of the piston member 114 in the dosing chamber 120, as effected by reciprocal movement between the nozzle assembly and the bottle assembly, comprises the bleeding, dispensing and filling phases.

In each subsequent cycle of movement of the piston member 114, the forward stroke results in another metered volume of the liquid being captured in the forward dosing chamber section 120*a* and then discharged through the restricted bore section 112*e*, while the rearward stroke results in liquid being drawn from the fluid supply 170 to refill the dosing chamber 120.

During priming, such subsequent pumping cycles continue until the liquid fills the fluid flow path from the dosing chamber 120 to the fluid outlet 152 (see FIG. 16I). In this regard, the liquid passing through the restricted bore section 112*e* flows through the forward bore section 112*f* of the main housing 112, into the fluid dispensement chamber 146 via the apertures 165*e* in the forward end wall 165*b* of the cap 165 mounted over the forward end of the main housing 112, into the space around the sealing member 154 by passing through the apertures 197*n* in the nozzle insert 197 fitted inside the nozzle 116 to enclose the cap 165 and thence into the swirl chamber 153 via the feed channels 153*b* thereof.

When liquid fills the fluid pathway from the fluid supply 170 to the fluid outlet 152, the forward stroke of the piston member 114 relative to the dosing chamber 120 in the next pumping cycle results in another metered volume of liquid being pumped through the restricted bore section 112*e* thereby pressurising the liquid pending downstream of the restricted bore section 112*e*. This pressure in the fluid dispensement chamber 146 results in rearward sliding movement of the cap 165 (and the main housing 112) in the nozzle insert 197 against the return force of the return spring 118 whereby the sealing tip 160 sealingly slides rearwardly in the sealing member 154. This is because the surface area of the sealing cap 165 bounding the fluid dispensement chamber 146 (and hence being acted upon by the pressurised fluid) is greater than that of the nozzle insert 197.

As a result, the elasticity of the sealing member 154 flattens the central part of the forward face 154*c* of the sealing member 154 back to its original state to open the central chamber 153*a* and passageway 153*c* of the swirl chamber 153 (see FIG. 3C). Consequently, a metered volume of the liquid is pumped through the fluid outlet 152 via the swirl chamber 153 for atomisation thereof to make space for the metered volume pumped through the restricted bore section 112*e* in that forward stroke (see FIG. 16J).

The dynamic seal between the opposing longitudinal sides of the sealing tip 160 and the sealing member 154 prevents liquid under the hydraulic pressure entering the sealing member cavity 154*e* (FIG. 4) in which the sealing tip 160 is disposed and acting to oppose the central part of the forward face 154*c* of the sealing member 154 moving back to its original state when released by the sealing tip 160.

The return force of the return spring 118 moves the main housing 112 and sealing cap 165 back (forwardly) to its normal, rest position in the nozzle insert 197 once the return force is greater than the hydraulic pressure in the fluid dispensement chamber 146 so that the sealing tip 160 deflects the sealing member 154 to (re)close the fluid outlet 152.

The sealing member 154 thus protects the liquid inside the fluid dispenser 110 from contamination by contaminants outside of the dispenser 110 entering through the fluid outlet 152 as it only opens during dispensing (i.e. when the fluid dispenser 110 is fired).

The rearward stroke of the same pumping cycle draws liquid from the liquid supply 170 to refill the dosing chamber 120, ready for the next pump cycle.

The dispenser is now fully primed, and each pump cycle thereafter results in a constant metered volume of the liquid being pumped from the fluid outlet 152 until the fluid supply 170 is exhausted.

It will be appreciated that the fluid dispenser 110 configuration is such that there will be no, or substantially no drainback of the liquid pending in the path between the dosing chamber 120 and the fluid outlet 152 as the restricted bore section 112*e* is sealed shut by the valve mechanism 189 except in the dispensing phase of the forward stroke. Thus, the need to re-prime the dispenser is avoided or substantially alleviated. Moreover, the tip seal arrangement, formed by the sealing member 154 and the sealing tip 160, and the valve mechanism 189 prevent or substantially prevent ambient air being drawn into the fluid dispenser 110 through the fluid outlet 152 by the negative pressure (e.g. vacuum) created in the dosing chamber 120 in the filling phase.

It is also notable that during priming of the fluid dispenser 110, air (and any other gas) in the headspace above the liquid is pumped out of the fluid outlet 152 by the same mechanism as described above for the liquid.

As described previously, the engagement of the forward end wall 165*b* of the cap 165 with the rear side of the end wall 197*c* of the nozzle insert 197 limits the length of the sealing tip 160 that is able to project through the nozzle insert 197 onto the rear face of the sealing member 154. In this way, the stress applied by the sealing tip 160 to the sealing member 154 is controlled and so too, therefore, is creep of the sealing member 154 over the lifetime of the dispenser 110. Consequently, in this arrangement the sealing member 154 will be less prone to creep into the swirl chamber feed channels 153*b* to create a permanent obstruction therein and to lose the elastic/shape memory properties upon which the sealing member 154 relies to open the fluid outlet 152 when the sealing tip 160 is moved rearwardly in use of the fluid dispenser 110, as described hereinabove.

Moreover, the above-described engagement of the sealing cap 165 and the nozzle insert 197 demarcates the forwardmost position of the main housing 112 in the nozzle 116, noting that the nozzle insert 197 is fixed in position in the nozzle 116 through engagement of the nozzle insert feet 197*i* in the T-shaped cut-outs 116*g*. This forwardmost position of the main housing 112 in the nozzle 116 is its normal, rest position as a result of the action of the return spring 118. The main housing 112 only moves rearwardly from this rest position when the fluid in the fluid dispensement chamber 146 is pressurised in the dispensing phase of the operational cycle of the fluid dispenser 110. This fixing of the rest position of the main housing 112 in the nozzle 116 ensures that the piston member 114 is able to abut the forward end wall 120*c* of the dosing chamber 120 in the dispensing phase for reliable metering from the dosing chamber 120, noting that if the main housing 112 was 'floating' in the nozzle 116 so as to be able to be moved further forwardly therein, the piston member 114 would be spaced rearwardly of the dosing chamber forward end wall 120*c* at the end of the forward stroke of the piston member 114, as demarked by engagement of the roof 176*c* of the stopper portion 176 with the rear end 116*f* of the nozzle 116.

It will also be appreciated that the inter-engagement of the sealing cap 165 with the nozzle insert 197 also prevents the piston member 114 being able to push the sealing tip 160 any farther into the sealing member 154 when the piston member 114 contacts the forward end wall 120*c* of the dosing chamber 120.

FIGS. 1A and 3A show the fluid dispenser 110 in an open (fully extended) position, where the nozzle 116 (and its attached components) is spaced farther from the bottle 170 (and its attached components) than in the rest position shown in FIGS. 1B and 3B. More particularly, in the rest position, the carrier member 195 rests on, or in close proximity to, the roof 176*c* of the stopper portion 176, whereas in the open position the carrier member 195 is spaced from the stopper portion roof 176*c*. In the open position, the clips 116*b* on the runners 116*a* of the nozzle 116 are at the forwardmost position with respect to the tracks 176*m* on the stopper portion 176, as shown in FIG. 3A. In the rest position, by contrast, the clips 116*b* are spaced rearwardly of the forwardmost position, as also shown in FIG. 3B. The ability for the nozzle 116 and bottle 170 to be further separated from the normal rest position provides protection of the fluid dispenser against breakage in the event it is dropped or suffers an impact.

It will be appreciated that the fluid dispenser 110 is able to adopt the open position through the carrier member 195 being separate from the stopper portion 176. FIG. 1B reveals that in the rest position, the clips 195*d* of the carrier member 195 are positioned at the rear end of the T-shaped tracks 116*g*. Forward movement of the nozzle 116 relative to the bottle 170 is only permitted since the carrier member 195 is able to be carried forwardly relative to the bottle 170 with the nozzle 116.

There now follows descriptions of alternative sealing arrangements that could be used in the fluid dispenser 110, with like reference numerals being used to indicate like parts and features with the sealing arrangement in FIGS. 1 to 15.

In FIGS. 18 and 19A-B there is shown a first alternative tip seal arrangement that could be used in the fluid dispenser 110. In FIG. 18, the sealing member 154' and nozzle insert 197' are of different shape compared to their counterparts in the fluid dispenser 110 of FIGS. 1 to 15, but function in the same way as their counterparts. However, the forward end wall 165*b* of the cap 165 is now biased by the return spring 118 into direct contact with the rear face 154*b'* of the sealing member 154'. This is due to removal of the step or shoulder in the central aperture 197*d'* of the nozzle insert 197' which supports the sealing member 154 of FIGS. 1 to 15 to allow a lengthened sealing member 154' to pass through into contact with the sealing cap 165. The nozzle insert 197' and sealing member 154' are of the same materials as described for the fluid dispenser 110 of FIGS. 1 to 15.

In FIG. 20 there is shown a second alternative tip seal arrangement that could be used in the fluid dispenser 110 having similarity with the first alternative tip seal arrangement. In this second alternative, the sealing member 154" and nozzle insert 197" are of different shape to their counterparts in the first alternative of FIGS. 18 and 19A-B, but function in the same way, and are made from the same materials, as those counterparts In FIG. 21 there is shown a different type of sealing arrangement for the fluid dispenser 110, with FIGS. 22 to 25 showing the components for this sealing arrangement.

In place of the elastic sealing member 154 there is provided an annular backing plate 254 (FIGS. 23A-B), made from a plastics material. In this embodiment, the backing plate is injection moulded from polypropylene (PP). The forward face 254*c* of the backing plate 254 is held by a modified nozzle insert 297 (FIGS. 24A-B) in sealing engagement with the forward end wall 116*i* of the nozzle 116 so as to seal over the swirl chamber feed channels 153*b* whereby any liquid travelling up the gap between the side face 254*d* of the backing plate 254 and the nozzle 116 has to pass into the swirl chamber feed channels 153*b*. It will be seen the a longitudinal groove or flute 254*y* is provided in the plate side face 254*d* as a fluid flow path between the plate 254 and the nozzle 116.

A sealing pin 255 (FIGS. 22A-B) is seated on the nozzle insert 297 so that a forward sealing section 255*a* of the sealing pin 255 protrudes through the through-hole 254*n* in the backing plate 254 and into the central chamber 153*a* of the swirl chamber 153 to sealing close the passageway 153*c*. Thus, the sealing pin 255 functions similarly to the elastic sealing member 154.

As shown in FIG. 21, the sealing pin 255 has an enlarged, rear end 255*b* of tapering profile which is held captive in a through-hole 265*n* in the forward end wall 265*b* of a modified cap 265 (FIGS. 25A-B) so that the sealing pin 255 moves in unison with the main housing 112 to which the cap 265 is fixed.

It will therefore be appreciated that the return spring 118 acts on the main housing 112 to bias the sealing pin 255 into sealing engagement over the swirl chamber passageway 153*c*. Moreover, during the dispensing phase of the forward stroke of the piston member 114 in the dosing chamber 120, the hydraulic pressure produced in the fluid dispensement chamber 146 results in the cap 265 moving rearwardly against the return spring force, and in so doing moves the sealing pin 255 rearwardly so as to open the swirl chamber passageway 153*c* for release of the metered volume of liquid.

It will be observed that the sealing pin 255 is provided with forward and rear annular flanges 255*c*, 255*d*. The rear flange 255*d* delimits the insertion of the sealing pin 255 into the cap through-hole 265*n*. The forward flange 255*c* seals against the rear side of the backing plate 254.

It will further be observed that the valve element 191 of the valve mechanism 189 in the main housing 112 is provided with an abbreviated length to accommodate the sealing pin 255.

The sealing pin 255 in this embodiment is injection moulded from low density polyethylene (LDPE) or high density polyethylene (HDPE), but other functionally equivalent plastics materials could be used.

The modified cap 265 and modified nozzle insert 297 are made from the same materials are described for the corresponding parts in the fluid dispenser 110 of FIGS. 1 to 15. The modified nozzle insert 297 may also have a castellated forward end wall 297*c*, as in the other illustrated nozzle inserts 197; 197'; 197'I.

The arrangement of FIGS. 21-25 could in turn be modified so that the sealing pin 255 is integrally formed (e.g. moulded) as part of the cap 265. The rear annular flange 255*d* and/or the rear end 255*b* may then be omitted. Additionally, or alternatively, the forward annular flange 255*c* may be omitted and the pin 255 or the inner circumferential surface of the sealing member 254 may be provided with a lip seal to seal therebetween. This latter option could be used as another independent variant of the tip seal arrangement of FIG. 21, i.e. when the pin 255 is a separate component from the cap 265 as otherwise shown in FIG. 21.

Referring now to the fluid dispenser 310 shown in FIGS. 16A-J, this functions in the same way as the fluid dispenser 110 of FIGS. 1 to 15. The sealing tip 360, sealing member 354, forward sealing element 328 and stopper portion 376 are of a slightly different structure to the corresponding components in the fluid dispenser 110. More particularly, the tip seal arrangement is of the alternative type described with reference to FIG. 20. Most notably, however, is the absence of a carrier member for the return spring 318 in the fluid dispenser 310. It will be seen from FIG. 16A that an annular retaining wall 376*t* projects forwardly from the roof 376*c* of the stopper portion 376 (see also FIG. 31). As further shown in FIG. 16A, the return spring 318 is carried on the stopper portion roof 376*c* and extends forwardly to the annular flange 312*b* of the main housing 312 through the annular gap formed between the annular retaining wall 376*t* and the main housing 312. It will also be appreciated that the fluid dispenser 310 does not have an open position, like the fluid dispenser 110, for improving protection against damage if dropped or otherwise impacted.

FIG. 26 shows a further fluid dispenser 410 which corresponds to the fluid dispenser 110 of FIGS. 1 to 15, other than in two notable respects. Firstly, the tip seal arrangement is of the alternative type described with reference to FIGS. 18 and 19A-B, although any of the others described herein could also be used. Secondly, a modified forward sealing element 448 is fixed on the piston 414. The forward sealing element 448 in this embodiment is fixed against movement on the piston 414 and provides no through channel for fluid to flow therethrough from the rear side to the forward side, as in the fluid dispenser 110. The modified forward sealing element 448 functions like the forward sealing element 148 in the fluid dispenser 110 in the forward stroke of the piston 414 to its forward position; i.e. the forward lip seal 448*a* slidingly seals against the forward dosing chamber section 420*a* so that a metered dose of the fluid is pumped through the valve 489. However, on the return rearward stroke of the piston 414 to its rear position, the pressure difference created across the resilient forward lip seal 448*a* of the forward sealing element 448 causes the forward lip seal 448*a* to flex or deform inwardly to create an annular space thereabout for the fluid in the dosing chamber 420 to flow forwardly past the forward lip seal 448*a* into the forward dosing chamber section 420*a* in front of the retreating piston 414. Thus, the resiliency of the forward lip seal 448*a* allows the forward sealing element 448 to function as a one-way valve which opens in the initial phase of the return stroke thereby avoiding the creation of any hydraulic lock in front of the piston member 414 which could otherwise prevent or inhibit the return stroke.

If air happens to be trapped in the forward section 420*a* of the dosing chamber 420, for instance in the annular space in the forward sealing element 448 behind the lip seal 448*a*, the lip seal 448*a* may stay in sliding sealing contact with the wall of the forward dosing chamber section 420*a* during the rearward, return stroke of the piston member 414 and no hydraulic lock results due to the presence of the afore-mentioned air. In other words, there is no deflection of the lip seal 448*a*. When the lip seal 448*a* passes into the step 420*s*, the fluid is then drawn by the pressure difference into the forward dosing section 420*a*, e.g. through the at least one axial flute 420*d*.

However, preferably no air, or substantially no air, is trapped in the dosing chamber forward section 420*a* so that the forward lip seal 448*a* acts as a one-way valve.

In the rest position of the dispenser 410, the forward lip seal 448*a* is in contact with that section of the dosing chamber wall in which the axial flute(s) 420*d* is defined (cf. FIG. 3B). However, the dispenser 410 may be adapted so that at rest the forward lip seal 448*a* is spaced rearward of the flute(s) 420*d* so as to be spaced away from the dosing chamber wall.

FIG. 27 shows another alternative fluid dispenser 510 which functions in the same way as the fluid dispenser 410 of FIG. 26, with like features being denoted by like reference numbers and the differences now being elaborated upon.

Firstly, as also shown in FIG. 28, the forward sealing element 548 has a subtly different shape, being flared at its rear end 548*d* and provided with at least one axial groove or flute 548*m* in its outer peripheral surface which extends forwardly from the rear end 548*d*. The flared rear end 548*d* prevents the main housing 512 catching on the forward lip seal 528*a* of the rear sealing element 528 as it moves relatively rearwardly over the piston member 514 in assembly of the fluid dispenser 510. In this regard, the forward lip seal 528*a* of the rear sealing element 528 is provided with a rounded lip (not shown). The outer diameter of the rear end 548*d* of the forward sealing element 548 is at least the same as the inner diameter of the forward lip seal 528*a* of the rear sealing element 528. Thus, when the main housing 512 slides relatively rearwardly over the piston member 514 in assembly, the rear end 548*d* of the forward sealing element 548 guides the rear end of the main housing 512 onto the rounded surface of the forward lip seal 528*a* of the rear sealing element 528, which in turn guides the rear end of the main housing 512 to slide thereover.

The rear lip seal 528*b* may also be provided with a rounded lip to form a symmetrical rear sealing element 528 which may be mounted on the piston member 114 either way round for simplifying assembly. Alternatively, just the forward lip seal 528*a* may have a rounded lip, with the rear lip seal 528*a* being, e.g., square cut.

Although the rear end 548*d* of the forward sealing element 548 is still spaced from the inner circumferential surface of the dosing chamber 520, as shown in FIG. 27, albeit less than in the hitherto described embodiments, the axial flute 548*m* reduces the resistance to fluid flow around the rear end 548*d* of the forward sealing element 548 on movement of the piston member 514 in the dosing chamber 520.

Notwithstanding these structural differences, the rear and forward sealing elements 528, 548 still function in the same way as their counterparts in the fluid dispenser 410 of FIG. 26.

Secondly, the stopper portion 576 has a series of minor protrusions 576*p* which, unlike the minor roof protrusions of the fluid dispenser 410 (see FIGS. 9A and 9B), form extensions of the roof opening 576*e* and have a tapered lead-in surface 576*u* to guide the main housing 512 into the roof opening 576*e* in assembly of the fluid dispenser 510.

Thirdly, the carrier member 595 for the return spring 518 has a series of radially inwardly-directed protrusions 595*h* at the rear end of the annular body 595*a* which interfit with the stopper portion minor protrusions 576*p* to prevent rotation of the carrier member 512 relative to the stopper portion 576 and also to align the carrier member 595 in the correct angular orientation so that the clips thereof (not shown) will clip into the T-shaped tracks (not shown) in the nozzle 516, as previously described for the fluid dispenser 110 of FIGS. 1 to 15. Conveniently, there are twice as many carrier member protrusions 595*h* as stopper portion minor protrusions 576*p*, with the carrier member protrusions 595*h* arranged into pairs. The carrier member protrusions 595*h* in each pair are located on opposing sides of one of the stopper portion minor protrusions 576*p*. As shown, the return spring 518 is supported on top of the carrier member protrusions 595*h*.

The carrier member 595 further has a pair of diametrically opposed arms 595*j* extending radially outwardly from the annular body 595*a* at its rear end.

Fourthly, the forward end wall 597*c* of the nozzle 597 has a subtly different geometry to reduce the dead volume in the dispenser 510, in particular in the fluid dispensement chamber 546.

Fifthly, the at least one axial flute 520*d* has a different geometry than that in FIG. 26 (which in turn corresponds to that in FIGS. 1 to 15 and 16). In this embodiment, the at least one flute 520*d* is arranged such that, when the dispenser 510 is at rest, the forward lip seal 548*a* is located adjacent the at least one flute 520*d*, but spaced away therefrom; i.e. there is an annular space around the lip seal 548*a* when it is at its rest, rearward position in the dosing chamber 520. In this way, the potential for creep of the forward lip seal 548*a* into the at least one flute 520*d* is avoided.

In this embodiment, the sides edges of the at least one flute 520*d* are angled to the longitudinal axis, rather than stepped as in the previous embodiments. The side edges of the at least one flute 520*d* may form an acute angle to the longitudinal axis, for instance in the range of 8° to 12°, such as 10°, and provide a lead-in surface to guide movement of the forward lip seal 548*a* into the forward dosing chamber section 520*a* on the forward stroke of the piston member 514. The floor of the at least one flute 520*d* may form a steeper acute angle to the longitudinal axis, for instance in the range of 15° to 25°, such as 20°.

FIG. 29 shows an alternative tip seal arrangement for the fluid dispenser 510. Like the dispenser 110 of FIGS. 1 to 15, the extent to which the sealing tip 560 of the cap 565 presses against the sealing member 554 is controlled through the inter-engagement of the forward end wall 565*b* with the rear side of the end wall 597*c* of the nozzle insert 597.

It will be observed that the sealing tip 560 in this embodiment has a concave form through provision of a recess 560*a*' therein. The sealing member 554 is formed (e.g. moulded) with a rear bulge 554*s*' on its rear side to fit in the recess 560*a*'. Moreover, the sealing member 554 is formed (e.g. moulded) with a forward bulge 554*t*' on its forward side to close the fluid outlet 552. When the fluid dispenser 510 is in its normal, rest state, the forward bulge 554*t*' is forced to seal against the fluid outlet passageway 553*c* by the force applied by the sealing tip 560 to the rear bulge 554*s*'. However, when the sealing cap 560 is forced rearwardly by the increased fluid pressure created in the fluid dispensement chamber 546 as the piston member 514 pumps a metered volume of fluid through the one-way valve (see 589, FIG. 27), the force applied to the rear bulge 554*s*' is released therefore enabling the forward bulge 554*t*' to relax rearwardly and open the fluid outlet passageway 553*c*. In effect, in the normal, rest position the sealing tip 560 compresses the rear bulge 554*s*' and in so doing pushes the forward bulge 554*t*' outwardly. When the sealing tip 560 moves rearwardly, both bulges 554*s*', 554*t*' are able to move back towards their rest state due to the inherent bias of the material (e.g. a thermoplastic elastomer, such as EPDM) from which the sealing member 554 is made, resulting in a space forming between the sealing member 554 and the fluid outlet passageway 553*c*, whereby a metered volume of fluid is able to be pumped from the fluid outlet 552, via the swirl chamber 553, as an atomised spray.

In yet another alternative tip seal arrangement, not shown, the rear bulge 554*s*' may be omitted and the sealing tip 560 used to push the forward bulge 554*t*' outwardly into sealing engagement with the fluid outlet passageway 553*c*. The sealing tip 560 in this case may also be modified to have a convex free end, such as in the fluid dispensers in FIGS. 1 to 26.

These arrangements using a forward bulge 554*t*' in the sealing member 554 concentrate the tip forces in the centre of the sealing member 554, where the sealing of the fluid outlet passageway 553*c* is needed, and reduce the tip forces applied to the sealing member 554 over the swirl chamber feed channels, thereby reducing the likelihood of these channels being occluded (e.g. by creep of the sealing member 554).

In FIGS. 30A and 30B there is shown a modified stopper portion 676 for use in the afore-described fluid dispensers. This stopper portion 676 corresponds closely to that of FIGS. 9A and 9B, but is provided with just two minor protrusions 676*p*, each forming a radial extension from one of the main protrusions 676*n*.

FIG. 31 shows a further modified stopper portion 776 for the afore-described fluid dispensers in which the carrier member for the return spring is formed as an integral part 776*t* of the stopper portion 776, preferably integrally formed therewith. It will be appreciated that use of such a stopper portion 776 precludes the associated fluid dispenser having the open (fully extended) position achieved with a separate carrier member, as in, for example, the fluid dispenser 110 of FIGS. 1 to 15.

FIGS. 32 and 33 show a bottle 870, preferably of plastic, for use in any of the foregoing fluid dispensers. The bottle 870 is provided with anti-rotational features, here two diametrically-opposed pairs of axial ribs 870*a* which are located in a groove 870*b* defined between a pair of axially spaced-apart circumferential beads 870*c*, to prevent rotation of the bottle 870 in the stopper portion 876 mounted thereon. As shown in FIG. 33, the internal surface of the stopper portion 876 is also provided with anti-rotational features, here the angular segments of the circumferentially-oriented bead 876*q*, which co-operate with the bottle anti-rotational features 870*a* to prevent relative rotation therebetween. Thus, the angular orientation of the bottle 870 relative to the features of the stopper portion 870 can be pre-set in the assembly of the fluid dispenser. It will also be appreciated that the annular segments 876*q* fit into the circumferential groove 870*b* to axially locate the bottle 870 relative to the stopper portion 876.

It will be noted that the bottle 870 has a tapered bottom 870*d*, here of V-section, into which the inlet of the supply tube (not shown) extends. In this way, all or substantially all of the fluid will be drawn from the bottle 870, unlike the case where the bottle has a flat bottom.

In a modification to the above-described embodiments, not shown, the bottle seal may be omitted and a bore seal formed between the bottle neck and the inner annular skirt of the stopper portion.

In another modification to the above-described embodiments, not shown, the rear open end of the nozzle may be chamfered to provide a lead-in or guide surface for guiding insertion of the dispenser components thereinto.

In another modification to the above-described embodiments, not shown, the sealing cap (e.g. the sealing tip) may be connected to the sealing member so that when the sealing tip is moved rearwardly relative to the nozzle insert, at least the central portion of the sealing member sealing the fluid outlet is pulled rearwardly therewith to open the fluid outlet for dispensement of the metered volume of fluid.

FIG. 37 shows a further modification for any of the previously described fluid dispensers 110; 310; 410; etc. in which the forward end 848*c*' of the forward sealing element 848' has a forwardly extending projection or spigot 848*s*' of length to project into the restricted bore section 812*e*' in the main housing 812' when the piston member 814' is at its forward-most position in the dosing chamber 820' and thereby prop up the valve member 891' so as to stop the one-way valve 889' reclosing under the action of the return spring 893' when the fluid pressure in front of the piston member 814' drops. In this way, the one-way valve 889' is only able to reclose once the piston member 814' has moved sufficiently rearwardly back towards its rest position to remove the spigot 848*s*' from the restricted bore section 812*e*', for instance rearward movement by 0.1-0.2 mm. By holding the one-way valve open 889' longer, it is believed this will prevent or inhibit the formation of fluid bubbles over the fluid outlet on the nozzle 816' after a dispensing cycle by giving time for pressure inside the dispenser to be relieved at the end of the forward stroke of the piston member. Of course, alternative ways of holding the one-way valve 889' open at the end of the forward stroke of the piston member 814' can be envisaged, for instance, as shown in FIG. 38, having a projection 891*s*" on the rear end 891*d*" of the valve member 891". Such a projection on the valve member may be instead of, or in addition to, a projection 848*s*' on the forward sealing element. The piston member could also carry a projection.

One of the benefits of the tip seal arrangements disclosed herein, additional to those previously documented, is that they provide a commitment feature to the fluid dispenser, in that a higher operating force (the "commitment force") is required at the start of the dispensing cycle to create the fluid pressure to overcome the sealing force applied to the sealing member by the sealing tip. Once the tip seal arrangement is opened, the commitment force is released to produce fast release of the fluid through the fluid outlet. This assists in providing accurate metering and reproducible fluid properties in each metered volume dispensed, such as droplet size distribution.

It will be understood that the afore-described fluid dispenser embodiments may be modified to include one or more of the components or features of the other embodiments. Moreover, it is to be understood that the materials described for making a component of one embodiment may also be used for the corresponding component of the other embodiments.

The fluid dispensers herein described with reference to FIGS. 1 to 33, 37 and 37 may be coupled with an actuator configured to effect the afore-described reciprocal relative movement of the nozzle assembly and the bottle/fluid supply assembly for priming and then repeated dispensing of a metered volume of fluid.

In this regard, possible such actuators are described and illustrated in UK patent application No. 0723418.0 filed 29 Nov. 2007, the content of which is incorporated herein by reference.

Another possible actuator is shown in FIGS. 34 to 36, which actuator operates according to the same general principle as those in UK patent application No. 0723418.0.

In FIG. 34, there is shown a fluid dispenser 910, corresponding to any of those of FIGS. 1 to 33 and 37, having been inserted into, and coupled to, an actuator 4405, which has a hollow, rigid plastics housing 4409 (e.g. made of ABS) of external appearance similar to that of the VERAMYST® nasal sprayer sold by GlaxoSmithKline, and shown in US-A-2007/0138207 which is hereby incorporated herein by reference, including having a window (not shown) for viewing the amount of fluid left in the fluid supply 970. A window may be provided on each side of the housing 4409.

The fluid dispenser 910 is received in the housing 4409 such that its longitudinal axis L-L is aligned with (i.e. in-line or co-axial with) the longitudinal axis X-X of the housing 4409 (the "housing axis"). The fluid dispenser 910 is mounted in the housing 4409 for reciprocal translation along its longitudinal axis L-L and the housing axis X-X.

For simplicity, the following description will mainly refer to the housing axis X-X, but it is to be understood that each such reference applies equally to the longitudinal axis L-L.

The actuator 4405 comprises a finger-operable actuator mechanism 4415 to apply a lifting force to the fluid dispenser 910 directed along the axis X-X to result in the fluid dispenser 910 pumping a metered dose of the fluid from the nozzle 916. More particularly, the lifting force applied by the finger-operable actuator mechanism 4415 causes the bottle assembly (including the piston member, not shown) to translate forwardly along the axis X-X relative to the nozzle assembly (including the main housing, not shown) so that a metered dose of fluid is released (assuming priming has already occurred).

As shown, the finger-operable actuator mechanism 4415 is mounted to the housing 4409 so as to be movable (i) inwardly, in an actuating direction which is transverse to the axis X-X, from the rest position of FIG. 34 to an operational position (not shown) to effect the forward dispensing movement of the bottle assembly of the fluid dispenser 910, and (ii) outwardly, in an opposite, return direction which is transverse to the axis X-X, from the operational position back to the rest position to enable the fluid dispenser 910 to reset ready for the next actuation to release another metered dose of the fluid. This reversible inward transverse movement of the finger-operable actuator mechanism 4415 is able to continue until no more fluid is able to be pumped from the bottle 910 (i.e. until the bottle 910 is empty or nearly empty of the fluid).

The finger-operable actuator mechanism 4415 has two members, namely (i) a finger-operable, rigid first member 4420 mounted to the housing 4409 to move inwardly-outwardly transversely to the axis X-X relative to the housing 4409, and (ii) a second rigid member 4425 carried on the first member 4420 so as to move therewith and to lift the bottle assembly of the fluid dispenser 910. The first and second members are made from a plastics material, and may be of ABS (e.g. Teluran® ABS (BASF)) and acetal, respectively.

As will be understood from FIGS. 34 and 36, the first member 4420, which in this instance is a lever, is formed separately from the housing 4409.

The first member 4420 is pivotally mounted to the housing 4409 so that the inward-outward movement of the first member 4420 transverse to the axis X-X is an arcuate movement. The first member 4420 has a rear end 4420*a* which fits into an axial channel 4409*b* formed in the housing 4409 and about which the first member 4420 pivots.

The second member 4425 is pivotally mounted on the first member 4420 such that upon application of an inward transversely-directed force (arrow F, FIG. 34) to the first member 4420 by a user's finger(s) and/or thumb, which can be of the same hand holding the actuator 4405, the second member 4425 is able to pivot in an anti-clockwise sense (arrow A, FIG. 34) as it is carried inwardly by the inwardly moving first member 4420. In this particular instance, the second part 4425 is a crank, more particularly a bell crank.

In more detail, and referring in part to FIGS. 35A and 35B, the bell crank 4425 has a mounting section 4426 for mounting to the lever 4420 and a first pair of arms 4425*a*, 4425*b* extending from one end of the mounting section 4426. The mounting section 4426 of the bell crank 1425 is pivotally mounted to the lever 4420 at a fixed pivot point 4427.

As shown in FIGS. 35A and 35B, the bell crank 4425 further comprises an identical second pair of arms 4425*a*, 4425*b* extending from the other end of the mounting section 4426. The result of this bell crank configuration is that the fluid dispenser 910 is straddled by the first (rear) arm 4425*a* of each pair of arms, the first arm 4425*a* of the first pair being on the near side as viewed in FIG. 34 and the corresponding first arm of the second pair being on the far side.

The first (rear) arms 4425*a* of each pair extend in a direction generally transverse to the axis X-X, whereas the second (forward) arms 4425*b* are angled more forwardly towards the nozzle 916.

The bell crank 4425 has a generally inverted Y-shape with the first and second arms 4425*a*, 4425*b* forming the outer limbs and the mounting portion 4426 the inner limb. As can be seen, there is an angle of less than 90° between the first and second arms 4425*a*, 4425*b*.

As shown, the mounting portion 4426 comprises a spindle 4426*a* for pivotal connection to the lever 4420. Referring to FIG. 36A, the spindle 4426*a* is clipped to a bracket 4220*q* presented on the inner surface 4220*d* of the lever 4220.

As will be appreciated from FIG. 35C, the configuration of the second arm 4425*b* in each pair is such that when the bell crank 4425 travels inwardly with the lever 4420, an inner surface 4428 of the second arms 4425*b* contacts an axially-oriented pusher surface 4429 in the housing 4409 thereby causing the bell crank 4425 to pivot in the anti-clockwise sense A about the pivot point 4427. In fact, the second arms 4425*b* also slide up the pusher surface 4429 as the bell crank 4425 moves inwardly with the lever 4420. The engagement of the second arms 4425*b* on the pusher surface 4429 helps to guide the pivotal movement of the bell crank 4425 and also supports the bell crank 4425 when lifting the bottle assembly of the fluid dispenser 910.

The pusher surface 4429 for the second arms 4425*b* may be presented by a single wall feature of the housing 4409 or, as here, by separate housing wall features, one for each second arm 4425*b*.

The pivotal movement of the bell crank 4425 in the anti-clockwise sense A, on inward movement of the lever 4420, causes a lifting surface 4431 of each first arm 4425*a* to contact a respective bearing surface 976*u* provided by diametrically-opposed embossments 976*r* provided on the stopper portion 976 of the fluid dispenser 910.

To use the actuator 4405 to actuate the fluid dispenser 910, the user grasps the actuator 4405 in one hand and places a thumb and/or finger of that hand on the lever 4420. The user places the nozzle 916 in their nostril (or a nostril of another person) and applies a transverse force F to the lever 4420 so that the lever moves arcuately inwardly from the rest position to the operational (or actuated) position. In so doing, this causes the bell crank 4425 to pivot in the anti-clockwise sense A and the lifting surfaces 4431 of the first arms 4425*a* to act on the bearing surfaces 976*u* of the stopper portion embossments 976*r* to lift the bottle assembly of the fluid dispenser 910 upwardly relative to the stationary nozzle assembly and cause release of a metered dose of the fluid medicament into the nasal cavity (assuming the fluid dispenser 910 has been primed). The user then releases the force F applied to the lever 4420 to allow the return spring 918 to reset the actuator mechanism 4415 and the fluid dispenser 910 to their rest positions shown in FIG. 34.

The user would then repeat the lever operation one or more times to release a corresponding number of further metered doses. The number of medicament doses to spray into the nasal cavity at any given time would be determined by the dosing regimen for the fluid medicament being administered. The dosing procedure can then be repeated until all, or nearly all, of the fluid in the bottle 910 has been administered.

To guide the reciprocal displacement of the fluid dispenser 910 in the housing 4409 along the axis X-X upon lever operation, the pair of diametrically-opposed embossments 976*r* of the stopper portion 976 each have a track 976*v* and a lead-in surface 976*t*. When the fluid dispenser 910 is mounted in the housing 4409, the rotary position of the stopper portion 976 is set such that the tracks 976*v* align with complementary, axially-oriented runners (not shown) formed on the inside surface of the housing 4409. In use, when the fluid dispenser 910 is axially displaced in the housing 4409, the tracks 976*v* ride over the runners. The co-operation of the tracks 976*v* with the runners not only guides the longitudinal displacement of the fluid dispenser 910 in the housing 4409, but also prevents the stopper portion 976, and in fact the bottle assembly as a whole, from rotating in the housing 4409. It will be appreciated that runners could be provided on the fluid dispenser 910 and complementary tracks provided on the inside of the housing 4409 to like effect.

The actuator 4405 further comprises a protective end cap (not shown) for mounting on the forward end of the housing 4409 to cover and protect the nozzle 916. The end cap is of the type used in VERAMYST® and disclosed in US-A-2007/0138207, having a pair of rearwardly extending lugs for receipt within suitably arranged channels 4451*a*, 4451*b* provided to the forward end of the housing 4409 to securely attach the end cap to the housing 4409 to cover the nozzle 916. The protective end cap also has, on its inner surface, a rearwardly-facing, resilient stopper of convex form arranged for sealing engagement with the fluid outlet 952 in the nozzle 916 when the end cap is in the nozzle covered position. The end cap is suitably made from the same material as the housing 4409, e.g. a plastics material, suitably ABS. The stopper may be made from a thermoplastic elastomer, for example SANTOPREN®).

When the cap is in the nozzle covered position, one of the lugs interferes with movement of the finger-operable actuator mechanism 4415, and in this particular instance the lever 4420 thereof, such as to prevent actuation (i.e. to lock movement) of the actuator mechanism 4415 when the end cap and lugs are in place (i.e. in the nozzle covered position) in much the same way as in VERAMYST® and disclosed in US-A-2007/0138207. In more detail, the forward end of the lever 4420 has a solid tab 4448. The tab 4448 bears against the inner edge of the slot 4409*a* to prevent the lever 4420 being moved outwardly through the slot 4409*a*. In addition, when the protective cap is received on the forward end of the actuator housing 4409 to cover the nozzle 916, one of the dependent lugs of the cap locates in front of the tab 4448 to prevent the lever 4420 moving inwardly. Thus, to use the actuator 4405, a user first has to remove the protective end cap.

The assembly of the actuator 4405 and the insertion of the fluid dispenser 910 therein will now be outlined.

The housing 4409 comprises forward and rear housing halves 4409*e*, 4409*f*, which snap fit together. Before the forward and rear housing halves 4409*e*, 4409*f* are snap-fitted together, the rear end 4420*a* of the lever 4420 is inserted into the retaining channel 4409*b* formed in the rear housing half 4409*f* so that the finger-operable actuator mechanism 4415 is retained by the rear housing half 4409*f*. To ensure that the bell crank 4425 is oriented correctly with reference to the pusher surfaces 4429 presented by the forward housing half 4409*e* after assembly of the housing 4409, the bell crank 4425 is pivoted anti-clockwise A while the housing halves 4409*e*, 4409*f* are snapped together. The bell crank 4425 then pivots back in the clockwise direction so that the second arms 4425*b* contact the housing pusher surfaces 4429.

After the housing halves 4409*e*, 4409*f* are assembled, the fluid dispenser 910 is inserted into the housing 4409 through a rear opening 4471*a* until the nozzle 916 is received in a forward opening 4471*b*. In this regard, the funnel-shaped lead-in surface 976*t* at the forward end of each track 976*v* of the stopper portion 976 helps guide the tracks 976*v* onto the runners in the housing 4409 when the fluid dispenser 910 is inserted or loaded into the housing 4409 through the rear opening 4471*a* of the housing 4409.

Moreover, the housing inner surface may be provided with a complementary profile to that of the outer plan profile of the stopper portion embossments 976*r* (see FIG. 30B).

The forward housing half 4409*e* has resilient clips 4409*h* adjacent the forward opening 4471*b* for a snap-fit connection to the nozzle 916. To limit the axial insertion of the nozzle 916 in the housing 4409, the nozzle 916 is provided with a series of protrusions or ribs 916*p* (cf. feature 116*p* in FIG. 10A) on opposing sides thereof which abut the underside of the forward end of the housing 4409 when the clips 4409*h* engage the nozzle 916. As a result, the nozzle 916 is fixed against movement relative to the housing 4409.

As the fluid dispenser 910 moves forwards in the housing 4409 towards its forward end, the shoulder 916*d* and an outer skirt 916*s* of the nozzle 916 push on the underside of the first arms 4425*a* of the bell crank 4425 so that the bell crank 4425 pivots anti-clockwise A so as not to impede insertion of the fluid dispenser 910 to the position where it snap-fits in the housing 4409.

The bell crank 4425 is integrally formed with a spring leg 4480 projecting from the mounting portion 4426. When the bell crank 4425 is pivoted anti-clockwise A towards the forward end of the housing 4409 by the nozzle 916 on insertion of the fluid dispenser 910 into the housing 4409 during assembly, the spring leg 4480 is brought into engagement with the inner surface 4420*d* of the lever 4420 so as to be loaded. Once the embossments 976*r* on the stopper portion 976 pass the first (rear) arms 4425*a* of the bell crank 4425, the loading in the spring leg 4480 is released to pivot the bell crank 4425 back rearwardly so that the first bell crank arms 4425*a* are disposed underneath the embossment bearing surfaces 976*u* and the second bell crank arms 4425*b* bear on the housing pusher surfaces 4429.

The fluid dispenser 910 is moved to its fired position during insertion into the housing 4409 by an insertion force applied thereto. The insertion force is removed when the fluid dispenser 910 is snap-fitted into the housing 4409 whereby the return spring 918 moves the bottle assembly away from the captive nozzle assembly (i.e. towards the housing rear open end 4471*a*). As the spring leg 4480 of the bell crank 4425 has already pivoted the bell crank 4425 back to its rest position against the pusher surfaces 4429, the subsequent return movement of the stopper portion 976 brings the bearing surfaces 976*u* of the embossments 976*r* of the stopper portion 476 into engagement with, or into close proximity to, the associated lifting surfaces 4431 of the first arms 4425*a* of the bell crank 4425, as shown in FIG. 34, so that inward movement of the lever 4420 would now cause the bell crank 4425 to lift the bottle assembly.

The rear opening 4471*a* is subsequently closed with an end cap (not shown), e.g. made of ABS, and the actuator 4405 is then "ready for use".

The bell crank spring leg 4480 has particular utility in enabling the assembly of the fluid dispenser 910 to the actuator 4405 in an inverted state (i.e. upside down to the orientation shown in FIG. 34). The spring leg 4480 overcomes the gravity force tending to keep the bell crank 4425 in the forward pivot position once the nozzle 916 is past the bell crank lifting arms 4425*a*.

If the actuator 4405 is dropped, or subject to other impacts, so as to cause the fluid dispenser 910 to move to its fully extended (open) position (i.e. where a separate carrier member 995 is used), when the stopper portion 976 moves farther away from the nozzle 916 the embossments 976*r* force the bell crank 4425 to distort, since the lever 4420 cannot move outwardly due to the lever tab 4448. In more detail, the first or lifting arms 4425*a* of the bell crank 4425 are forced to flex rearwardly due to the rearward force applied thereto by the embossments 976*r*. This keeps the bell crank lifting arms 4425*a* in engagement with the respective embossment bearing surfaces 976*u*, whereby simply pushing the lever 4420 inwardly will lift the bottle assembly forwardly to reset the fluid dispenser 910 in its rest position.

The actuator 4405 may be modified to have another corresponding actuating mechanism (not shown) on the other side of the housing 4409. The user would squeeze the levers 4420 together and in so doing cause the associated bell cranks 4425 to lift the bottle assembly forwardly from each side thereof.

As stated, the fully extended position, and its ability to prevent parts of the fluid dispenser 910 breaking in a drop event, is not available where the carrier member 995 is integrated with the stopper portion 976. However, where the bottle 970 is made from a lightweight material compared to glass, e.g. a plastics material, this drop resistance feature may not be strictly necessary, although perhaps still preferred for added protection. In other words, use of an integrated stopper portion 976 and carrier member 995 might need to be in combination with a lightweight, e.g. plastics, bottle 970, for instance such as that shown in FIG. 32.

Those parts of the fluid dispenser or actuator herein described which are made from a plastics material are typically formed by a moulding process, and more typically by injection moulding.

In the exemplary embodiments the sealing arrangement at the fluid outlet 152; 352; 452; etc of the fluid dispenser 110; 310; 410; etc acts to prevent or inhibit the ingress of microbials and other contaminants into the dispenser 110; 310; 410; etc through the fluid outlet 152; 352; 452; etc and hence into the dosing chamber 120; 320; 420; etc and ultimately the bottle/reservoir of the fluid. Where the fluid is a liquid medicament formulation, e.g. for nasal administration, this enables the formulation to be free of preservatives or, perhaps more likely, to be a preservative-sparing formulation. In addition, the seal acts to prevent or inhibit the pending dose of the fluid in the dosing chamber from draining back into the supply or reservoir when the dispenser is in its rest configuration between actuations. This avoids or reduces the need for the dispenser to be primed for its next usage (priming then only effectively being required for the very first usage of the fluid dispenser so as to fill the dosing chamber, but not after the first usage).

In a modification of the fluid dispensers 110; 310; 410; etc herein, a sealing tubular sleeve, e.g. in the form of a gaiter, may be placed over the fluid dispenser so that it is sealed at one (rear) point (e.g. at or near a rear sleeve end) to the outer surface of the stopper portion 176; 376; 476; etc or fluid supply 170; 370; 470; etc and at another (forward) point (e.g. at or near a forward sleeve end) to the outer surface of the nozzle 116; 316; 416; etc. The material for the sealing sleeve is selected to be impervious to microbials and other contaminants, as are the seals formed between the sleeve and the dispenser parts. Suitable materials and seal techniques would be known to the skilled reader. Such a sealing sleeve would further protect the dispensers from microbial and other contaminant ingress thereinto. It would also allow the sealing tolerances inside the dispensers (i.e. other than the tip seal arrangement and the bottle seal 171; 371; 471; etc) to be reduced, since these seals (e.g. 128*a,b*/328*a,b*/428*a,b*; 165*h*; 365*h*/465*h*; 197*p* etc) would then be the second line of defence against ingress other than through the dispensing outlet 152; 352; 452; etc. The sleeve would need to accommodate the movement of the attached dispenser parts towards and away from one another, e.g. be expandable and/or contractible or have a length of sleeve material between the seal points at the maximum distance of separation thereof which is not stretching at that maximum distance, e.g. by having an excess length of sleeve material between the seal points. Slack in the sleeve material may therefore occur between the sleeve seal points when the dispenser parts are moved towards one another in the firing phase. The use of such a sealing sleeve would find use in other dispensers having one (e.g. rear) part which moves relative to another (e.g. forward) part to actuate the dispenser. The sealing sleeve would be sealed to each part.

The fluid dispenser of the invention may be used to dispense a liquid medicament formulation, e.g. for the treatment of mild, moderate or severe acute or chronic symptoms for prophylactic/palliative treatment. The precise dose administered will depend on the age and condition of the patient, the particular medicament used and the frequency of administration and will ultimately be at the discretion of the attendant physician. When combinations of medicaments are employed the dose of each component of the combination will in general be that employed for each component when used alone.

Appropriate medicaments for the formulation may be selected from, for example, analgesics, e.g., codeine, dihydromorphine, ergotamine, fentanyl or morphine; anginal preparations, e.g., diltiazem; antiallergics, e.g., cromoglycate (eg as the sodium salt), ketotifen or nedocromil (eg as the sodium salt); antiinfectives e.g., cephalosporins, penicillins, streptomycin, sulphonamides, tetracyclines and pentamidine; antihistamines, e.g., methapyrilene; anti-inflammatories, e.g., beclomethasone (eg as the dipropionate ester), fluticasone (eg as the propionate ester), flunisolide, budesonide, rofleponide, mometasone (eg as the furoate ester), ciclesonide, triamcinolone (eg as the acetonide), 6α, 9α-difluoro-11β-hydroxy-16α-methyl-3-oxo-17α-propionyloxy-androsta-1,4-diene-17β-carbothioic acid S-(2-oxo-tetrahydro-furan-3-yl) ester or 6α, 9α-Difluoro-17α-[(2-furanylcarbonyl)oxy]-11β-hydroxy-16α-methyl-3-oxo-androsta-1,4-diene-17β-carbothioic acid S-fluoromethyl ester; antitussives, e.g., noscapine; bronchodilators, e.g., albuterol (eg as free base or sulphate), salmeterol (eg as xinafoate), ephedrine, adrenaline, fenoterol (eg as hydrobromide), formoterol (eg as fumarate), isoprenaline, metaproterenol, phenylephrine, phenylpropanolamine, pirbuterol (eg as acetate), reproterol (eg as hydrochloride), rimiterol, terbutaline (eg as sulphate), isoetharine, tulobuterol or 4-hydroxy-7-[2-[[2-[[3-(2-phenylethoxy)propyl]sulfonyl]ethyl] amino]ethyl-2(3H)-benzothiazolone; PDE4 inhibitors eg cilomilast or roflumilast; leukotriene antagonists eg montelukast, pranlukast and zafirlukast; [adenosine 2a agonists, eg 2R,3R,4S,5R)-2-[6-Amino-2-(1S-hydroxymethyl-2-phenyl-ethylamino)-purin-9-yl]-5-(2-ethyl-2H-tetrazol-5-yl)-tetrahydro-furan-3,4-diol (e.g. as maleate); [α4 integrin inhibitors eg (2S)-3-[4-({[4-(aminocarbonyl)-1-piperidinyl] carbonyl}oxy)phenyl]-2-[((2S)-4-methyl-2-{[2-(2-methylphenoxy)acetyl]amino}pentanoyl)amino] propanoic acid (e.g as free acid or potassium salt), diuretics, e.g., amiloride; anticholinergics, e.g., ipratropium (eg as bromide), tiotropium, atropine or oxitropium; hormones, e.g., cortisone, hydrocortisone or prednisolone; xanthines, e.g., aminophylline, choline theophyllinate, lysine theophyllinate or theophylline; therapeutic proteins and peptides, e.g., insulin or glucagons. It will be clear to a person skilled in the art that, where appropriate, the medicaments may be used in the form of salts, (e.g., as alkali metal or amine salts or as acid addition salts) or as esters (e.g., lower alkyl esters) or as solvates (e.g., hydrates) to optimise the activity and/or stability of the medicament and/or to minimise the solubility of the medicament in the propellant.

Preferably, the medicament is an anti-inflammatory compound for the treatment of inflammatory disorders or diseases such as asthma and rhinitis.

In one aspect, the medicament is a glucocorticoid compound, which has anti-inflammatory properties. One suitable glucocorticoid compound has the chemical name: 6α, 9α-Difluoro-17α-(1-oxopropoxy)-11β-hydroxy-16α-methyl-3-oxo-androsta-1,4-diene-17β-carbothioic acid S-fluoromethyl ester (fluticasone propionate). Another suitable glucocorticoid compound has the chemical name: 6α,9α-difluoro-17α-[(2-furanylcarbonyl)oxy]-11β-hydroxy-16α-methyl-3-oxo-androsta-1,4-diene-17β-carbothioic acid S-fluoromethyl ester. A further suitable glucocorticoid compound has the chemical name: 6α,9α-Difluoro-11β-hydroxy-16α-methyl-17α-[(4-methyl-1,3-thiazole-5-carbonyl)oxy]-3-oxo-androsta-1,4-diene-17β-carbothioic acid S-fluoromethyl ester.

Other suitable anti-inflammatory compounds include NSAIDs e.g. PDE4 inhibitors, leukotriene antagonists, iNOS inhibitors, tryptase and elastase inhibitors, beta-2 integrin antagonists and adenosine 2a agonists.

Other medicaments which may be comprised in the formulation are 6-({3-[(Dimethylamino)carbonyl] phenyl}sulfonyl)-8-methyl-4-{[3-(methyloxy) phenyl] amino}-3-quinolinecarboxamide; 6a,9a-Difluoro-11b-hydroxy-16a-methyl-17a-(1-methycyclopropylcarbonyl) oxy-3-oxo-androsta-1,4-diene-17b-carbothioic acid S-fluoromethyl ester; 6a,9a-Difluoro-11i-hydroxy-16a-methyl-3-oxo-17a-(2,2,3,3-tetramethycyclopropylcarbonyl) oxy-androsta-1,4-diene-17i-carbothioic acid S-cyanomethyl ester; 1-{[3-(4-{[4-[5-fluoro-2-(methyloxy)phenyl]-2-hydroxy-4-methyl-2-(trifluoromethyl)pentyl] amino-6-methyl-1H-indazol-1-yl)phenyl]carbonyl}-D-prolinamide; and the compound disclosed in International patent application No. PCT/EP2007/053773, filed 18 Apr. 2007, in Example 24, and in particular the form which is 24C therein.

The fluid dispenser herein is suitable for dispensing fluid medicament formulations for the treatment of inflammatory and/or allergic conditions of the nasal passages such as rhinitis e.g. seasonal and perennial rhinitis as well as other local inflammatory conditions such as asthma, COPD and dermatitis.

A suitable dosing regime would be for the patient to inhale slowly through the nose subsequent to the nasal cavity being cleared. During inhalation the formulation would be applied to one nostril while the other is manually compressed. This procedure would then be repeated for the other nostril. Typically, one or two inhalations per nostril would be administered by the above procedure up to three times each day, ideally once daily. Each dose, for example, may deliver 5 μg, 50 μg, 100 μg, 200 μg or 250 μg of active medicament. The precise dosage is either known or readily ascertainable by those skilled in the art.

All usage herein of terms such as "about", "approximately", "substantially" and the like in relation to a parameter or property is meant to include the exact parameter or property as well as immaterial deviations therefrom.

The embodiments of the present invention described above are purely illustrative. The present invention relates to every novel aspect disclosed herein. Moreover, the present invention is not restricted to fluid dispensers used for administration of medicaments, but to fluid dispensers in general.

What is claimed is:

1. A fluid dispenser for use with a fluid supply, the dispenser having a dosing chamber, a fluid outlet, and a piston member which is arranged to sealingly stroke in the dosing chamber (i) in a first direction for filling the dosing chamber with fluid from the supply, and (ii) in a second direction to dispense fluid from the dosing chamber towards the fluid outlet, wherein:

the dosing chamber has first and second sections of different widths, the first section is narrower than the second section and located in the second direction relative to the second section, the piston member is in constant sealing contact with the second section as it strokes in the first and second directions, but only in sealing contact with the first section in a portion of the strokes in the first and second directions, the first and second sections are in fluid communication when the piston member is not in sealing contact with the first section, the sealing contact of the piston member with the first section as the piston member strokes in the second direction is such that the first section is sealed-off from the second section and that the piston member is able to pump fluid present in the sealed-off first section towards the fluid outlet, the piston member has a fluid conduit for communicating with the fluid supply and through which, in use, fluid is conveyed from the fluid supply into the dosing chamber when the piston member strokes in the first direction, and the fluid conduit has an outlet comprising at least one opening positioned on the piston member to register with the second section of the dosing chamber so that fluid is conveyed from the fluid supply into the second section.

2. The dispenser of claim 1, wherein the piston member has a seal to sealingly contact with the first section, which seal has an outer dimension which is no less than the width of the first section and less than the width of the second section.

3. A fluid dispenser for use with a fluid supply, the dispenser having a dosing chamber, a fluid outlet, and a piston member which is arranged to sealingly stroke in the dosing chamber (i) in a first direction for filling the dosing chamber with fluid from the supply, and (ii) in a second direction to dispense fluid from the dosing chamber towards the fluid outlet, wherein:

the dosing chamber has first and second sections of different widths, the first section is narrower than the second section and located in the second direction relative to the second section, the piston member is in constant sealing contact with the second section as it strokes in the first and second directions, but only in sealing contact with the first section in a portion of the strokes in the first and second directions, the piston member has a seal to sealingly contact with the first section, which seal has an outer dimension which is no less than the width of the first section and less than the width of the second section, the sealing contact of the piston member seal with the first section as the piston member strokes in the second direction is such that the first section is sealed-off from the second section and that the piston member is able to pump fluid present in the sealed-off first section towards the fluid outlet, and the piston member seal forms a one-way valve to allow fluid flow from the second section to the first section during the stroke of the piston member in the first direction with the piston member seal in the first section.

4. The dispenser of claim 3, wherein the seal is a resilient lip-seal which flexes during the stroke of the piston member in the first direction to permit fluid to flow pass.

5. The dispenser of claim 4, wherein the seal is located on an end of the piston member.

6. The dispenser of claim 1, wherein the piston member has a seal to sealingly contact the second section of the dosing chamber.

7. The dispenser of claim 3, wherein the piston member has a fluid conduit for communicating with the fluid supply and through which, in use, fluid is conveyed from the fluid supply into the second section of the dosing chamber when the one-way valve formed by the piston member seal opens during the stroke of the piston member in the first direction.

8. The dispenser of claim 7 wherein the fluid conduit has an outlet comprising at least one opening positioned on the piston member to register with the second section of the dosing chamber so that, in use, fluid is conveyed from the fluid supply into the second section.

9. The dispenser of claim 1 or 7 adapted such that, in use, as the piston member strokes in the second direction fluid in the dosing chamber is bled from the dosing chamber until the piston member sealingly contacts the first section of the dosing chamber.

10. The dispenser of claim 1 or 3 which comprises a valve between the first section of the dosing chamber and the fluid outlet which remains closed as the piston member strokes in the second direction before it comes into sealing contact with the first section.

11. The dispenser of claim 3 wherein the one-way valve is adapted to open to enable fluid to pass into the first section of the dosing chamber as the piston member strokes in the first direction with the seal in sealing contact with the first section.

12. The dispenser of claim 1 or 3, wherein the dosing chamber has a step between the first and second sections.

13. The dispenser of claim 1 or 3, wherein the dosing chamber is provided with at least one fluid flow channel extending from the first section to the second section.

14. The dispenser of claim 1 or 3, wherein the first and second sections of the dosing chamber are co-axial.

15. The dispenser of claim 1 or 3, comprising a container for the fluid supply, and wherein the piston member is mounted to the container so as to be fixed against relative movement therebetween in the first and second directions.

16. The dispenser of claim 15, wherein the piston member is comprised in a cap structure mounted on the container.

17. The dispenser of claim 16, wherein the cap structure is a stopper of the container.

18. The dispenser of claim 15, wherein the dosing chamber is provided in a nozzle of the fluid dispenser in which the fluid outlet is formed.

19. The dispenser of claim 18, wherein the nozzle is mounted on the container for relative movement therebetween to cause the piston member to stroke in the first and second directions in the dosing chamber.

20. The dispenser of claim 18, wherein the piston member is comprised in a cap structure mounted on the container having the nozzle mounted on the cap structure for relative movement therebetween.

21. The dispenser of claim 1, wherein the first and second sections of the dosing chamber are respectively forward and rearward sections, wherein the piston member is mounted to reciprocate forwardly in the second direction and rearwardly in the first direction in the dosing chamber, wherein sealing contact between the piston member and the forward section of the dosing chamber is formed by a seal presented by the piston member which is to sealingly slide on a wall of the forward section of the dosing chamber, and wherein the seal is adapted in use to come out of sealing contact with the wall of the forward section of the dosing chamber during the rearward stroke to enable fluid to flow forwardly past the seal into the forward section of the dosing chamber in front of the piston member for filling of the forward section.

22. The dispenser of claim 21, wherein the seal is a lip seal which is adapted to deflect inwardly during the rearward stroke.

23. The dispenser of claim 10, wherein the first and second sections of the dosing chamber are respectively forward and rearward sections, wherein the forward section of the dosing chamber has an outlet which the valve is biased to close, wherein the piston member is mounted to reciprocate forwardly in the second direction and rearwardly in the first direction in the dosing chamber, wherein a rearward stroke of the piston member enables the forward section of the dosing chamber to fill with fluid from the fluid supply and a forward stroke of the piston member pumps fluid present in the forward section of the dosing chamber through the outlet in the dosing chamber, and wherein the dispenser is configured and arranged such that the valve is kept open against the valve bias at the end of the forward stroke of the piston member.

24. The dispenser of claim 23, wherein the piston member and valve are configured and arranged to cooperate to keep the valve open at the end of the forward stroke.

25. The dispenser of claim 24, wherein the piston member and valve have cooperating surfaces through which the piston member holds the valve open at the end of the forward stroke.

26. The dispenser of claim 24, wherein at least one of the piston member and the valve has a projection which acts on the other so that the valve is held open at the end of the forward stroke of the piston member.

27. The dispenser of claim 1 or 3, wherein the piston member is arranged to stroke in the first direction to an end of stroke position at which the piston member is not disposed in the first section of the dosing chamber.

* * * * *

UNITED STATES PATENT AND TRADEMARK OFFICE

CERTIFICATE OF CORRECTION

PATENT NO. : 8,678,243 B2
APPLICATION NO. : 12/601361
DATED : March 25, 2014
INVENTOR(S) : Collins et al.

It is certified that error appears in the above-identified patent and that said Letters Patent is hereby corrected as shown below:

In the Claims

In Column 36, lines 3-6

Original:

"20. The dispenser of claim 18, wherein the piston member is comprised in a cap structure mounted on the container having the nozzle mounted on the cap structure for relative movement therebetween."

should read,

"20. The dispenser of claim 18, wherein the piston member is comprised in a cap structure mounted on the container <u>and</u> having the nozzle mounted on the cap structure for relative movement therebetween."

Signed and Sealed this
Seventh Day of April, 2015

Michelle K. Lee

Michelle K. Lee
*Director of the United States Patent and Trademark Office*